US011495906B2

(12) United States Patent
Yamamoto et al.

(10) Patent No.: US 11,495,906 B2
(45) Date of Patent: Nov. 8, 2022

(54) CONNECTOR ASSEMBLY INCLUDING A CONNECTOR AND A MATING CONNECTOR LOCKABLY ENGAGEABLE WITH EACH OTHER

(71) Applicant: JAPAN AVIATION ELECTRONICS INDUSTRY, LIMITED, Tokyo (JP)

(72) Inventors: Masao Yamamoto, Tokyo (JP); Michael Zayc, Hampshire (GB); David Schneider, Hampshire (GB); Stuart Kingswell, Hampshire (GB)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 17/237,220

(22) Filed: Apr. 22, 2021

(65) Prior Publication Data

US 2021/0351538 A1 Nov. 11, 2021

(30) Foreign Application Priority Data

May 7, 2020 (JP) ..... JP2020-081861

(51) Int. Cl.
*H01R 13/436* (2006.01)
*H01R 13/502* (2006.01)
(Continued)

(52) U.S. Cl.
CPC ..... *H01R 13/4361* (2013.01); *H01R 13/502* (2013.01); *H01R 13/53* (2013.01); *H01R 13/639* (2013.01)

(58) Field of Classification Search
CPC .... H01R 13/53; H01R 13/502; H01R 13/504; H01R 13/506; H01R 13/514; H01R 13/4361; H01R 13/639
(Continued)

(56) References Cited

U.S. PATENT DOCUMENTS 3,829,821 A * 8/1974 Derr ..... H01R 13/633 439/304
4,971,567 A * 11/1990 Mizuno ..... H04M 1/0293 439/441
(Continued)

FOREIGN PATENT DOCUMENTS

DE 102007010515 B3 9/2008
JP H07114135 A 5/1995
(Continued)

OTHER PUBLICATIONS

Extended European Search Report (EESR) dated Sep. 27, 2021 issued in counterpart European Application No. 21170899.5.

*Primary Examiner* — Marcus E Harcum
(74) *Attorney, Agent, or Firm* — Holtz, Holtz & Volek PC

(57) ABSTRACT

A connector assembly comprises a connector and a mating connector. The mating connector comprises a mating housing. The mating housing is formed with a release projection. The connector comprises a first housing and a second housing. The first housing is provided with a stopper. The second housing is provided with a stopped portion. One of the first housing and the second housing is provided with a second support portion which supports a supported portion. When the second housing is installed to the first housing, the stopped portion is brought into abutment with the stopper, and a movement of the second housing is regulated by the stopper. When the thus-regulated second housing is received into the mating housing together with the first housing, one of the second support portion and the supported portion is brought into abutment with the release projection so that the regulation of the second housing is released.

11 Claims, 25 Drawing Sheets

(51) Int. Cl.
*H01R 13/53* (2006.01)
*H01R 13/639* (2006.01)

(58) Field of Classification Search
USPC ..... 439/686, 599, 752, 353, 355, 701, 712
See application file for complete search history.

(56) References Cited

U.S. PATENT DOCUMENTS 4,997,386 A * 3/1991 Kawachi ..... H01R 13/6272 439/352
5,681,178 A 10/1997 Kunkle et al.
5,928,038 A * 7/1999 Berg ..... H01R 13/6272 439/752
6,261,116 B1 * 7/2001 Ceru ..... H01R 13/6272 439/352
6,638,108 B2 * 10/2003 Tachi ..... H01R 13/4223 439/701
7,011,553 B2 * 3/2006 Hayashi ..... H01R 13/5812 439/942
7,588,461 B2 9/2009 Tyler
7,641,499 B1 1/2010 George et al.
7,811,115 B1 10/2010 Tyler
8,083,533 B2 * 12/2011 De Chazal ..... H01R 13/648 200/51.09
8,597,043 B2 12/2013 Zhao
8,747,168 B2 * 6/2014 Kida ..... H01R 13/506 439/701
8,998,653 B2 * 4/2015 Kamiya ..... H01R 13/627 439/701
9,017,108 B2 * 4/2015 Suemitsu ..... H01R 13/4223 439/701
9,039,458 B2 * 5/2015 Tsuchiya ..... H01R 13/4365 439/701
10,177,480 B2 * 1/2019 Choi ..... H01R 13/6275
2002/0173198 A1 * 11/2002 Plate ..... H01R 13/4362 439/752
2005/0032404 A1 * 2/2005 Furuta ..... H01R 13/641 439/157
2005/0196943 A1 * 9/2005 Ishiwa ..... H01R 13/641 438/489
2015/0200484 A1 * 7/2015 Randolph ..... H01R 13/4368 439/686
2016/0204539 A1 * 7/2016 Kwon ..... H01R 13/506 439/701
2017/0250502 A1 8/2017 Endo et al.
2017/0365424 A1 * 12/2017 Tabata ..... H01H 21/22
2018/0358750 A1 12/2018 Miyamura et al.

FOREIGN PATENT DOCUMENTS

JP H09017505 A 1/1997
JP 2010056088 A 3/2010
JP 2011515788 A 5/2011
JP 2012511805 A 5/2012
JP 2014512065 A 5/2014

* cited by examiner

CONNECTOR ASSEMBLY INCLUDING A CONNECTOR AND A MATING CONNECTOR LOCKABLY ENGAGEABLE WITH EACH OTHER

CROSS REFERENCE TO RELATED APPLICATIONS

This application is based on and claims priority under 35 U.S.C. § 119 to Japanese Patent Application No. JP 2020-081861 filed May 7, 2020, the content of which is incorporated herein in its entirety by reference.

BACKGROUND OF THE INVENTION

This invention relates to a connector assembly comprising a connector and a mating connector.

For example, this type of connector assembly is disclosed in JP2010-56088 (Patent Document 1), the content of which is incorporated herein by reference.

As shown in FIGS. 45 to 47, Patent Document 1 discloses a connector assembly 900 which comprises a female high-voltage connector 910, a female high voltage interlock loop (HVIL) connector 930, a male high-voltage connector 950 and a male HVIL connector 970. The female high-voltage connector 910 is mateable with the male high-voltage connector 950 along the X-direction. The female high-voltage connector 910 has a latch device 918 and a slide member 916 which is slidable in the X-direction. The latch device 918 has a latch handle 919 and a locking latch (not shown). The locking latch can be moved in the Z-direction by the latch handle 919. The female HVIL connector 930 is detachable from the female high-voltage connector 910. The female HVIL connector 930 is mateable with the male HVIL connector 970 along the X-direction. The female HVIL connector 930 has a low-voltage terminal 932 and an abutment portion 934. The male high-voltage connector 950 has a complementary recess 954. The male HVIL connector 970 is attached to the male high-voltage connector 950. The male HVIL connector 970 has a low-voltage terminal 972 and a stopping portion 976. When the female HVIL connector 930 is mated with the male HVIL connector 970 so that the low-voltage terminal 932 is connected to the low-voltage terminal 972, an HVIL circuit is closed, and electric power is supplied between the female high-voltage connector 910 and the male high-voltage connector 950. When the female HVIL connector 930 is detached from the male HVIL connector 970 so that the low-voltage terminal 932 is disconnected from the low-voltage terminal 972, the HVIL circuit is opened, and the electric power supplied between the female high-voltage connector 910 and the male high-voltage connector 950 is cut off.

According to the connector assembly 900, the following operation is necessary in order to supply the electric power between the female high-voltage connector 910 and the male high-voltage connector 950. First, as shown in FIG. 47, the female high-voltage connector 910 and the male high-voltage connector 950 are mated with each other along the X-direction. Meanwhile, the locking latch of the latch device 918 is engaged with the complementary recess 954 illustrated in FIG. 46 and locks the mating of the female high-voltage connector 910 with the male high-voltage connector 950. Then, the slide member 916 is pushed in the positive X-direction to be moved to the position shown in FIG. 46. As a result, the slide member 916 is located under the negative Z-side of the latch handle 919. Accordingly, even if the latch handle 919 is pushed in the negative Z-direction, the locking latch is moved in the positive Z-direction so that the lock of the mating is not released. Under this state, the female HVIL connector 930 is made to slide toward the male HVIL connector 970 so that the low-voltage terminal 932 is brought into contact with the low-voltage terminal 972 as shown in FIG. 45. As a result, the HVIL circuit is closed, and the electric power is supplied between the female high-voltage connector 910 and the male high-voltage connector 950. According to another operation in which the female HVIL connector 930 is made to slide toward the male HVIL connector 970 under a state where the slide member 916 is not pushed to the position shown in FIG. 46, the abutment portion 934 illustrated in FIG. 45 is brought into abutment with the stopping portion 976 illustrated in FIG. 46, and thereby the female HVIL connector 930 cannot be mated with the male HVIL connector 970. When the mating of the female high-voltage connector 910 and the male high-voltage connector 950 is released, a reverse operation of the aforementioned operation needs to be performed.

Since the connector assembly 900 of Patent Document 1 has a large number of components, there is a problem that its manufacturing process is complicated, and that its manufacturing cost increases.

SUMMARY OF THE INVENTION

It is therefore an object of the present invention to provide a new connector assembly which is more compact and has a smaller number of components than the existing connector assembly, and which is more easily operated than the existing connector assembly when the connectors thereof are mated with each other and removed from each other.

An aspect of the present invention provides a connector assembly comprising a connector and a mating connector. The mating connector comprises a first mating terminal, a second mating terminal and a mating housing. The mating housing holds the first mating terminal and the second mating terminal. The mating housing forms a receiving portion. The mating housing is formed with a release projection and a mating lock portion. The release projection projects into the receiving portion. The mating lock portion faces the receiving portion. The connector is mateable with the mating connector along a mating direction. The connector comprises a first terminal, a first housing, a second terminal and a second housing. The first housing is configured to be received into the receiving portion along the mating direction. The first housing holds the first terminal. The first terminal is connected to the first mating terminal when the first housing is received in the receiving portion. The first housing is provided with a stopper and a first structure which includes a first support portion and a lock portion. The first support portion has a restoring force and supports the lock portion. The lock portion is movable in a perpendicular direction perpendicular to the mating direction by using the restoring force of the first support portion. The lock portion and the mating lock portion lock a state where the first housing is received in the receiving portion when the first terminal is connected to the first mating terminal. The second housing holds the second terminal. The second housing is provided with a stopped portion and a regulation portion. One of the first housing and the second housing is provided with a second support portion. The second support portion has a restoring force and supports a supported portion which is one of the stopper and the stopped portion. The supported portion is movable in the perpendicular direction by using the restoring force of the second support portion. When the second housing is installed to the first housing along the mating direction, the stopped portion is brought into abutment with the stopper, and the second housing takes a regulated state where a movement of the second housing in the mating direction is regulated by the stopper. When the second housing under the regulated state is received into the receiving portion along the mating direction together with the first housing, the first terminal is connected to the first mating terminal, and then one of the second support portion and the supported portion is brought into abutment with the release projection so that a movement regulation of the second housing in the mating direction is released. When the second housing is further moved in the mating direction after release of the movement regulation, the second terminal is connected to the second mating terminal, and the regulation portion is located inward of at least a part of the first structure in the perpendicular direction to regulate a movement of the lock portion in the perpendicular direction.

According to the connector assembly of an aspect of the present invention, the mating housing of the mating connector is formed with the release projection, the first housing of the connector is provided with the stopper, the second housing of the connector is provided with the stopped portion and the regulation portion, and one of the first housing and the second housing is provided with the second support portion which supports the supported portion which is one of the stopper and the stopped portion. As can be seen from the above description, the functions of the slide member 916, the female HVIL connector 930 and the male HVIL connector 970 of Patent Document 1 are assigned to the mating connector and the connector according to the connector assembly of an aspect of the present invention, so that the connector assembly of an aspect of the present invention is more compact and has a smaller number of components than the connector assembly of Patent Document 1.

According to the connector assembly of an aspect of the present invention, when the second housing is installed to the first housing along the mating direction, the stopped portion is brought into abutment with the stopper, and the second housing takes the regulated state where the movement of the second housing in the mating direction is regulated by the stopper. When the second housing under the regulated state is received into the receiving portion of the mating connector along the mating direction together with the first housing, the first terminal is connected to the first mating terminal, and then one of the second support portion and the supported portion is brought into abutment with the release projection so that the aforementioned regulation is released. When the second housing is further moved in the mating direction after release of the aforementioned regulation, the second terminal is connected to the second mating terminal, and the regulation portion is located inward of a part of the first structure in the perpendicular direction to regulate the movement of the lock portion in the perpendicular direction. As described above, the connector assembly of an aspect of the present invention is configured so that the connection between the connector and the mating connector is completed only by an operation in which the connector under the state where the second housing is installed to the first housing is mated with the mating connector, and then the second housing is pushed toward the first housing. Thus, the connector assembly of an aspect of the present invention is more easily operated than the existing connector assembly when the connectors thereof are mated with each other and removed from each other in comparison with the connector assembly 900 of Patent Document 1.

An appreciation of the objectives of the present invention and a more complete understanding of its structure may be had by studying the following description of the preferred embodiment and by referring to the accompanying drawings.

Figure 1:
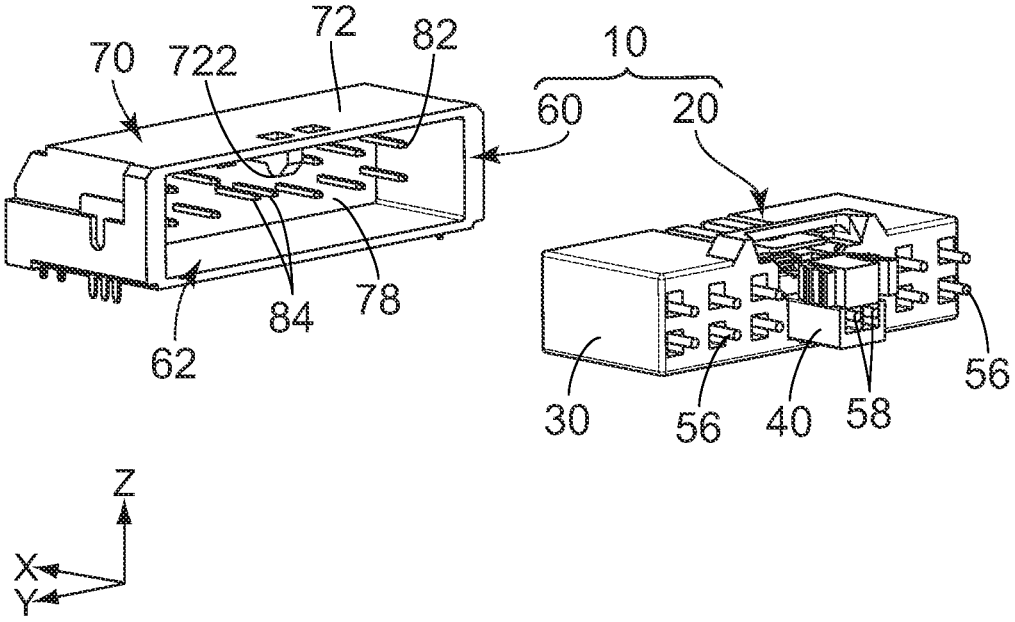
FIG. 1 is a perspective view showing a connector assembly according to a first embodiment of the present invention, wherein a connector and a mating connector of the connector assembly are under an unmated state where they are separated from each other, and a second housing of the connector is under a regulated state.
Figure 2:
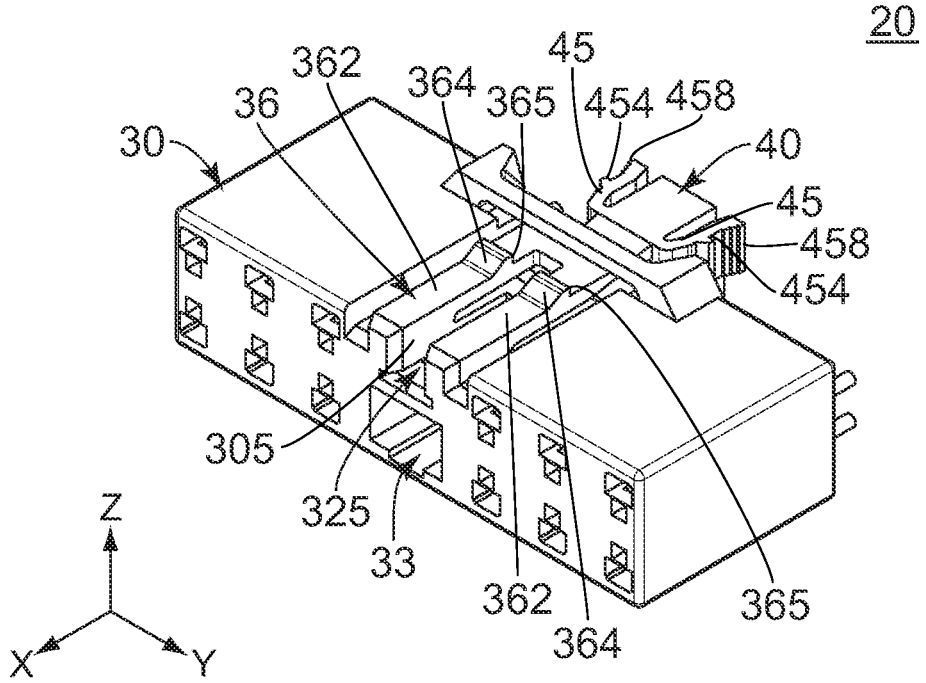
FIG. 2 is a perspective view showing the connector of the connector assembly of FIG. 1.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

First Embodiment

As shown in FIG. 1, a connector assembly 10 according to a first embodiment of the present invention comprises a mating connector 60 and a connector 20. The connector 20 and the mating connector 60 are mateable with each other. The connector assembly 10 has a connector position assurance (CPA) mechanism and a high-voltage interlock loop (HVIL) mechanism. The CPA mechanism locks a mated state where the connector 20 and the mating connector 60 are mated with each other. The HVIL mechanism is for preventing electric shock which might be caused by high-voltage power.

Figure 16:
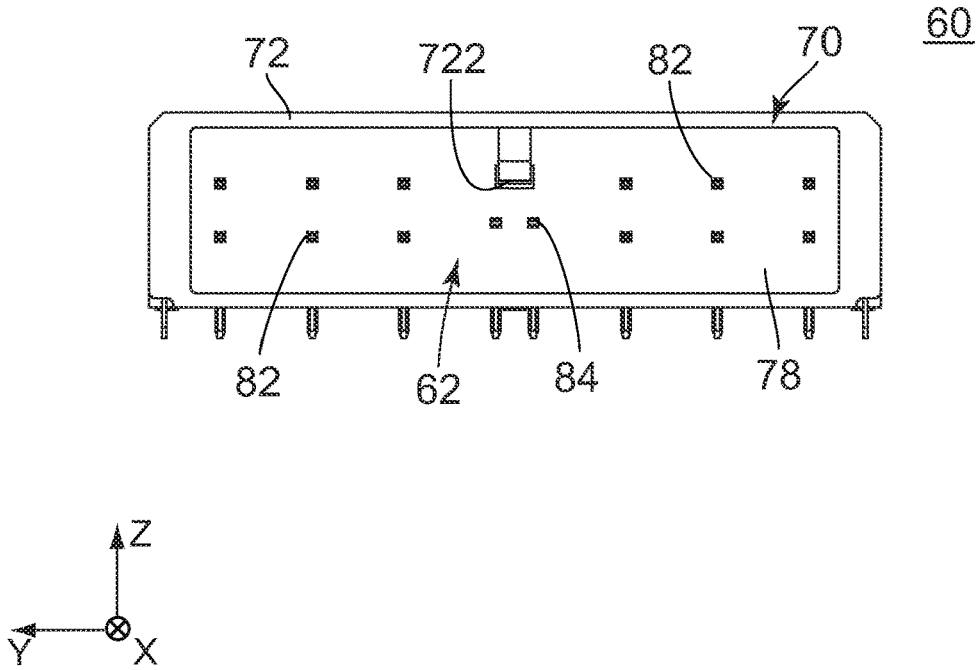
FIG. 16 is a rear view showing the mating connector of FIG. 14.

Referring to FIG. 16, the mating connector 60 of the present embodiment is configured to be mounted on a circuit board (not shown). The mating connector 60 comprises a mating housing 70, first mating terminals 82 and second mating terminals 84.

Figure 14:
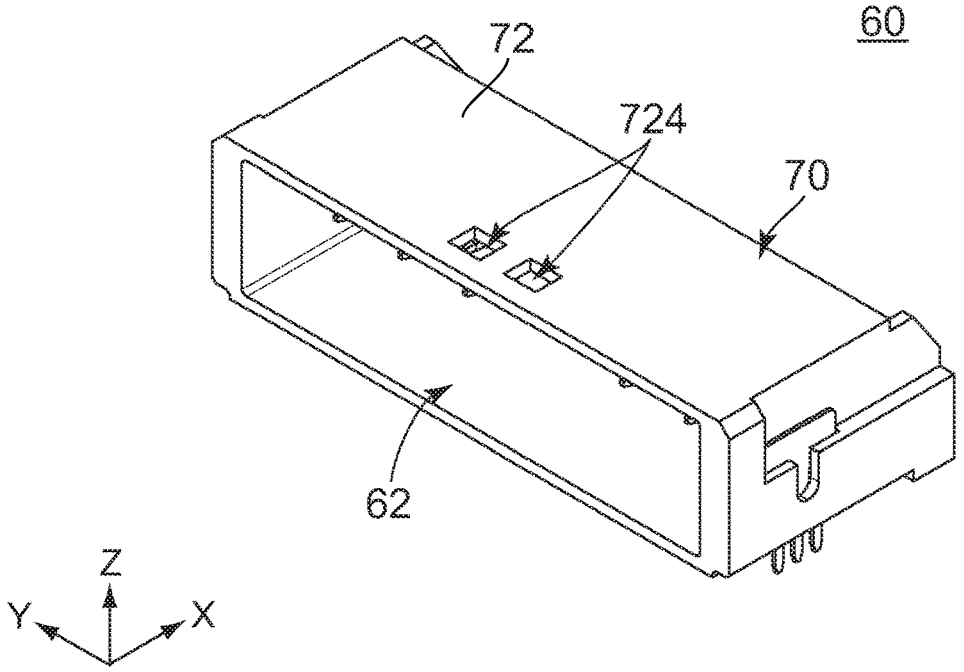
FIG. 14 is a perspective view showing the mating connector of the connector assembly of FIG. 1.

As shown in FIG. 16, the mating housing 70 of the present embodiment holds the first mating terminals 82 and the second mating terminals 84. As shown in FIG. 14, the mating housing 70 forms a receiving portion 62.

Figure 18:
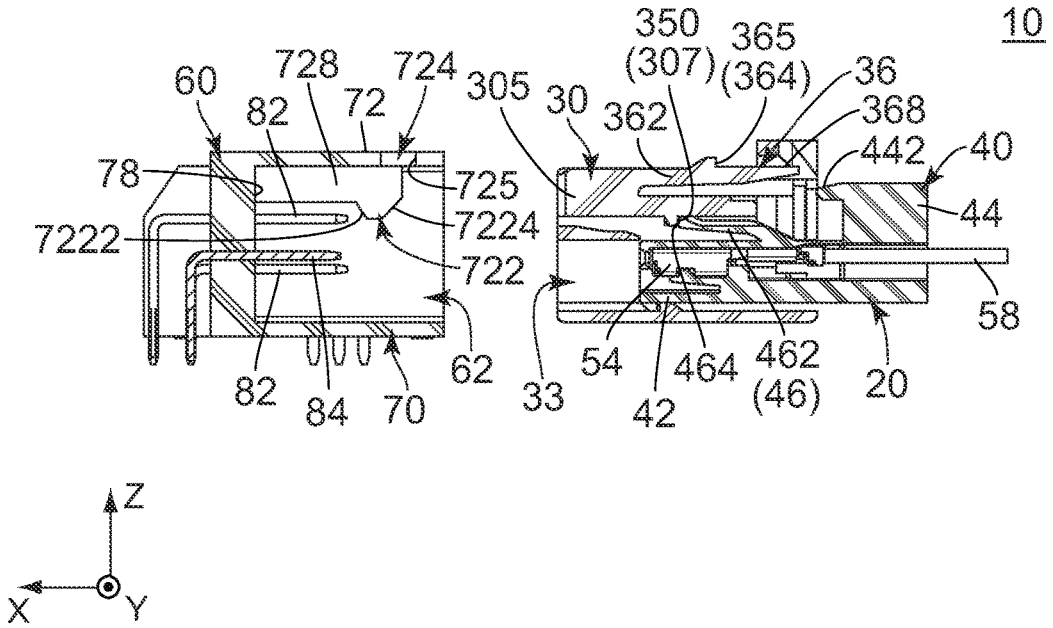
FIG. 18 is a cross-sectional view showing the connector assembly of FIG. 17, taken along line XVIII-XVIII, wherein the second terminal and the cable are illustrated not by their cross-sections but by their side surfaces.
Figure 19:
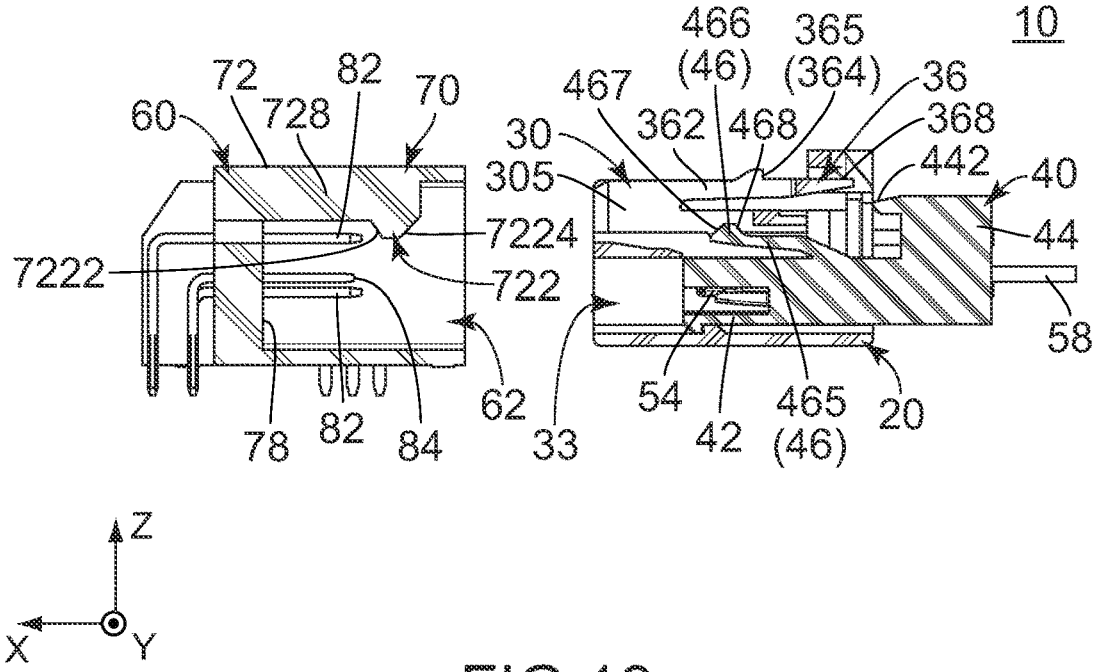
FIG. 19 is a cross-sectional view showing the connector assembly of FIG. 17, taken along line XIX-XIX.

As shown in FIGS. 18 and 19, the receiving portion 62 of the present embodiment is a space which extends in a front-rear direction. The front-rear direction of the present embodiment is the X-direction. A mating direction which will be described later is the positive X-direction. Forward is the positive X-direction, and rearward is the negative X-direction.

As shown in FIG. 19, the mating housing 70 has an upper plate 72 and a rear plate 78.

As shown in FIG. 19, the upper plate 72 of the present embodiment defines one of opposite ends of the mating housing 70 in a perpendicular direction perpendicular to the mating direction. The perpendicular direction of the present embodiment is the Z-direction. The perpendicular direction is also an upper-lower direction. Upward is the positive Z-direction, and downward is the negative Z-direction. Thus, the upper plate 72 defines an upper end of the mating housing 70 in the upper-lower direction.

As shown in FIG. 19, the rear plate 78 of the present embodiment defines a front end of the mating housing 70 in the front-rear direction. The receiving portion 62 is located rearward of the rear plate 78 in the front-rear direction.

Figure 15:
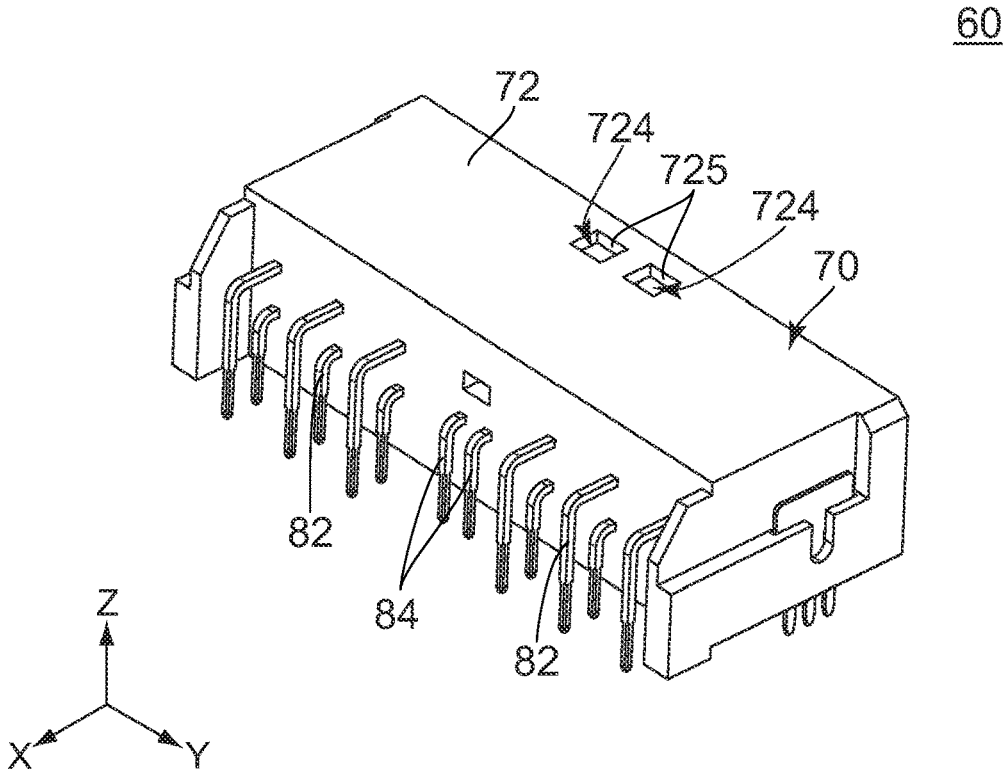
FIG. 15 is another perspective view showing the mating connector of FIG. 14.

As shown in FIGS. 15 and 18, the mating housing 70 is formed with a release projection 722, an extension portion 728, two lock holes 724 and two mating lock portions 725. However, the present invention is not limited thereto, but each of the number of the lock holes 724 and the number of the mating lock portions 725 may be one.

As shown in FIG. 16, the release projection 722 of the present embodiment projects into the receiving portion 62. The release projection 722 projects downward from the upper plate 72.

As shown in FIG. 19, the release projection 722 has a front surface 7222 and a rear surface 7224.

As shown in FIG. 19, the front surface 7222 of the present embodiment intersects with the front-rear direction. The front surface 7222 faces forward and downward. The front surface 7222 slopes rearward and downward.

As shown in FIG. 19, the rear surface 7224 of the present embodiment intersects with the front-rear direction. The rear surface 7224 faces rearward and downward. The rear surface 7224 slopes rearward and upward. The rear surface 7224 is located rearward of the front surface 7222 in the front-rear direction.

As shown in FIG. 19, the extension portion 728 of the present embodiment is located rearward of the rear plate 78 in the front-rear direction. The extension portion 728 is located forward of the release projection 722 in the front-rear direction. The extension portion 728 couples the rear plate 78 and the release projection 722 to each other in the front-rear direction. The extension portion 728 has a lower end which is located above a lower end of the release projection 722.

As shown in FIG. 18, each of the lock holes 724 of the present embodiment passes through the upper plate 72 in the upper-lower direction. Each of the lock holes 724 has an inner surface which faces forward in the front-rear direction. Each of the inner surfaces of the lock holes 724 works as the mating lock portion 725.

As shown in FIG. 18, each of the mating lock portions 725 of the present embodiment faces the receiving portion 62. Each of the mating lock portions 725 is a plane which faces forward in the front-rear direction.

Referring to FIG. 18, each of the first mating terminals 82 of the present embodiment is made of metal and has an L-like shape. Each of the first mating terminals 82 is a so-called pin contact. Each of the first mating terminals 82 has a lower end which is configured to be fixed and connected to a pad (not shown) of the circuit board via soldering, etc.

Referring to FIG. 18, each of the second mating terminals 84 of the present embodiment is made of metal and has an L-like shape. Each of the second mating terminals 84 is a so-called pin contact. Each of the second mating terminals 84 has a lower end which is configured to be fixed and connected to a pad (not shown) of the circuit board via soldering, etc.

Figure 17:
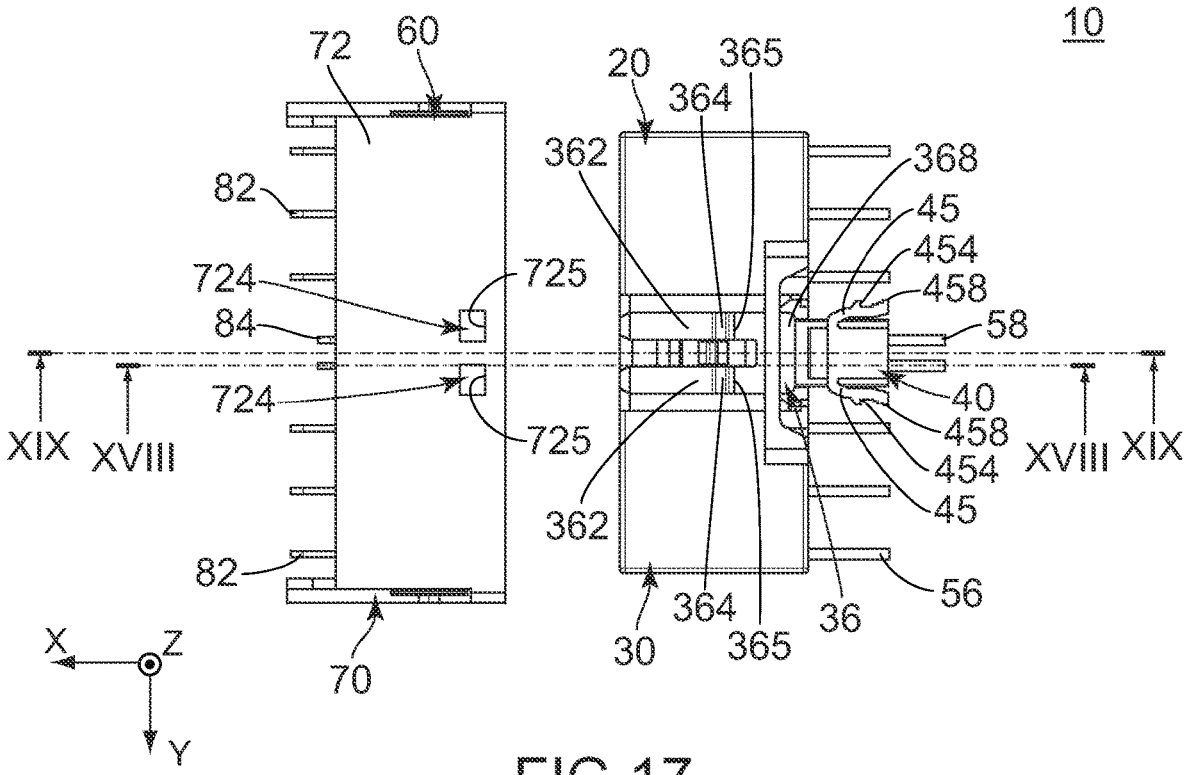
FIG. 17 is a top view for explanation about a mating process of the connector with the mating connector of the connector assembly of FIG. 1, wherein the connector and the mating connector are under the unmated state, and the second housing is under the regulated state.
Figure 20:
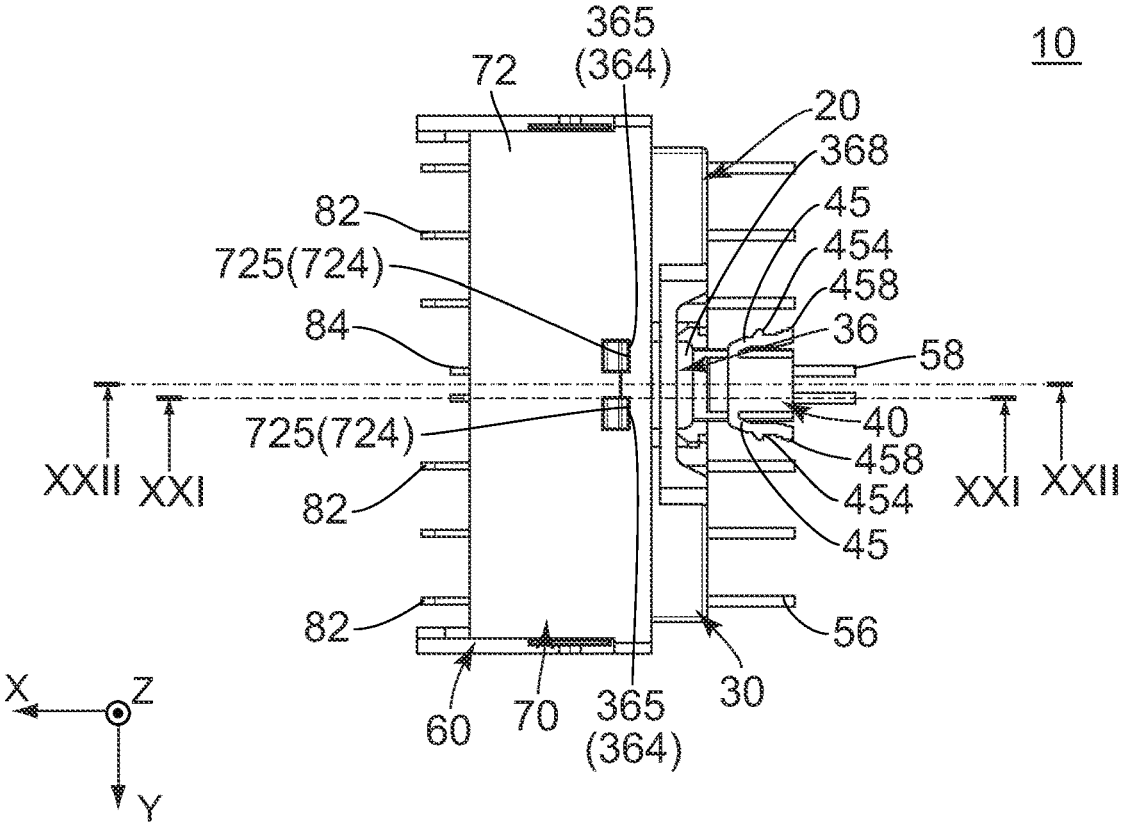
FIG. 20 is another top view for explanation about the mating process of the connector with the mating connector of the connector assembly of FIG. 1, wherein the first housing is received in a receiving portion, and the second housing is under the regulated state.
Figure 23:
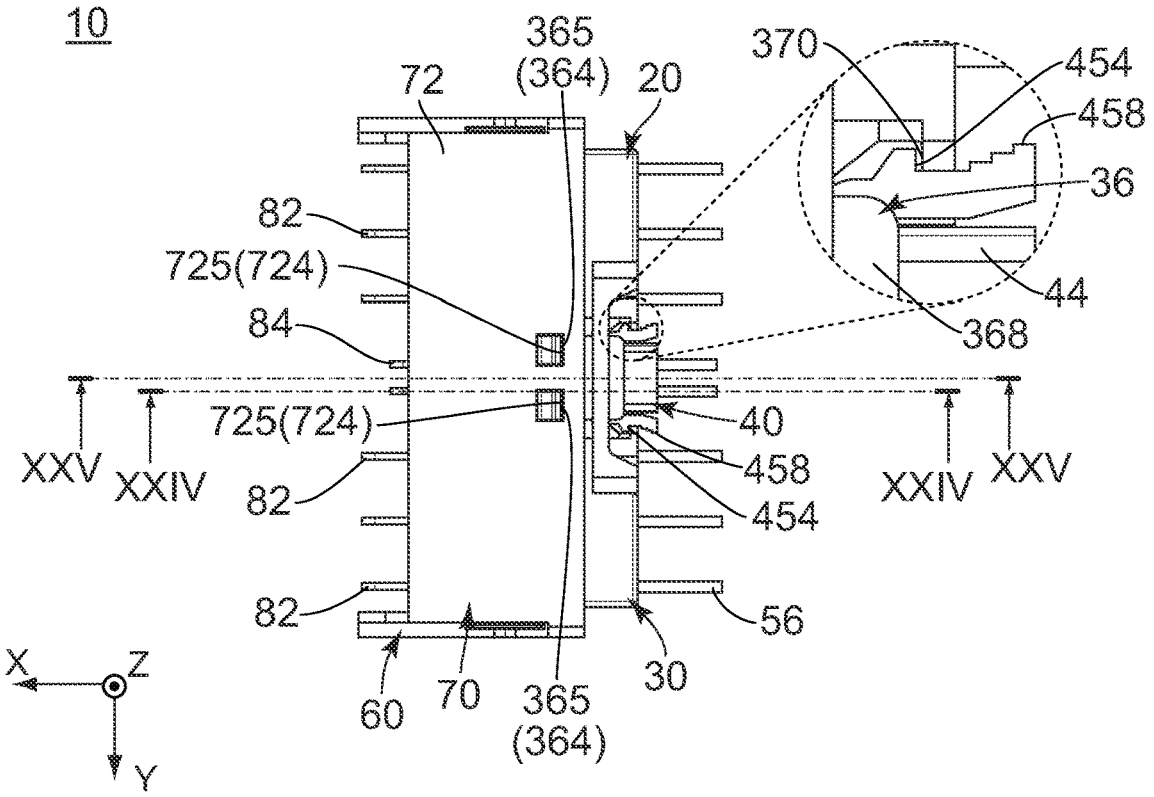
FIG. 23 is still another top view for explanation about the mating process of the connector with the mating connector of the connector assembly of FIG. 1, wherein a part of the connector assembly enclosed by dashed line is enlarged and illustrated, the connector and the mating connector are under a mated state where they are mated with each other, and the regulation portion regulates the movement of the lock portions in the perpendicular direction.

Referring to FIGS. 17, 20 and 23, the connector 20 of the present embodiment is mateable with the mating connector 60 along the mating direction. The connector 20, which is mated with the mating connector 60, is removable from the mating connector 60 along a removing direction (negative X-direction) which is opposite to the mating direction (positive X-direction).

Figure 8:
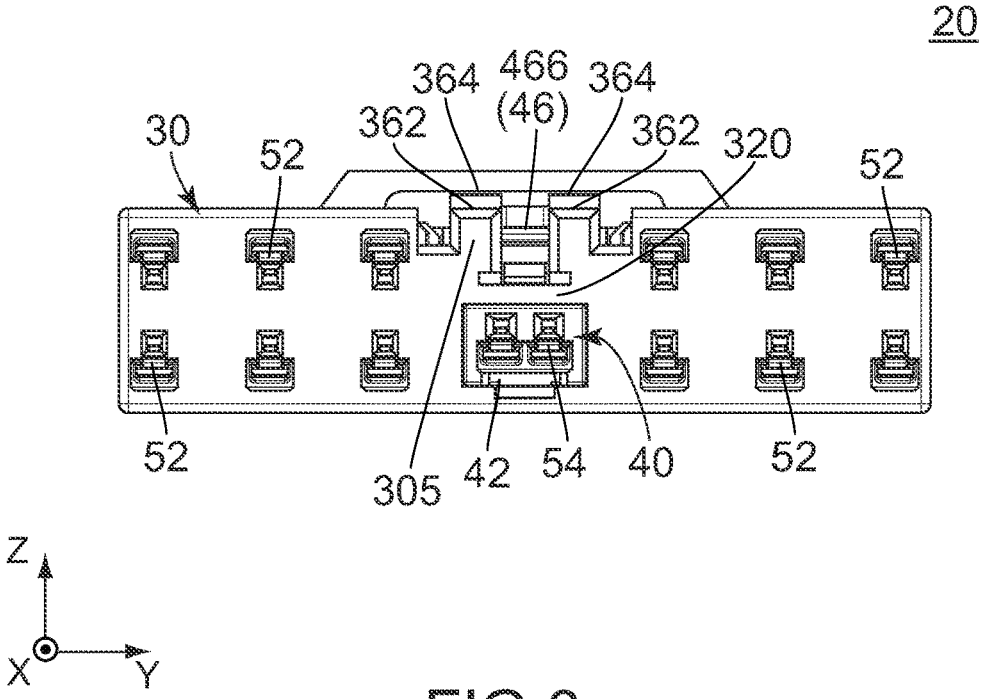
FIG. 8 is a front view showing the connector of FIG. 6.

As shown in FIG. 8, the connector 20 of the present embodiment comprises a first housing 30, a plurality of first terminals 52, a second housing 40 and two second terminals 54.

Figure 10:
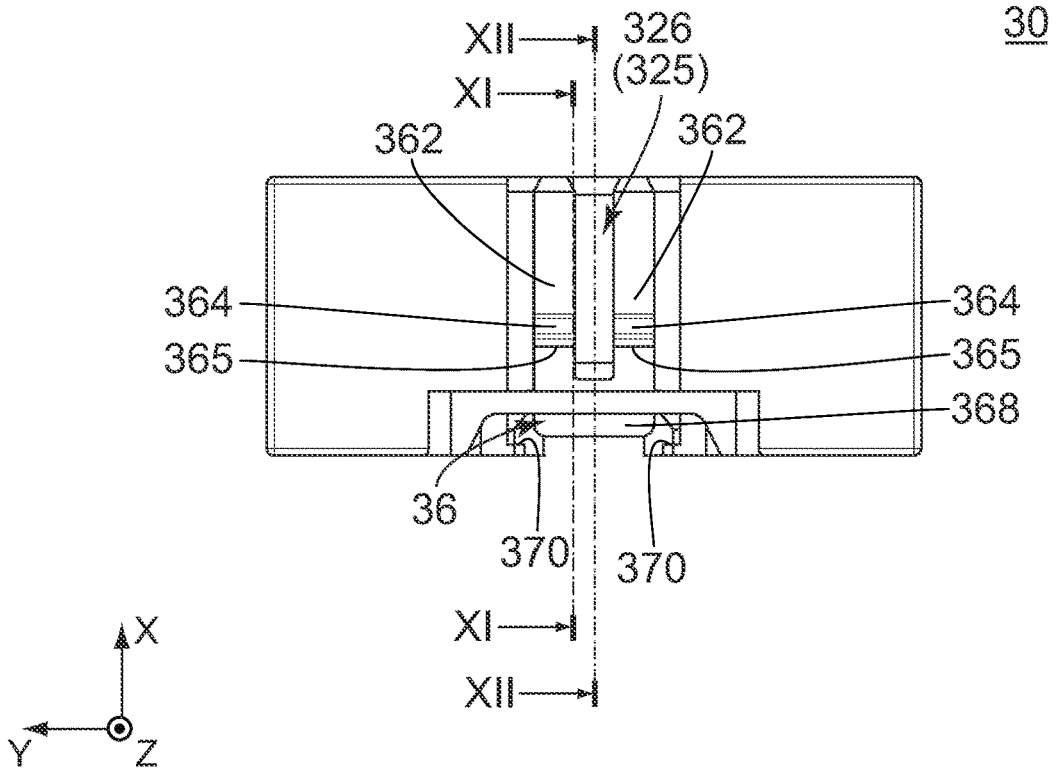
FIG. 10 is a top view showing a first housing of the connector of FIG. 9.
Figure 11:
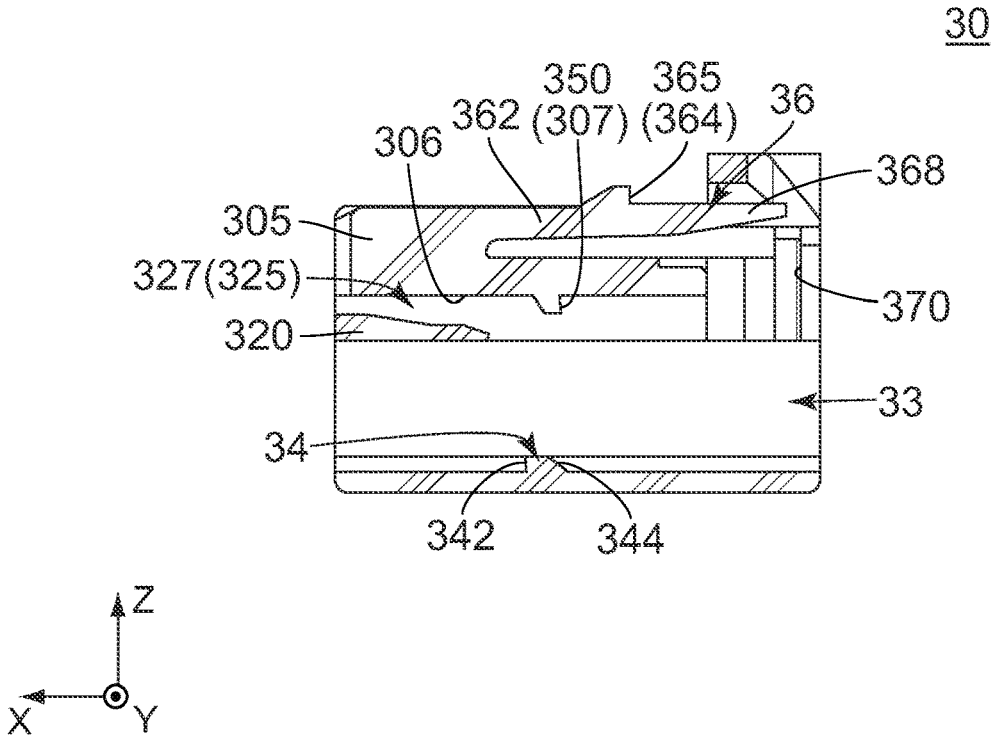
FIG. 11 is a cross-sectional view showing the first housing of FIG. 10, taken along line XI-XI.
Figure 21:
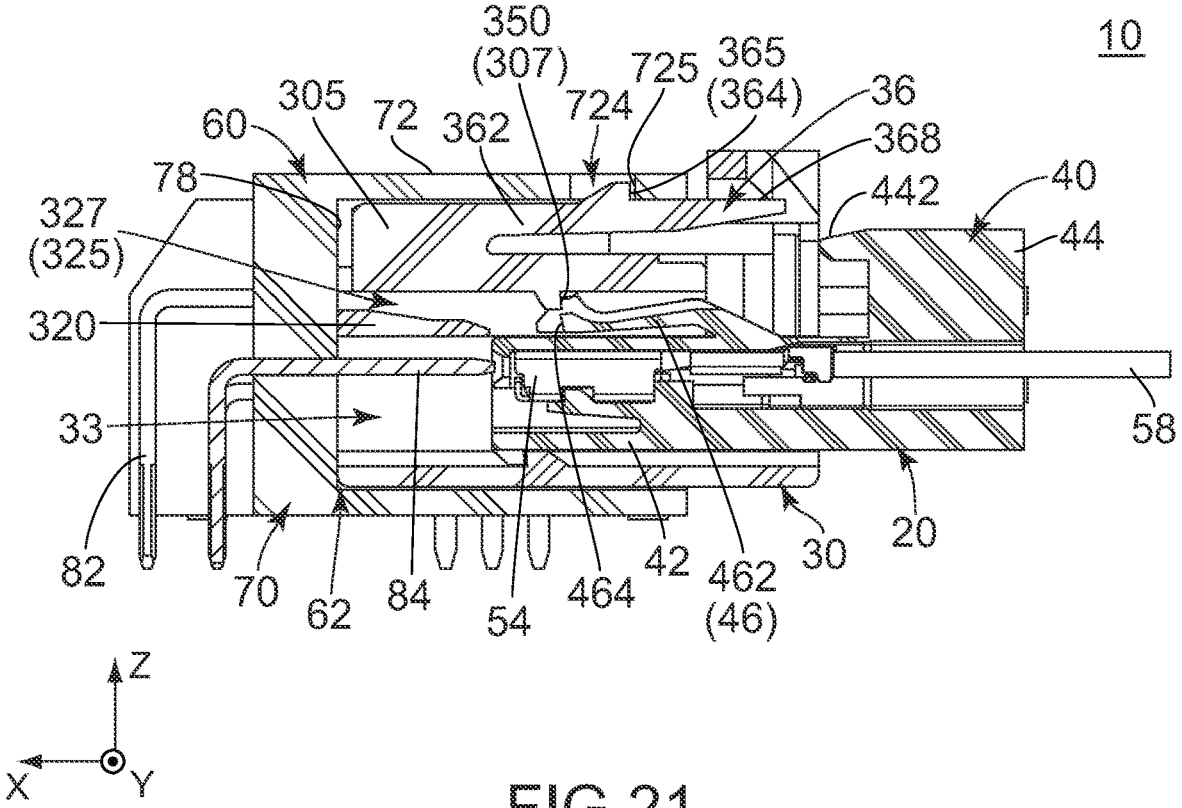
FIG. 21 is a cross-sectional view showing the connector assembly of FIG. 20, taken along line XXI-XXI, wherein the second terminal and the cable are illustrated not by their cross-sections but by their side surfaces.

As can be seen from FIGS. 18 and 21, the first housing 30 of the present embodiment is configured to be received into the receiving portion 62 along the mating direction. As shown in FIG. 8, the first housing 30 holds the first terminals 52. Referring to FIGS. 8 and 10, the first housing 30 has a mirror-symmetrical shape with respect to a plane which is perpendicular to a lateral direction and passes the middle of the first housing 30 in the lateral direction. The lateral direction of the present embodiment is the Y-direction. As shown in FIGS. 10 and 11, the first housing 30 is provided with an upper portion 305, stoppers 350, a first structure 36, an accommodation portion 33, an additional stopper 34, a partition wall 320 and a support-portion accommodation portion 325.

As shown in FIG. 11, the upper portion 305 of the present embodiment extends in the front-rear direction. The upper portion 305 has a lower surface 306 and projecting portions 307. The lower surface 306 is a plane which faces downward in the upper-lower direction. Each of the projecting portions 307 projects downward from the lower surface 306. Each of the projecting portions 307 is located at the middle of the first housing 30 in the front-rear direction. Each of the projecting portions 307 has a rear surface which faces rearward in the front-rear direction. The rear surface of each of the projecting portions 307 works as the stopper 350.

As shown in FIG. 11, each of the stoppers 350 of the present embodiment intersects with the front-rear direction. Each of the stoppers 350 is a plane which faces rearward in the front-rear direction.

As shown in FIGS. 10 and 11, the first structure 36 of the present embodiment includes two first support portions 362, two lock portions 365 and a first operation portion (operation portion) 368. Thus, the first housing 30 is provided with the stoppers 350 and the first structure 36 which includes the first support portions 362 and the lock portions 365. However, the present invention is not limited thereto. When the number of the mating lock portions 725 is one, the first structure 36 may include only one of the first support portions 362 and only one of the lock portions 365.

As shown in FIG. 11, each of the first support portions 362 of the present embodiment extends rearward in the front-rear direction from the upper portion 305. Each of the first support portions 362 has a restoring force and supports one of the lock portions 365. Each of the first support portions 362 is resiliently deformable in the perpendicular direction, i.e. in the upper-lower direction. Each of the first support portions 362 has a lock projection 364.

As described above, each of the first support portions 362 of the present embodiment has the restoring force which is a resilient force thereof. However, the restoring force of each of the first support portions 362 of the present invention is not limited to the resilient force of the first support portion 362 itself. For example, each of the first support portions 362 may be supported by a spring (not shown) separable from the first housing 30 to be turnable about a fulcrum which is a front end of the first support portion 362. Thus, each of the first support portions 362 may have a restoring force caused by another member. The modification as described above is applicable to each portion having a restoring force and each member having a restoring force in the present embodiment and in a second embodiment described later.

As shown in FIG. 11, the lock projections 364 of the present embodiment are located at the middle of the first structure 36 in the front-rear direction. Each of the lock projections 364 projects upward in the upper-lower direction. Each of the lock projections 364 has a rear surface which faces rearward in the front-rear direction. Each of the rear surfaces of the lock projections 364 works as the lock portion 365.

As shown in FIG. 11, each of the lock portions 365 of the present embodiment intersects with the front-rear direction. Each of the lock portions 365 is a plane which faces rearward in the front-rear direction. The lock portions 365 are provided on the first support portions 362, respectively. As describe above, each of the first support portions 362 has the restoring force. Therefore, each of the lock portions 365 is movable in the perpendicular direction perpendicular to the mating direction by using the restoring force of the first support portion 362. More specifically, each of the lock portions 365 is movable in the upper-lower direction by using the restoring force of the first support portion 362. Referring to FIG. 21, the lock portions 365 and the mating lock portions 725 lock a state where the first housing 30 is received in the receiving portion 62 when the first terminals 52 illustrated in FIG. 8 are connected to the first mating terminals 82.

As shown in FIG. 10, the first operation portion 368 of the present embodiment is located at a rear end of the first structure 36 in the front-rear direction. The first operation portion 368 is located in the vicinity of a rear end of the first housing 30 in the front-rear direction. The first operation portion 368 is located rearward of the first support portions 362 in the front-rear direction. The first operation portion 368 is located rearward of the lock portions 365 in the front-rear direction. Referring to FIG. 11, by pressing the first operation portion 368 inward of the first housing 30 in the perpendicular direction, the first support portions 362 can be resiliently deformed so that the lock portions 365 are moved inward of the first housing 30 in the perpendicular direction. As described above, each of the first support portions 362 has the restoring force. Therefore, when the aforementioned pressure against the first operation portion 368 is stopped, the first support portions 362 return to their initial shapes so that the lock portions 365 are moved outward of the first housing 30 in the perpendicular direction. More specifically, by pressing the first operation portion 368 downward, the first support portions 362 can be resiliently deformed so that the lock portions 365 are moved downward. When the aforementioned pressure against the first operation portion 368 is stopped, the first support portions 362 return to their initial shapes so that the lock portions 365 are moved upward.

Figure 9:
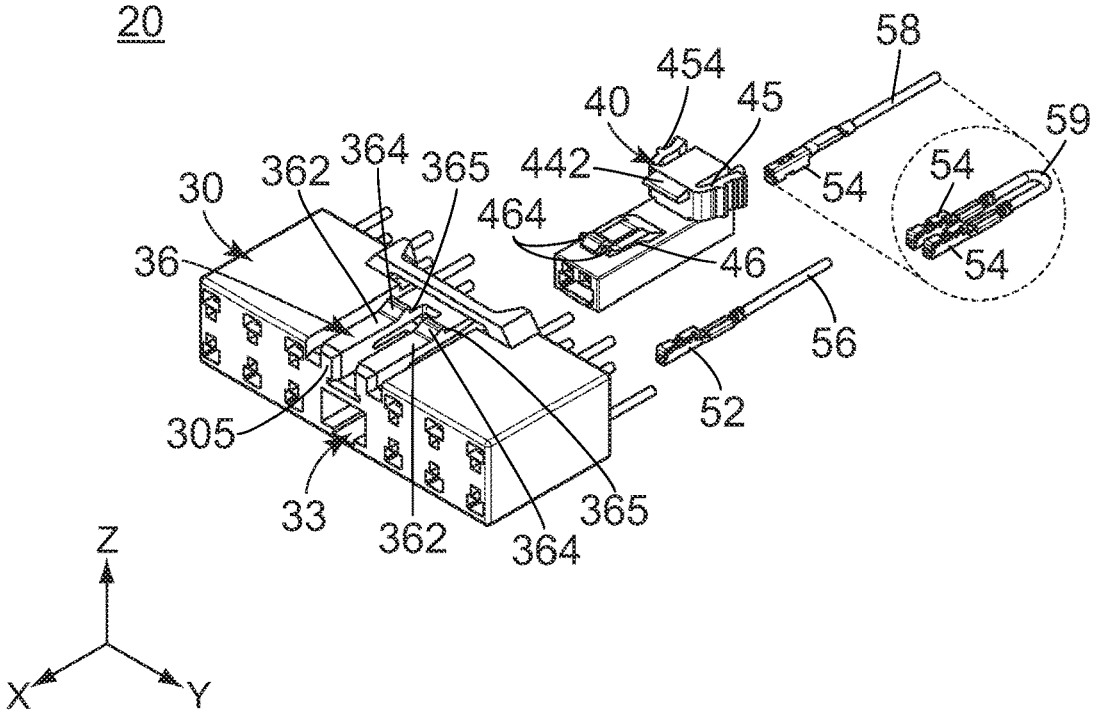
FIG. 9 is an exploded, perspective view showing the connector of FIG. 2, wherein a modification of the cable of the connector is illustrated in a dashed circle.

As shown in FIG. 11, the accommodation portion 33 of the present embodiment is a hole which passes through the first housing 30 in the front-rear direction. The accommodation portion 33 is located below the lower surface 306 of the upper portion 305 in the upper-lower direction. The accommodation portion 33 is located below the first support portions 362 in the upper-lower direction. The accommodation portion 33 is located below the lock portions 365 in the upper-lower direction. The accommodation portion 33 is located below the first operation portion 368 in the upper-lower direction. As shown in FIG. 9, the accommodation portion 33 is located at the middle of the first housing 30 in the lateral direction.

Figure 12:
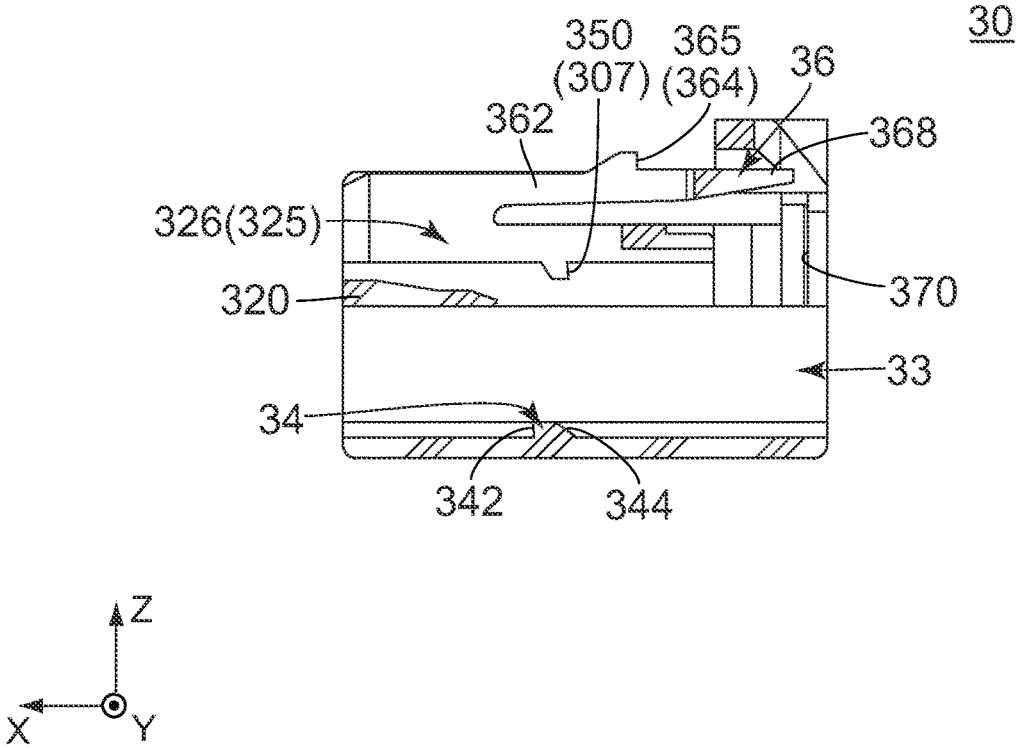
FIG. 12 is a cross-sectional view showing the first housing of FIG. 10, taken along line XII-XII.

As shown in FIG. 12, the additional stopper 34 of the present embodiment is located at the middle of the first housing 30 in the front-rear direction. The additional stopper 34 is located in the vicinity of a lower end of the first housing 30. The additional stopper 34 is located in the accommodation portion 33 and projects upward in the upper-lower direction. The additional stopper 34 has a front surface 342 and a rear surface 344. Each of the front surface 342 and the rear surface 344 intersects with the front-rear direction. The front surface 342 faces forward in the front-rear direction. The rear surface 344 faces rearward and upward. The rear surface 344 slopes rearward and downward. The rear surface 344 is located rearward of the front surface 342 in the front-rear direction.

As shown in FIGS. 11 and 12, the partition wall 320 of the present embodiment extends rearward from a front end of the first housing 30. The partition wall 320 is located below the lower surface 306 of the upper portion 305. The partition wall 320 is located forward of the first support portions 362 in the front-rear direction. The partition wall 320 is located forward of the lock portions 365 in the front-rear direction. The partition wall 320 is located forward of the first operation portion 368 in the front-rear direction. As shown in FIG. 8, the partition wall 320 is located at the middle of the first housing 30 in the lateral direction.

As shown in FIG. 10, the support-portion accommodation portion 325 of the present embodiment is a space which extends in in the front-rear direction. The support-portion accommodation portion 325 is located at the middle of the first housing 30 in the lateral direction. The support-portion accommodation portion 325 is located between the two first support portions 362 in the lateral direction. The support-portion accommodation portion 325 is located between the two lock portions 365 in the lateral direction. The support-portion accommodation portion 325 is located forward of the first operation portion 368 in the front-rear direction. As shown in FIGS. 11 and 12, the support-portion accommodation portion 325 is located above the partition wall 320 in the upper-lower direction.

Referring to FIGS. 11 and 12, the support-portion accommodation portion 325 has a main accommodation portion 326 and two additional accommodation portions 327.

As shown in FIG. 10, the main accommodation portion 326 of the present embodiment is a channel which extends in the front-rear direction. The main accommodation portion 326 is located at the middle of the first housing 30 in the lateral direction. The main accommodation portion 326 is located between the two first support portions 362 in the lateral direction. The main accommodation portion 326 is located between the two lock portions 365 in the lateral direction. As shown in FIG. 12, the main accommodation portion 326 communicates with the outside of the first housing 30 in the upper-lower direction. The main accommodation portion 326 communicates with the outside of the first housing 30 in the front-rear direction. The main accommodation portion 326 is located forward of the first operation portion 368 in the front-rear direction. Referring to FIGS. 11 and 12, the main accommodation portion 326 is located between the two additional accommodation portions 327 in the lateral direction. The main accommodation portion 326 communicates with each of the additional accommodation portions 327 in the lateral direction.

As shown in FIG. 11, each of the additional accommodation portions 327 of the present embodiment is a space which extends in the front-rear direction. Each of the additional accommodation portions 327 communicates with the outside of the first housing 30 in the front-rear direction. The additional accommodation portions 327 are located below the lock portions 365 in the upper-lower direction, respectively. The additional accommodation portions 327 are located below the lower surface 306 of the upper portion 305 in the upper-lower direction.

As shown in FIG. 10, the first housing 30 further has additional locked portions 370.

As shown in FIG. 10, each of the additional locked portions 370 of the present embodiment is located in the vicinity of the rear end of the first housing 30 in the front-rear direction. Each of the additional locked portions 370 intersects with the front-rear direction. More specifically, each of the additional locked portions 370 is a plane which faces forward in the front-rear direction. Each of the additional locked portions 370 is located rearward of the first operation portion 368 in the front-rear direction.

Referring to FIG. 9, each of the first terminals 52 of the present embodiment is made of metal. Each of the first terminals 52 is a so-called socket contact and is connected to a cable 56. Referring to FIGS. 8, 16 and 21, the first terminals 52 are connected to the first mating terminals 82, respectively, when the first housing 30 is received in the receiving portion 62. Each of the first terminal 52 and the corresponding first mating terminal 82 are configured to be connected to each other to transmit high-voltage current.

Figure 4:
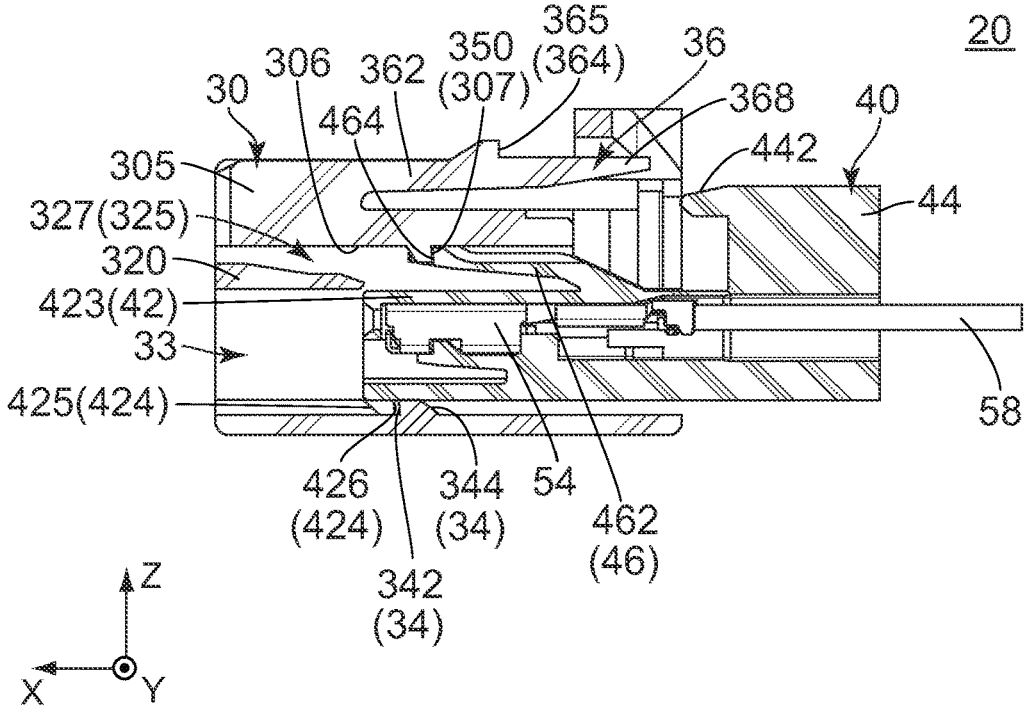
FIG. 4 is a cross-sectional view showing the connector of FIG. 3, taken along line IV-IV, wherein a second terminal and a cable are illustrated not by their cross-sections but by their side surfaces.
Figure 5:
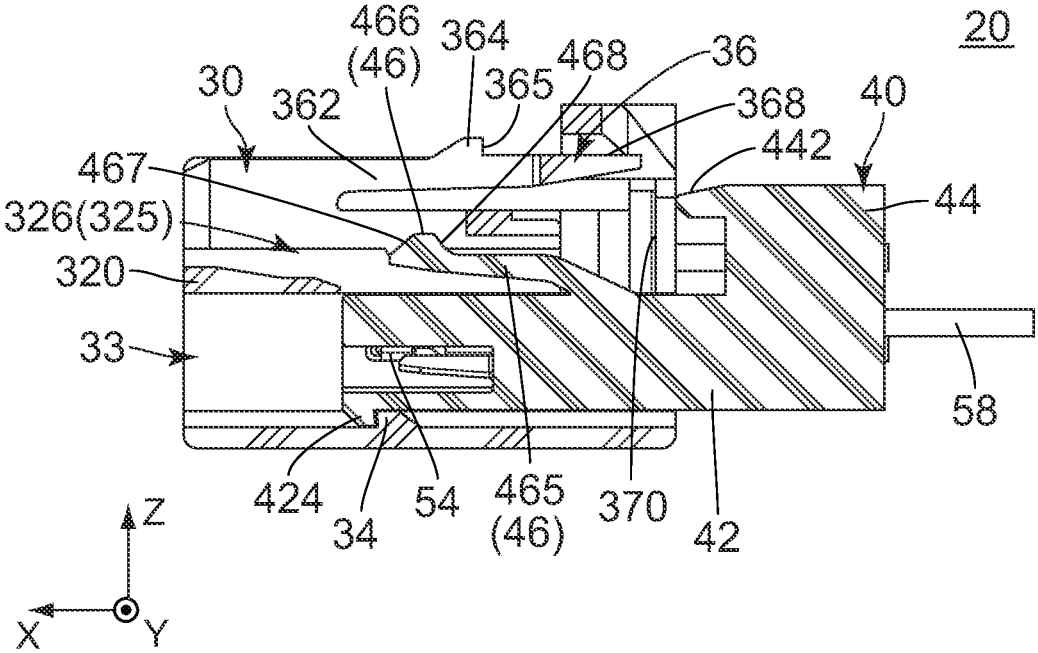
FIG. 5 is a cross-sectional view showing the connector of FIG. 3, taken along line V-V.
Figure 6:
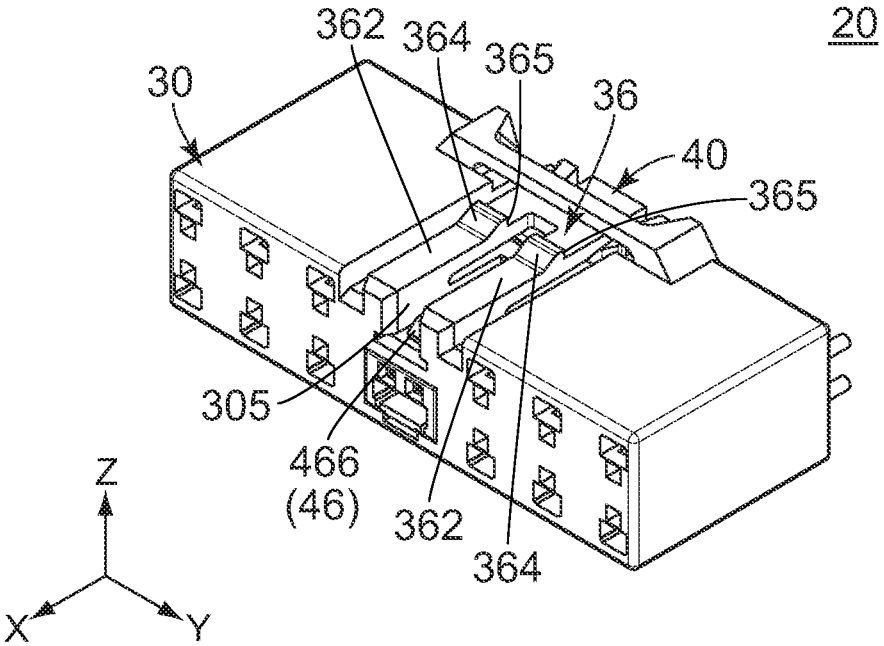
FIG. 6 is another perspective view showing the connector of FIG. 2, wherein a regulation portion of the connector regulates a movement of lock portions in a perpendicular direction.
Figure 7:
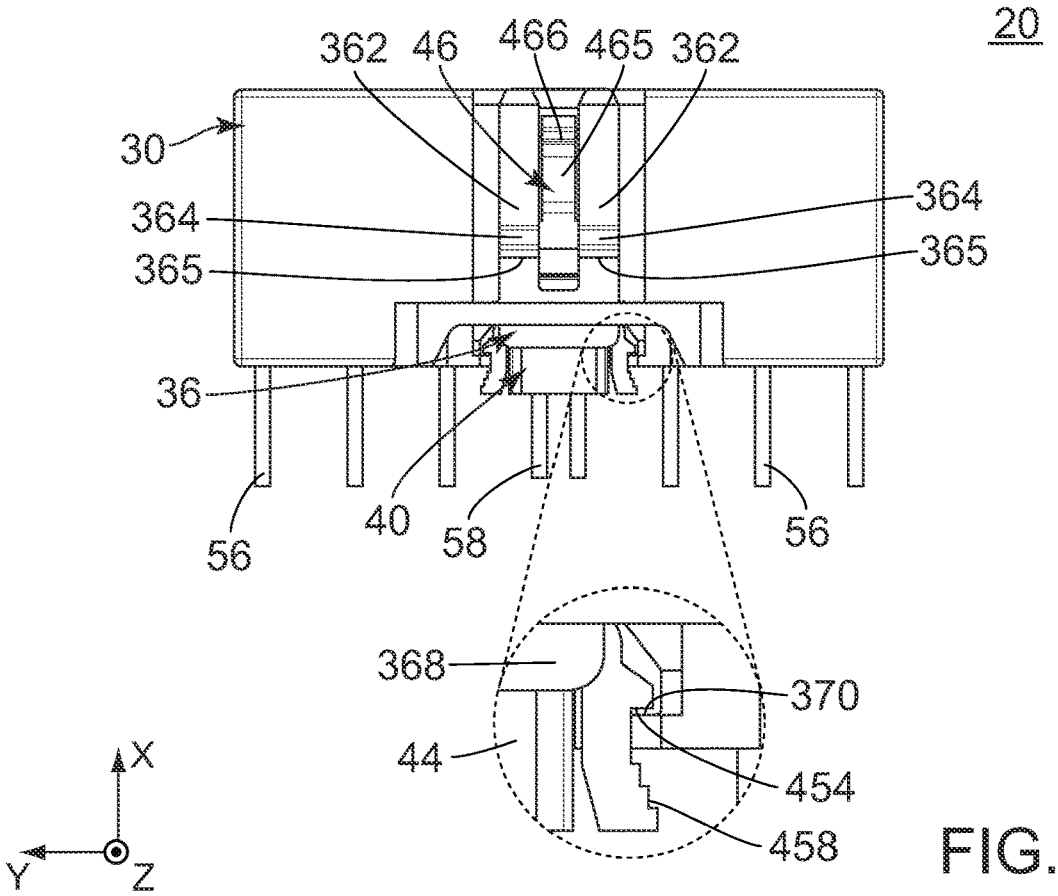
FIG. 7 is a top view showing the connector of FIG. 6, wherein a part of the connector enclosed by dashed line is enlarged and illustrated.
Figure 13:
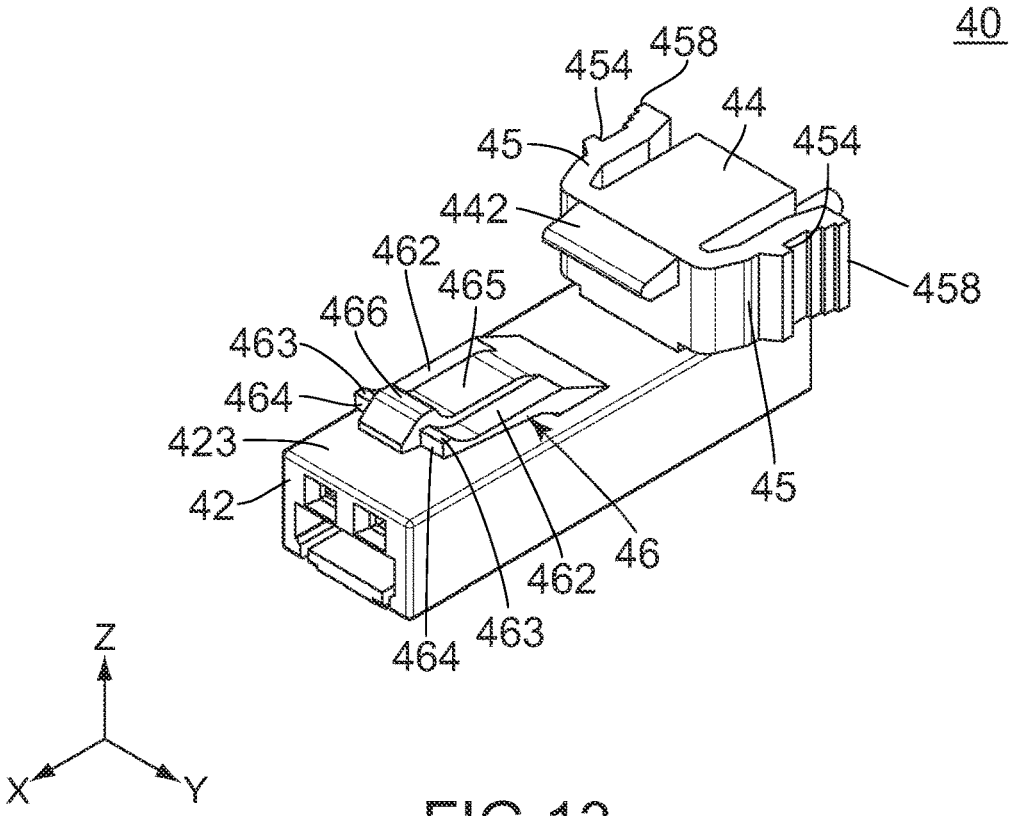
FIG. 13 is a perspective view showing the second housing of the connector of FIG. 9.

As shown in FIG. 5, the second housing 40 of the present embodiment is held by the first housing 30 to be movable relative to the first housing 30. As shown in FIG. 4, the second housing 40 holds the second terminals 54. As shown in FIGS. 4 and 13, the second housing 40 is provided with a body portion 42, a head portion 44, a regulation portion 442, a second support portion 46, two stopped portions 464, two additional support portions 45, two additional lock portions 454, two second operation portions 458 and an additional stopped portion 424. Thus, the second support portion 46 is provided to the second housing 40. However, the present invention is not limited thereto, but the second support portion 46 may be provided to the first housing 30. In other words, one of the first housing 30 and the second housing 40 should be provided with the second support portion 46. However, the second support portion 46 is preferred to be provided to the second housing 40 for more flexible design of the connector 20.

As shown in FIG. 13, the body portion 42 of the present embodiment has a rectangular cylindrical shape which extends in the front-rear direction. The body portion 42 has an upper surface 423 which faces upward.

As shown in FIG. 13, the head portion 44 of the present embodiment is located above the body portion 42 in the upper-lower direction. The head portion 44 is provided on the upper surface 423 of the body portion 42. The head portion 44 defines an upper end of the second housing 40 in the upper-lower direction.

As shown in FIG. 13, the regulation portion 442 of the present embodiment has a plate-like shape. As shown in FIG. 5, the regulation portion 442 extends forward from the head portion 44 in the front-rear direction. The regulation portion 442 is located in the vicinity of an upper end of the head portion 44. The regulation portion 442 is apart from and is located above the body portion 42 in the upper-lower direction. The regulation portion 442 is apart from and is located above the second support portion 46 in the upper-lower direction.

Referring to FIG. 4, the second support portion 46 of the present embodiment has a restoring force and supports each of the stopped portions 464 as the supported portion 464. The second support portion 46 is resiliently deformable in the perpendicular direction, i.e. in the upper-lower direction. However, the present invention is not limited thereto. When the second support portion 46 is provided to the first housing 30, the second support portion 46 may support each of the stoppers 350 of the first housing 30 as a supported portion. In summary, the second support portion 46 should have the restoring force and should support the supported portions each of which is one of the stopper 350 and the stopped portion 464.

As shown in FIG. 13, the second support portion 46 has a protrusion support portion 465, a protrusion 466 and two stopped-portion support portions 462.

Referring to FIG. 13, the protrusion support portion 465 of the present embodiment has a restoring force and extends forward from the middle of the upper surface 423 of the body portion 42 in the front-rear direction. The protrusion support portion 465 is located at the middle of the second support portion 46 in the lateral direction. The protrusion support portion 465 is sandwiched by the two stopped-portion support portions 462 in the lateral direction. The protrusion support portion 465 is coupled to each of the stopped-portion support portions 462 in the lateral direction.

Referring to FIG. 13, the protrusion 466 of the present embodiment is movable in the perpendicular direction, i.e. in the upper-lower direction, by using the restoring force of the second support portion 46. The protrusion 466 is located rearward of a front end of the body portion 42 in the front-rear direction. The protrusion 466 is located forward of the stopped portions 464 in the front-rear direction. The protrusion 466 is located at a front end of the second support portion 46 in the front-rear direction. The protrusion 466 is located at a front end of the protrusion support portion 465 in the front-rear direction. The protrusion 466 is sandwiched by the two stopped portions 464 in the lateral direction. The protrusion 466 is coupled to each of the stopped portions 464 in the lateral direction. As shown in FIG. 5, the protrusion 466 projects upward in the upper-lower direction. The protrusion 466 is located below the regulation portion 442 in the upper-lower direction.

As shown in FIG. 5, the protrusion 466 of the present embodiment has a front surface 467 and a rear surface 468.

As shown in FIG. 5, the front surface 467 of the present embodiment intersects with the front-rear direction. The front surface 467 faces forward and upward. The front surface 467 slopes rearward and upward.

As shown in FIG. 5, the rear surface 468 of the present embodiment intersects with the front-rear direction. The rear surface 468 faces rearward and upward. The rear surface 468 slopes rearward and downward. The rear surface 468 is located rearward of the front surface 467 in the front-rear direction.

Referring to FIG. 13, each of the stopped-portion support portions 462 of the present embodiment has a restoring force and extends forward from the middle of the upper surface 423 of the body portion 42 in the front-rear direction. The stopped-portion support portions 462 are located at opposite sides of the second support portion 46 in the lateral direction, respectively. Each of the stopped-portion support portions 462 has an upper end 463 in the upper-lower direction.

As shown in FIG. 13, the stopped portions 464 of the present embodiment are provided to the second support portion 46. As described above, the second support portion 46 has the restoring force. Therefore, the stopped portions 464 are movable in the perpendicular direction, i.e. in the upper-lower direction, by using the restoring force of the second support portion 46. Thus, the supported portions 464 are movable in the perpendicular direction, i.e. in the upper-lower direction, by using the restoring force of the second support portion 46. Each of the stopped portions 464 intersects with the front-rear direction. Each of the stopped portions 464 is a plane which faces forward in the front-rear direction. Each of the stopped portions 464 faces forward in the front-rear direction. The stopped portions 464 are located rearward of the front end of the body portion 42 in the front-rear direction. The stopped portions 464 are located at front ends of the stopped-portion support portions 462 in the front-rear direction, respectively. The stopped portions 464 are located rearward of the protrusion 466 in the front-rear direction. The two stopped portions 464 sandwich the protrusion 466 in the lateral direction.

Figure 3:
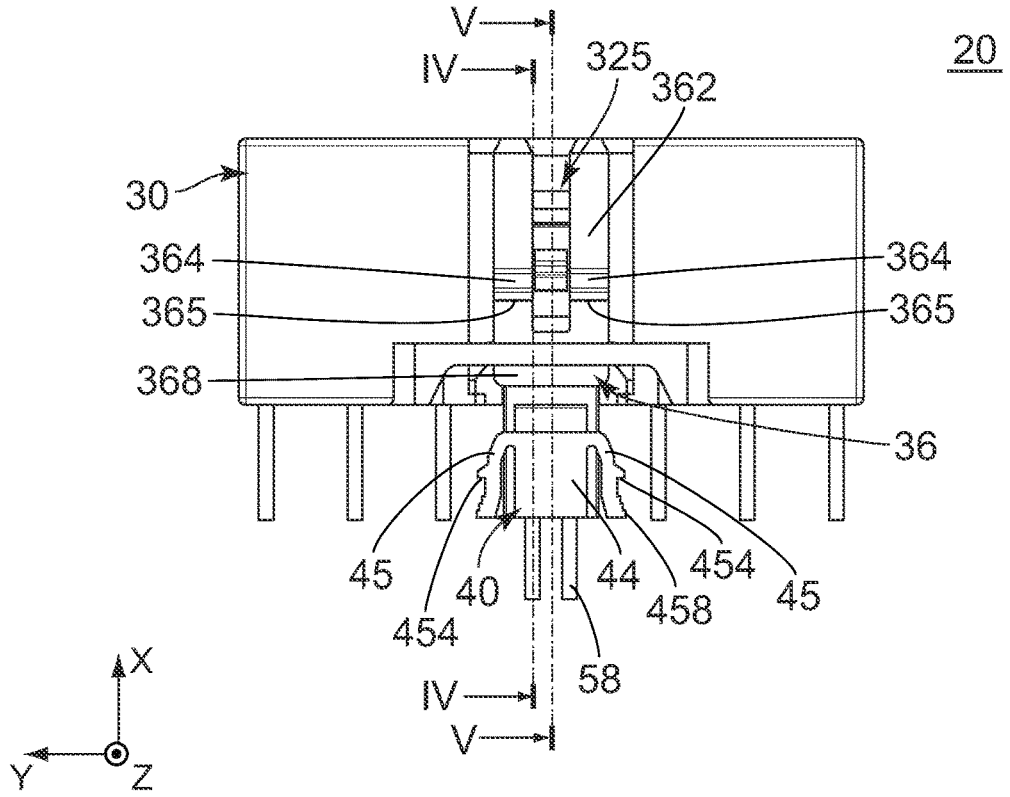
FIG. 3 is a top view showing the connector of FIG. 2.

Referring to FIG. 13, each of the additional support portions 45 of the present embodiment has a restoring force. Each of the additional support portions 45 is resiliently deformable in the lateral direction. The additional support portions 45 are located above the body portion 42 in the upper-lower direction. As shown in FIG. 3, the additional support portions 45 are located about opposite ends of the second housing 40 in the lateral direction, respectively. Each of the additional support portions 45 extends outward of the second housing 40 in the lateral direction from an outer end of the head portion 44 in the lateral direction. Each of the additional support portions 45 extends rearward from a front end of the head portion 44. The additional support portions 45 support the additional lock portions 454, respectively.

As shown in FIG. 3, the additional lock portions 454 of the present embodiment are located about the opposite ends of the second housing 40 in the lateral direction, respectively. Each of the additional lock portions 454 extends outward of the second housing 40 in the lateral direction from the additional support portion 45. Each of the additional lock portions 454 intersects with the front-rear direction. Each of the additional lock portions 454 is a plane which faces rearward in the front-rear direction. As can be seen from FIGS. 23 and 24, when the second terminals 54 are connected to the second mating terminals 84, the additional lock portions 454 and the additional locked portions 370 lock a state where the second housing 40 is installed to the first housing 30.

As shown in FIG. 3, the second operation portions 458 of the present embodiment are located at the opposite ends of the second housing 40 in the lateral direction, respectively. The second operation portions 458 are located at a rear end of the second housing 40 in the front-rear direction. The second operation portions 458 are located rearward of the additional support portions 45 in the front-rear direction, respectively. The second operation portions 458 are located rearward of the additional lock portions 454 in the front-rear direction, respectively. By pressing the second operation portions 458 inward of the second housing 40 in the lateral direction, the additional support portions 45 can be resiliently deformed so that the additional lock portions 454 are moved inward of the second housing 40 in the lateral direction. As described above, each of the additional support portions 45 has the restoring force. Therefore, when the aforementioned pressure against the second operation portions 458 is stopped, the additional support portions 45 return to their initial shapes so that the additional lock portions 454 are moved outward of the second housing 40 in the lateral direction.

As shown in FIG. 4, the additional stopped portion 424 of the present embodiment projects downward from a part of the body portion 42 which is located at a lower end and a front end of the body portion 42. The additional stopped portion 424 has a front surface 425 and a rear surface 426. Each of the front surface 425 and the rear surface 426 intersects with the front-rear direction. The front surface 425 faces forward and downward. The front surface 425 slopes rearward and downward. The rear surface 426 faces rearward in the front-rear direction. The rear surface 426 is located rearward of the front surface 425 in the front-rear direction.

Referring to FIG. 9, each of the second terminals 54 of the present embodiment is made of metal. Each of the second terminals 54 is a so-called socket contact and is connected to a cable 58. The two second terminals 54 of the present embodiment are not short-circuited. However, the present invention is not limited thereto, but the two second terminals 54 may be short-circuited by a cable 59 as shown in a dashed circle of FIG. 9. In other words, the number of the second terminals 54 may be two, and the two second terminals 54 may be connected to each other. As shown in FIG. 4, the second terminals 54 are accommodated in the body portion 42.

Figure 24:
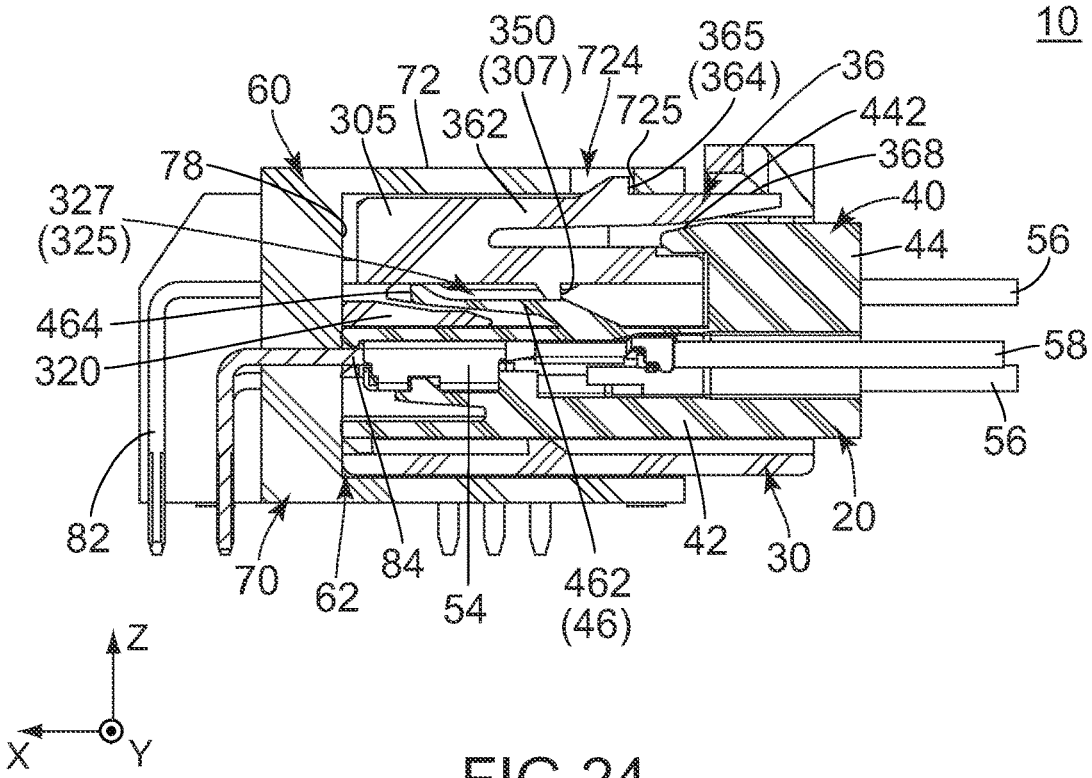
FIG. 24 is a cross-sectional view showing the connector assembly of FIG. 23, taken along line XXIV-XXIV, wherein the second terminal and the cable are illustrated not by their cross-sections but by their side surfaces.

Referring to FIG. 24, the second terminals 54 and the second mating terminals 84 are configured to be connected to an HVIL circuit (not shown) and to control the opening and the closing of the HVIL circuit. More specifically, when the second terminals 54 are connected to the second mating terminals 84, respectively, the HVIL circuit is closed, and electric current flows between the first terminals 52 illustrated in FIG. 8 and the first mating terminals 82 illustrated in FIG. 18. When the second terminals 54 are disconnected from the second mating terminals 84, respectively, the HVIL circuit is opened, and electric power supply between the first terminals 52 illustrated in FIG. 8 and the first mating terminals 82 illustrated in FIG. 18 is stopped. Thus, the connector assembly 10 has the HVIL mechanism which includes the second terminals 54, the second mating terminals 84 and the HVIL circuit.

Hereafter, specific explanation will be made about a mating operation of the connector 20 with the mating connector 60.

Referring to FIGS. 4 and 13, first, the second housing 40 is installed to the first housing 30 along the mating direction. In this operation, the first housing 30 and the second housing 40 are arranged so that the body portion 42 of the second housing 40 is located rearward of the accommodation portion 33 of the first housing 30. Then, the second housing 40 is moved forward relative to the first housing 30 so that the body portion 42 of the second housing 40 is accommodated in the accommodation portion 33 of the first housing 30. At the end of this operation, the front surface 425 of the additional stopped portion 424 of the second housing 40 is brought into contact with the rear surface 344 of the additional stopper 34 located in the accommodation portion 33 of the first housing 30.

When the second housing 40 is further moved forward relative to the first housing 30, the additional stopped portion 424 of the second housing 40 rides over the additional stopper 34 of the first housing 30, and the rear surface 426 of the additional stopped portion 424 faces the front surface 342 of the additional stopper 34 in the front-rear direction. Thereafter, the stopped portions 464 of the second housing 40 are brought into abutment with the stoppers 350 of the first housing 30, respectively, and the connector 20 takes a regulated state shown in FIG. 4.

Under the regulated state shown in FIG. 4, the stopped portions 464 are in abutment with the stoppers 350, respectively, and a movement of the second housing 40 in the mating direction is regulated by the stoppers 350. In detail, the stopped portions 464 are brought into abutment with the stoppers 350 from behind, and a forward movement of the second housing 40 in the front-rear direction is regulated by the stoppers 350. Under this regulated state, because the rear surface 426 of the additional stopped portion 424 faces the front surface 342 of the additional stopper 34 in the front-rear direction, a rearward movement of the second housing 40 in the front-rear direction is also regulated. Thus, when the second housing 40 takes the regulated state, the additional stopper 34 regulates a movement of the additional stopped portion 424 in the removing direction so that the second housing 40 is unremovable from the first housing 30.

Under this regulated state, the aforementioned mechanism regulates both of the forward movement and the rearward movement of the second housing 40 relative to the first housing 30 in the front-rear direction. In summary, when the second housing 40 is installed to the first housing 30 along the mating direction, the stopped portions 464 are brought into abutment with the stoppers 350, and the second housing 40 takes the regulated state where the movement of the second housing 40 in the mating direction is regulated by the stoppers 350.

Referring to FIGS. 17 to 19, the connector 20 is arranged to face the mating connector 60 along the mating direction while the second housing 40 thereof takes the regulated state. Thereafter, the connector 20 and the mating connector 60 are moved to be closer to each other in the mating direction, and the first housing 30 is received into the receiving portion 62. During this operation, the first terminals 52 illustrated in FIG. 8 are connected to the first mating terminals 82, respectively, and then the front surface 467 of the protrusion 466 of the second housing 40 of the connector 20 is brought into contact with the rear surface 7224 of the release projection 722 of the mating connector 60.

The connector 20 and the mating connector 60 are moved to be further close to each other in the mating direction after they take a state where the front surface 467 of the protrusion 466 is in contact with the rear surface 7224 of the release projection 722. During this operation, the second support portion 46 is resiliently deformed so that the protrusion 466 is pushed down by the release projection 722, and the connector 20 and the mating connector 60 take a state shown in FIGS. 20 to 22.

Figure 22:
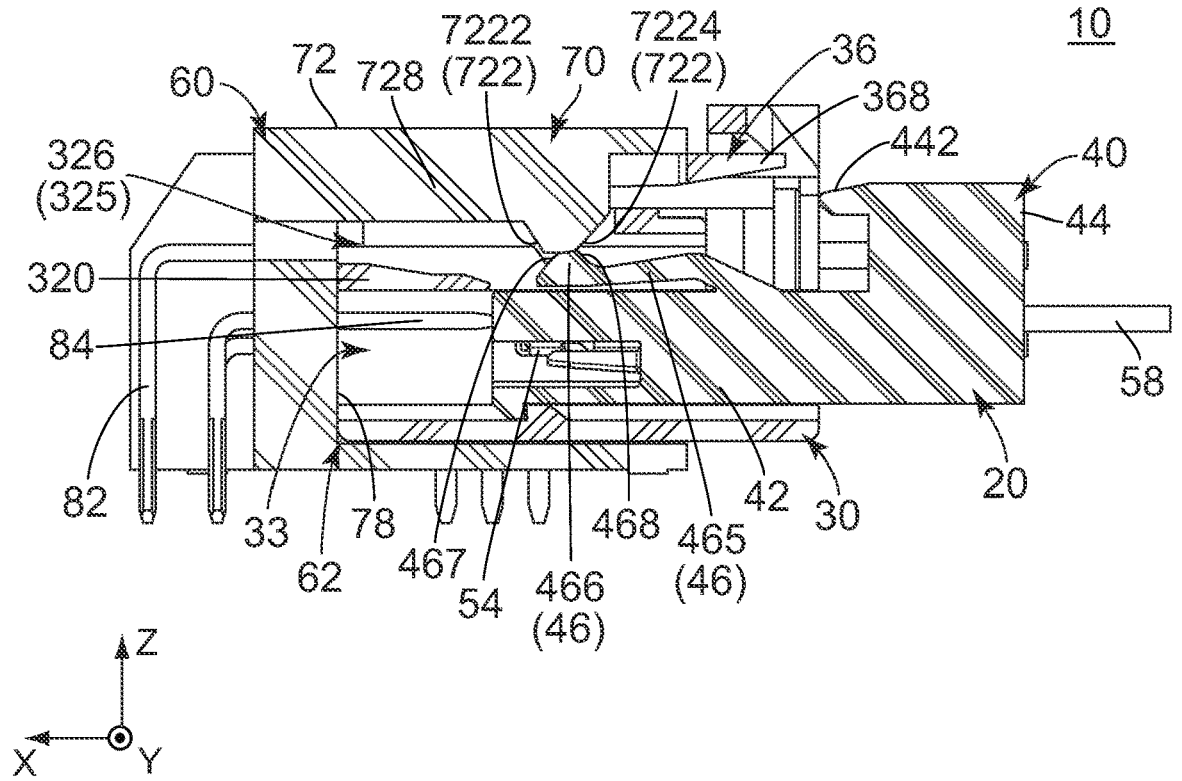
FIG. 22 is a cross-sectional view showing the connector assembly of FIG. 20, taken along line XXII-XXII.

As shown in FIG. 22, under this state, the protrusion 466 of the second support portion 46 of the connector 20 is in abutment with the release projection 722 of the mating connector 60, and the second support portion 46 is resiliently deformed downward. As shown in FIG. 21, under this state, the stopped portions 464 of the second housing 40 are located below the stoppers 350 of the first housing 30 in the upper-lower direction. Thus, the aforementioned regulation, namely a movement regulation, is released.

In summary, when the second housing 40 under the aforementioned regulated state is received into the receiving portion 62 along the mating direction together with the first housing 30, the first terminals 52 are connected to the first mating terminals 82, and then the second support portion 46 is brought into abutment with the release projection 722 so that the movement regulation of the second housing 40 in the mating direction is released.

As shown in FIG. 21, under this state, the lock projections 364 of the connector 20 are accommodated in the lock holes 724 of the mating connector 60, respectively, and the lock portions 365 face the mating lock portions 725 in the front-rear direction, respectively. Thus, under this state, the lock portions 365 and the mating lock portions 725 lock a state where the first housing 30 is received in the receiving portion 62.

As shown in FIG. 21, under this state, because the second terminals 54 are not connected to the second mating terminals 84, the HVIL circuit is opened, and the electric power supply between the first terminals 52 illustrated in FIG. 8 and the first mating terminals 82 illustrated in FIG. 18 is stopped.

Figure 25:
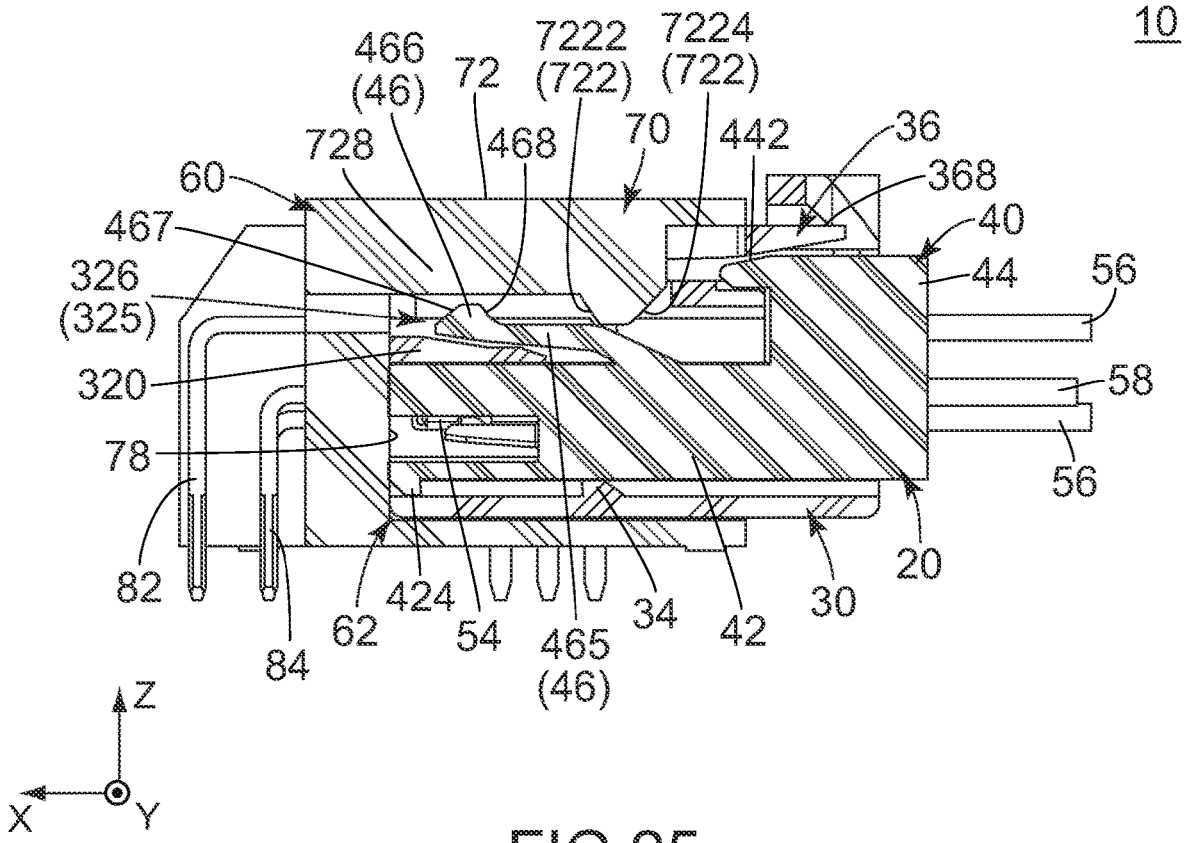
FIG. 25 is a cross-sectional view showing the connector assembly of FIG. 23, taken along line XXV-XXV.

When the second housing 40 is further moved in the mating direction after release of the aforementioned movement regulation, the connector assembly 10 takes a state shown in FIGS. 23 to 25.

As shown in FIGS. 24 and 25, under this state, the second support portion 46 is accommodated in the support-portion accommodation portion 325 and returns to its initial shape. In detail, under this state, the stopped portions 464 and the stopped-portion support portions 462 are accommodated in the additional accommodation portions 327, and the protrusion 466 and the protrusion support portion 465 are accommodated in the main accommodation portion 326. Under this state, an upper end of the protrusion 466 is not in contact with the lower end of the extension portion 728, and a lower end of the protrusion 466 is not in contact with the partition wall 320. Under this state, the protrusion support portion 465 is not in contact with the release projection 722.

As shown in FIG. 24, under this state, the second terminals 54 of the connector 20 are connected to the second mating terminals 84 of the mating connector 60, respectively, so that the HVIL circuit is closed, and the electric current flows between the first terminals 52 illustrated in FIG. 8 and the first mating terminals 82 illustrated in FIG. 18. Under this state, the regulation portion 442 is moved inward of the first operation portion 368 in the perpendicular direction to regulate a movement of the lock portions 365 in the perpendicular direction. More specifically, under this state, the regulation portion 442 is located below the first operation portion 368 in the upper-lower direction to regulate a downward movement of the lock portions 365.

In summary, when the second housing 40 is further moved in the mating direction after release of the aforementioned movement regulation, the second terminals 54 are connected to the second mating terminals 84, and the regulation portion 442 is located inward of the first operation portion 368 in the perpendicular direction to regulate the movement of the lock portions 365 in the perpendicular direction. However, the present invention is not limited thereto. The regulation portion 442 may be located inward of at least a part of the first structure 36 in the perpendicular direction to regulate the movement of the lock portions 365 in the perpendicular direction. Thus, when the second housing 40 is further moved in the mating direction after release of the movement regulation, the second terminals 54 may be connected to the second mating terminals 84, and the regulation portion 442 may be located inward of at least a part of the first structure 36 in the perpendicular direction to regulate the movement of the lock portions 365 in the perpendicular direction.

As can be seen from FIG. 24, under this state, even when the first operation portion 368 is pressed inward of the first housing 30 in the perpendicular direction, the first operation portion 368 is brought into abutment with the regulation portion 442. Therefore, this operation cannot release the lock which is made by the lock portions 365 and the mating lock portions 725 so as to lock the state where the first housing 30 is received in the receiving portion 62. Under this state, the electric current flows between the first terminals 52 illustrated in FIG. 8 and the first mating terminals 82 illustrated in FIG. 18. Under this state, even if a user accidentally presses the first operation portion 368 in order to release the mated state of the connector 20 with the mating connector 60, the mated state of the connector 20 with the mating connector 60 is not released. Thus, the connector assembly 10 has the CPA mechanism which locks the mated state of the connector 20 with the mating connector 60.

As shown in FIG. 23, under this state, the additional lock portions 454 face the additional locked portions 370 in the front-rear direction, respectively. Thus, under this state, the additional lock portions 454 and the additional locked portions 370 lock the state where the second housing 40 is installed to the first housing 30.

Hereafter, specific explanation will be made about an operation which releases the mated state of the connector 20 with the mating connector 60.

When the connector assembly 10 takes the state shown in FIG. 23, the second operation portions 458 of the connector 20 are pressed inward of the second housing 40 in the lateral direction. As a result, each of the additional lock portions 454 is moved inward of the second housing 40 in the lateral direction relative to the additional locked portion 370. Thus, this operation releases the lock of the state where the second housing 40 is installed to the first housing 30.

The second housing 40 is moved rearward to be away from the first housing 30 while the aforementioned pressed state of the second operation portions 458 is kept. At the end of this operation, the rear surface 468 of the protrusion 466 of the second housing 40 of the connector 20 is brought into contact with the front surface 7222 of the release projection 722 of the mating connector 60.

The second housing 40 is further moved rearward to be away from the first housing 30 after they take a state where the rear surface 468 of the protrusion 466 is in contact with the front surface 7222 of the release projection 722. During this operation, the second support portion 46 is resiliently deformed so that the protrusion 466 is pushed down by the release projection 722, and the second housing 40 and the first housing 30 take a state shown in FIGS. 20 to 22.

As shown in FIG. 21, under this state, the second terminals 54 are disconnected from the second mating terminals 84. Thus, the HVIL circuit is opened, and the electric power supply between the first terminals 52 illustrated in FIG. 8 and the first mating terminals 82 illustrated in FIG. 18 is stopped. Under this state, the regulation portion 442 is located rearward of the first operation portion 368 in the front-rear direction. Thus, when the first operation portion 368 is pressed inward of the first housing 30 in the perpendicular direction, the first operation portion 368 is not brought into abutment with the regulation portion 442.

Under this state, the first operation portion 368 is pressed inward of the first housing 30 in the perpendicular direction, i.e. downward. As a result, because the lock portions 365 are moved downward relative to the mating lock portions 725, the lock of the state, in which the first housing 30 is received in the receiving portion 62, is released.

The connector 20 is moved rearward to be away from the mating connector 60 while the aforementioned pressed state of the first operation portion 368 is kept. As a result, the connector 20 can be removed from the mating connector 60, and the mated state of the connector 20 with the mating connector 60 can be released.

There has been specifically described about the present invention referring to its embodiments. However, the present invention is not limited thereto, but various modifications can be made.

The mating connector 60 of the present embodiment comprises the first mating terminals 82 and the second mating terminals 84 configured to be connected to the pads of the circuit board. However, the present invention is not limited thereto, but the mating connector 60 may comprise the terminals for cables, each of which is configured to be connected to a cable, instead of the first mating terminals 82 and the second mating terminals 84. Thus, the connector assembly 10 may be used as a relay connector comprising the connector 20 and the mating connector 60 each of which forms a cable harness.

According to the connector assembly 10 of the present embodiment, the mating lock portions 725 are the inner surfaces of the lock holes 724, and the lock portions 365 are the rear surfaces of the lock projections 364. However, the present invention is not limited thereto. For example, each of the mating lock portions 725 may be a front surface of a projection which projects downward from the upper plate 72. Each of the lock portions 365 may be an inner surface of a hole which passes through the first support portion 362 in the upper-lower direction, and each of the inner surfaces may face rearward.

According to the connector assembly 10 of the present embodiment, when the second housing 40 under the aforementioned regulated state is received into the receiving portion 62 of the mating connector 60 along the mating direction together with the first housing 30, the protrusion 466 of the second support portion 46 is brought into abutment with the release projection 722 so that the aforementioned movement regulation is released. However, the present invention is not limited thereto. For example, when the second housing 40 under the aforementioned regulated state is received into the receiving portion 62 of the mating connector 60 along the mating direction together with the first housing 30, the supported portions 464 may be brought into abutment with the release projection 722 so that the movement regulation is released. Thus, when the second housing 40 under the aforementioned regulated state is received into the receiving portion 62 along the mating direction together with the first housing 30, the first terminals 52 should be connected to the first mating terminals 82, and then one of the second support portion 46 and the supported portion 464 should be brought into abutment with the release projection 722 so that the movement regulation is released.

Second Embodiment

The present invention is not limited to the aforementioned first embodiment but can be variously applicable. Hereafter, specific explanation will be made about the second embodiment of the present invention. This specific explanation includes description about structures and modifications which are not specifically described in the first embodiment.

Figure 26:
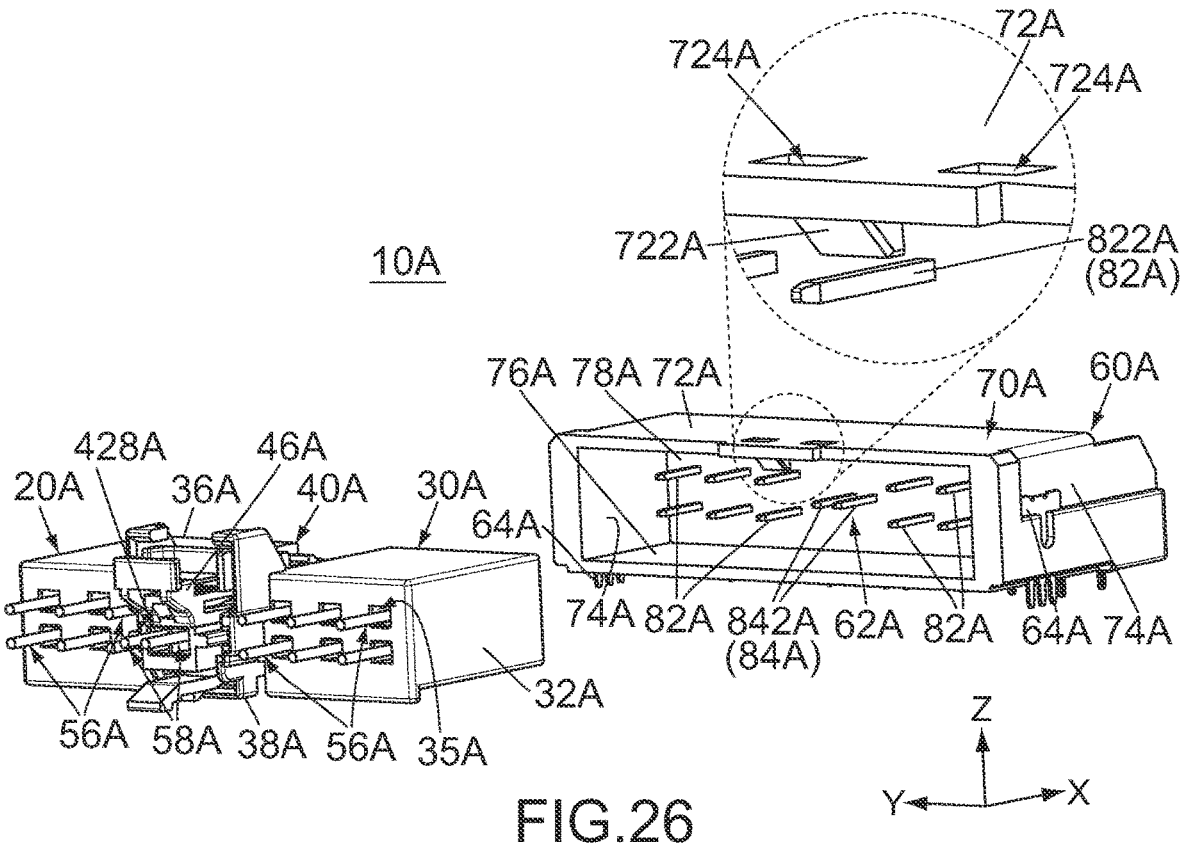
FIG. 26 is a perspective view showing a connector assembly according to a second embodiment of the present invention, wherein a connector and a mating connector of the connector assembly are under an unmated state where they are separated from each other, and a part of the mating connector enclosed by dashed line is enlarged and illustrated.

As shown in FIG. 26, a connector assembly 10A according to the second embodiment of the present invention comprises a connector 20A and a mating connector 60A. The connector 20A is mateable with the mating connector 60A along a mating direction (positive X-direction). The connector 20A, which is mated with the mating connector 60A, is removable from the mating connector 60A along a removing direction opposite to the mating direction. The mating direction of the present embodiment is the positive X-direction directed forward in a front-rear direction (X-direction). The removing direction of the present embodiment is the negative X-direction directed rearward in the front-rear direction (X-direction).

The connector 20A of the present embodiment is a cable connector which is connected to cables 56A and 58A. The connector 20A forms a cable harness together with the cables 56A and 58A. The mating connector 60A of the present embodiment is an on-board connector which is mounted on a circuit board (not shown). However, the present invention is not limited thereto but is applicable to various connector assemblies comprising various connectors and mating connectors. For example, the mating connector 60A may be connected to cables to from a cable harness similarly to the connector 20A.

The cables 56A and 58A of the present embodiment are connected to a power device (not shown). The circuit board (not shown) on which the mating connector 60A is mounted is installed in a mating electronic device (not shown). Under a mated state where the connector 20A and the mating connector 60A are mated with each other, the mating electronic device is electrically connected with the power device, and the power device supplies high-voltage power to the mating electronic device. As described later, the connector assembly 10A has a connector position assurance mechanism (CPA mechanism) which locks the mated state and a high-voltage interlock loop mechanism (HVIL mechanism) for preventing electric shock which might be caused by the high-voltage power.

Hereafter, explanation will be made about a structure of the mating connector 60A.

Referring to FIG. 26, the mating connector 60A of the present embodiment comprises a mating housing 70A made of insulator, two additional members 64A made of metal, a plurality of first mating terminals 82A each made of conductor and a plurality of second mating terminals 84A each made of conductor.

The first mating terminals 82A of the present embodiment are terminals for supplying electric power. The second mating terminals 84A of the present embodiment are parts of the HVIL mechanism. The mating connector 60A of the present embodiment is provided with six pairs of the first mating terminals 82A, i.e. twelve of the first mating terminals 82A, and a pair of the second mating terminals 84A, i.e. two of the second mating terminals 84A. However, the present invention is not limited thereto. For example, the number of the first mating terminals 82A may be designed in accordance with usage. The number of the second mating terminals 84A may be designed in accordance with a necessary HVIL mechanism. When no HVIL mechanism is provided, the second mating terminals 84A do not need to be provided. The HVIL mechanism may be formed of members different from the second mating terminals 84A. The additional members 64A may be provided as necessary. Thus, the mating connector 60A of the present invention should comprise the mating housing 70A and one or more of the first mating terminals 82A. Instead, the mating connector 60A may further comprise another member in addition to the aforementioned members.

Figure 27:
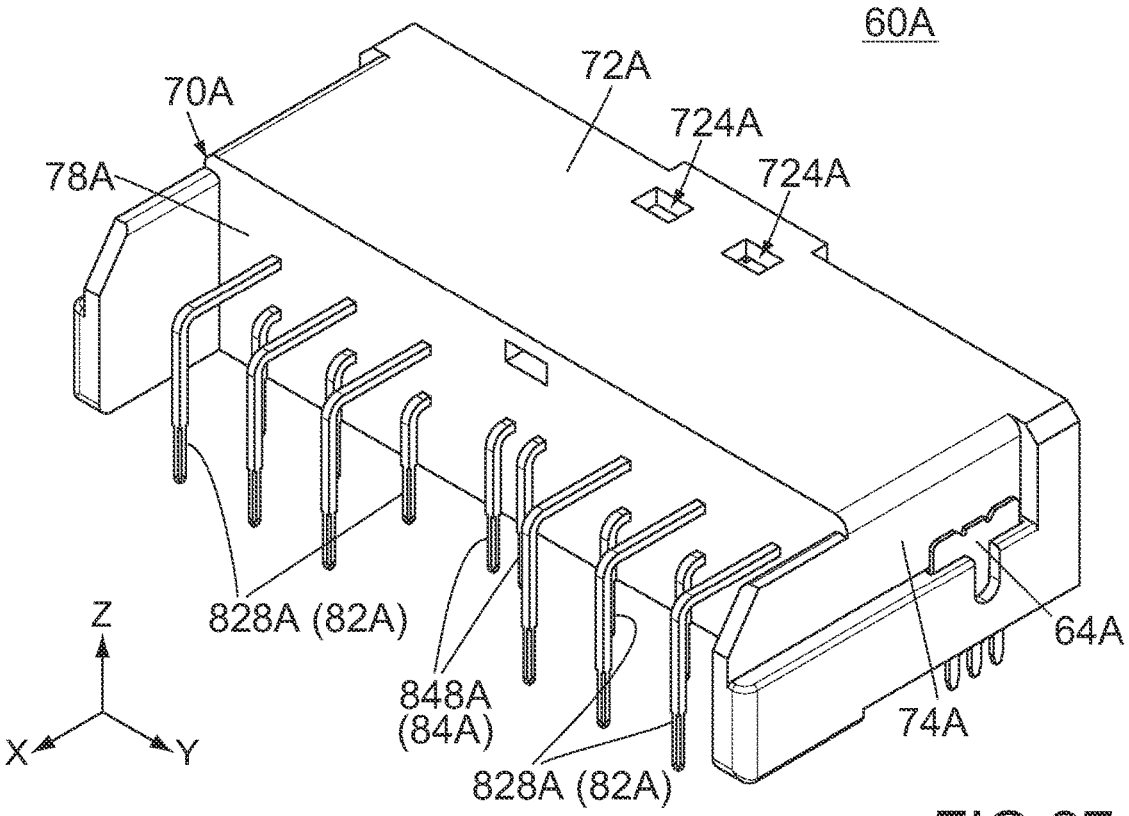
FIG. 27 is a perspective view showing the mating connector of the connector assembly of FIG. 26.
Figure 28:
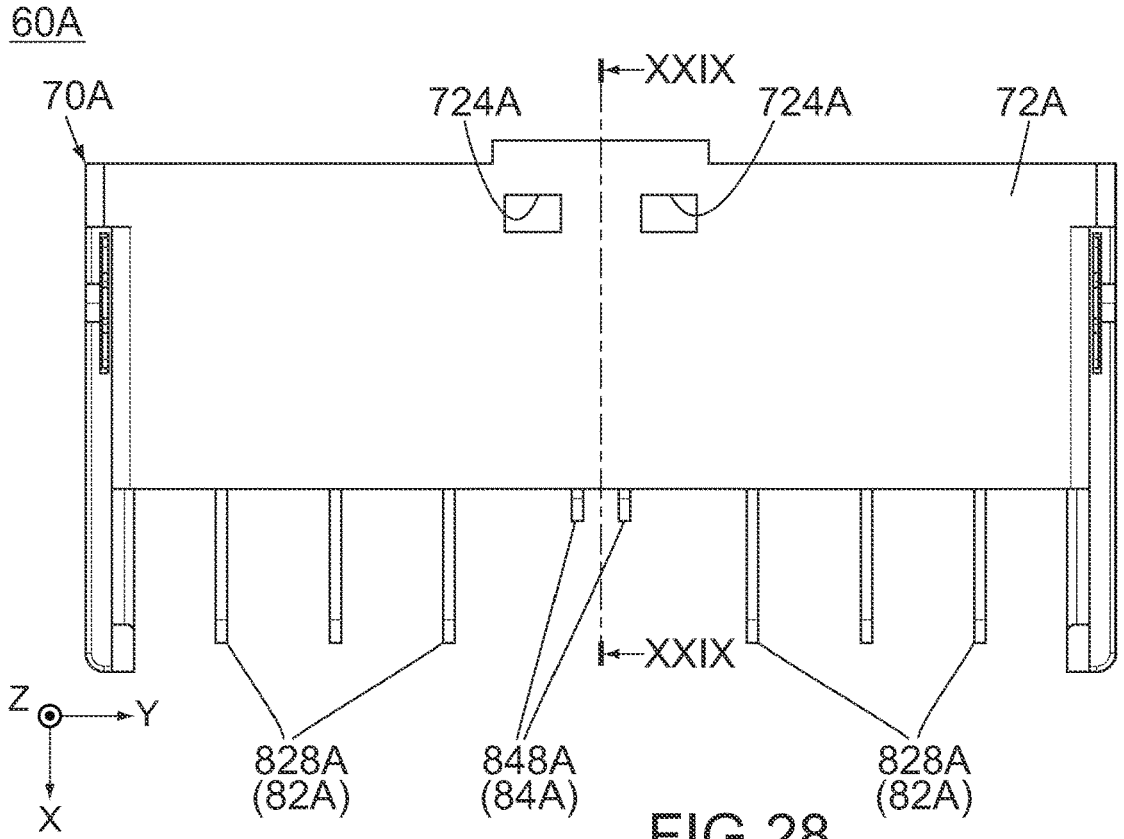
FIG. 28 is a top view showing the mating connector of FIG. 27.

Referring to FIGS. 26 and 27, the mating housing 70A of the present embodiment has an upper plate 72A, two side plates 74A, a bottom plate 76A and a rear plate 78A. Each of the upper plate 72A, the side plates 74A, the bottom plate 76A and the rear plate 78A has a rectangular flat-plate shape. The upper plate 72A, the side plates 74A, the bottom plate 76A and the rear plate 78A are connected to each other to form a rectangular parallelepiped box which opens rearward.

The upper plate 72A is located at an upper end of the mating housing 70A in a perpendicular direction (upper-lower direction: Z-direction) perpendicular to the X-direction and extends along a horizontal plane (XY-plane) perpendicular to the Z-direction. The bottom plate 76A is located at a lower end of the mating housing 70A and extends along the XY-plane in parallel to the upper plate 72A. The two side plates 74A are located at opposite sides of the mating housing 70A, respectively, in a lateral direction (Y-direction) perpendicular to both the X-direction and the Z-direction and extend along a predetermined plane (XZ-plane) in parallel to each other. The rear plate 78A extends along a perpendicular plane (YZ-plane) and is connected to front ends (positive X-side ends) of the upper plate 72A, the side plates 74A and the bottom plate 76A.

Referring to FIG. 26, the mating housing 70A which is formed as described above has a receiving portion 62A in which the connector 20A is receivable. In other words, the mating housing 70A forms the receiving portion 62A of the mating connector 60A. The receiving portion 62A of the present embodiment is a rectangular parallelepiped space which is enclosed by the upper plate 72A, the side plates 74A, the bottom plate 76A and the rear plate 78A and opens rearward. The rear plate 78A defines a front end of the receiving portion 62A.

The mating housing 70A of the present embodiment has the aforementioned structure as a whole. However, the structure of the mating housing 70A is not limited to the present embodiment, provided that the mating connector 60A is provided with the receiving portion 62A.

As shown in FIG. 26, the mating housing 70A is formed with a release projection 722A and two mating lock portions (lock holes) 724A. The release projection 722A and the mating lock portions 724A are parts of the CPA mechanism of the connector assembly 10A. According to the present embodiment, the number of the release projection 722A is one, and the number of the mating lock portions 724A is two. The two mating lock portions 724A are arranged in the Y-direction while the release projection 722A is located therebetween. However, the number of the release projection 722A and the number of the mating lock portions 724A may be designed in accordance with a necessary CPA mechanism. Moreover, the release projection 722A and the mating lock portions 724A may be arranged in accordance with a necessary CPA mechanism.

Figure 29:
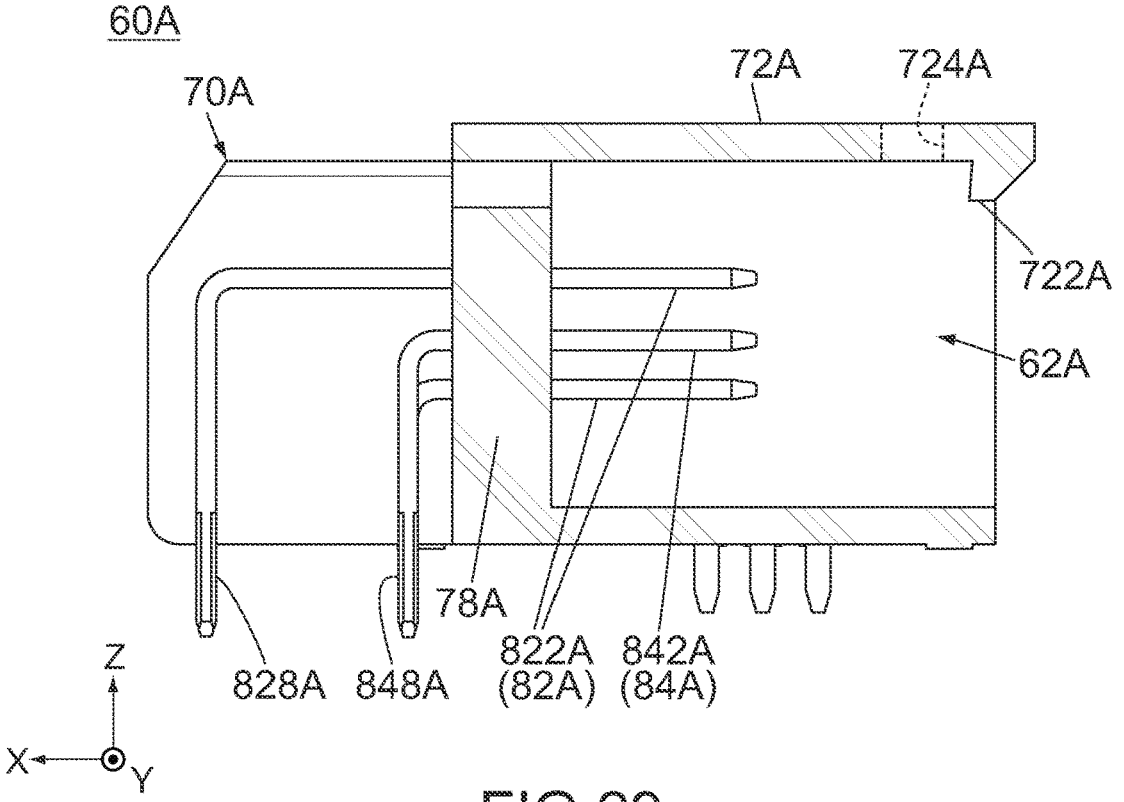
FIG. 29 is a cross-sectional view showing the mating connector of FIG. 28, taken along line XXIX-XXIX, wherein a hidden outline of a mating lock portion is illustrated with dashed line.

As shown in FIGS. 26 and 29, the release projection 722A of the present embodiment is provided on the upper plate 72A. The release projection 722A is located at a rear end (negative X-side end) of the upper plate 72A in the X-direction and is located at the middle of the upper plate 72A in the Y-direction. The release projection 722A projects downward, i.e. in the negative Z-direction, from a lower surface (negative Z-side surface) of the upper plate 72A.

Thus, the release projection 722A projects into the receiving portion 62A. The release projection 722A of the present embodiment has a rear end formed with a guide surface and a front end formed with a stop surface. The guide surface of the release projection 722A is a gentle slope which relatively gently slopes forward and downward. The stop surface of the release projection 722A is a sharp slope which sharply slopes forward and downward. However, the structure of the release projection 722A is not limited to the present embodiment but can be modified as necessary, provided that the release projection 722A is, at least in part, located in the receiving portion 62A.

As shown in FIGS. 26 to 29, the mating lock portions 724A of the present embodiment are formed in the upper plate 72A. Each of the mating lock portions 724A is a hole formed in the upper plate 72A and has a rectangular shape in the XY-plane. Each of the mating lock portions 724A passes through the upper plate 72A in the Z-direction to communicates with the receiving portion 62A. Thus, each of the mating lock portions 724A faces the receiving portion 62A. Each of the mating lock portions 724A of the present embodiment has the aforementioned structure. However, the structure of each of the mating lock portions 724A can be variously modified, provided that each of the mating lock portions 724A faces the inner space of the receiving portion 62A. For example, each of the mating lock portions 724A may be a projection instead of a hole. When each of the mating lock portions 724A is a projection, each of the mating lock portions 724A may project into the receiving portion 62A.

Referring to FIGS. 26, 27 and 29, the mating housing 70A holds the first mating terminals 82A and the second mating terminals 84A. The first mating terminals 82A and the second mating terminals 84A of the present embodiment are insert-molded into and are held by the rear plate 78A of the mating housing 70A. However, the present invention is not limited thereto, but the first mating terminals 82A and the second mating terminals 84A may be held by the mating housing 70A in any manner.

Referring to FIGS. 26 and 27, the second mating terminals 84A are located at the middle of the rear plate 78A in the Y-direction and are arranged in the Y-direction. The first mating terminals 82A are divided into two rows in the Z-direction. The first mating terminals 82A of each row are arranged in the Y-direction so that the second mating terminals 84A are located between two of the first mating terminals 82A. The first mating terminals 82A and the second mating terminals 84A of the present embodiment are arranged as described above. However, the arrangement of the first mating terminals 82A and the second mating terminals 84A is not limited to the present embodiment.

Referring to FIG. 29, each of the first mating terminals 82A is a so-called pin contact which is formed by bending a metal rod. Each of the first mating terminals 82A has a mating contact portion 822A and a mating fixed portion 828A. Each of the mating contact portions 822A is located within the receiving portion 62A. In detail, the mating contact portions 822A extend from the rear plate 78A toward the opening of the receiving portion 62A along the negative X-direction and extend to positions same as each other. Each of the mating fixed portions 828A projects outward of the mating housing 70A from the rear plate 78A and extends downward as a whole. Each of the mating fixed portions 828A is fixed and connected to the circuit board (not shown) via soldering, etc. when the mating connector 60A is used.

Each of the second mating terminals 84A is a so-called pin contact which is formed by bending a metal rod. Each of the second mating terminals 84A has a mating contact portion 842A and a mating fixed portion 848A. Each of the mating contact portions 842A is located within the receiving portion 62A. In detail, the mating contact portion 842A extend from the rear plate 78A toward the opening of the receiving portion 62A along the negative X-direction and extend to positions same as each other. Each of the mating fixed portions 848A projects outward of the mating housing 70A from the rear plate 78A and extends downward as a whole. Each of the mating fixed portions 848A is fixed and connected to the circuit board (not shown) via soldering, etc. when the mating connector 60A is used.

The mating contact portions 842A of the second mating terminals 84A extend along the negative X-direction to the position which is same as the position to which the mating contact portions 822A of the first mating terminals 82A extend. In other words, the position of rear ends of the mating contact portions 822A in the X-direction is same as the position of rear ends of the mating contact portions 842A in the X-direction. Each of the first mating terminals 82A and the second mating terminals 84A of the present embodiment has the aforementioned structure. However, the structure of each of the first mating terminals 82A and the second mating terminals 84A is not limited to the present embodiment.

Hereafter, explanation will be made about the structure of the connector 20A (see FIG. 26).

Figure 32:
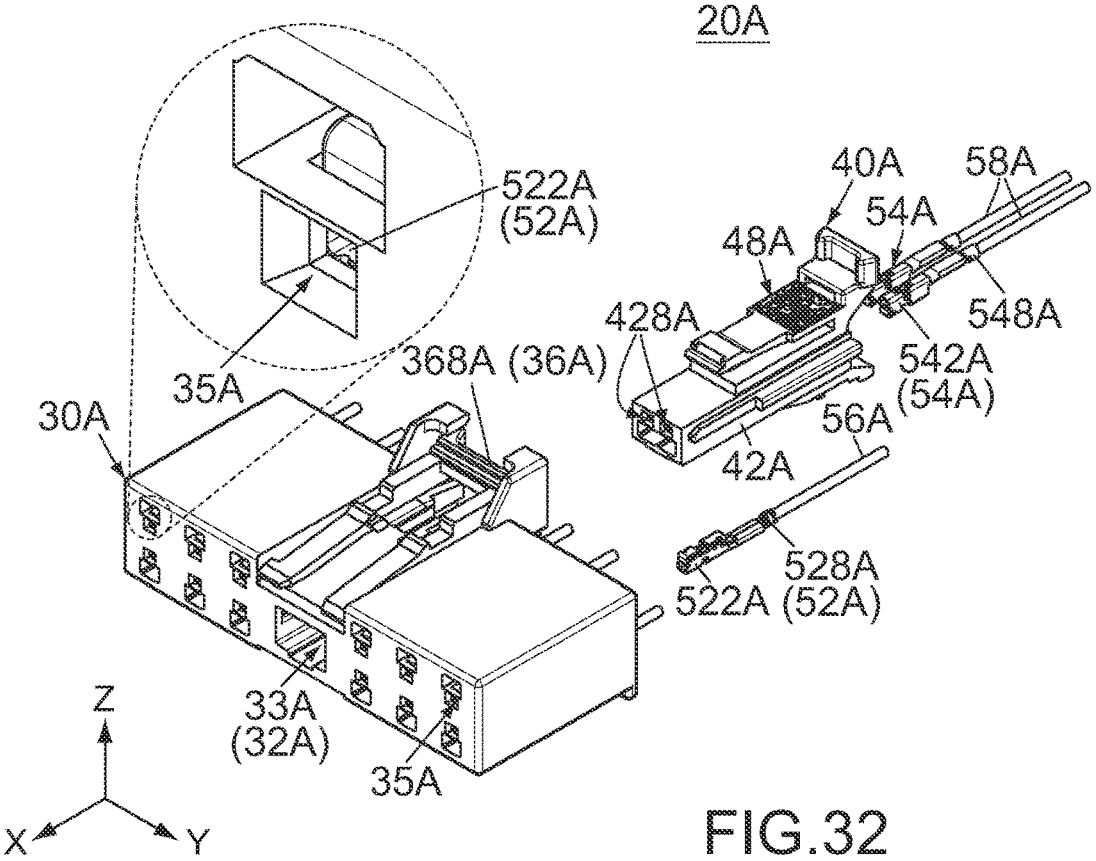
FIG. 32 is an exploded, perspective view showing the connector of FIG. 30, wherein a part of the connector enclosed by dashed line is enlarged and illustrated.

Referring to FIGS. 26 and 32, the connector 20A of the present embodiment comprises a first housing 30A made of insulator, a second housing 40A made of insulator, a plurality of first terminals 52A each made of conductor and a plurality of second terminals 54A each made of conductor.

The first terminals 52A of the present embodiment are terminals for supplying electric power. The first terminals 52A are connected to the cables 56A for supplying electric power, respectively, when the connector 20A is used. The second terminals 54A are parts of the HVIL mechanism. The second terminals 54A are connected to the cables 58A for transmitting signals, respectively, when the connector 20A is used. The first terminals 52A of the present embodiment correspond to the first mating terminals 82A (see FIG. 26), respectively. The second terminals 54A of the present embodiment correspond to the second mating terminals 84A, respectively. Thus, the connector 20A of the present embodiment is provided with six pairs of the first terminals 52A, i.e. twelve of the first terminals 52A and a pair of the second terminals 54A, i.e. two of the second terminals 54A.

The connector 20A of the present embodiment has the aforementioned members. However, the present invention is not limited thereto. For example, the number of the first terminals 52A may be designed in accordance with usage. The number of the second terminals 54A may be designed in accordance with a necessary HVIL mechanism. When no HVIL mechanism is provided, the second terminals 54A do not need to be provided. The HVIL mechanism may be formed of members different from the second terminals 54A. Thus, the connector 20A of the present invention should comprise the first housing 30A, the second housing 40A and one or more of the first terminals 52A. Instead, the connector 20A may comprise another member in addition to the aforementioned members.

Referring to FIG. 26, the first housing 30A is partially insertable into the receiving portion 62A of the mating connector 60A. When the connector 20A is mated with the mating connector 60A, the first housing 30A is inserted into the receiving portion 62A along the positive X-direction to be received in the receiving portion 62A. Thus, the first housing 30A is configured to be received into the receiving portion 62A along the positive X-direction.

Figure 30:
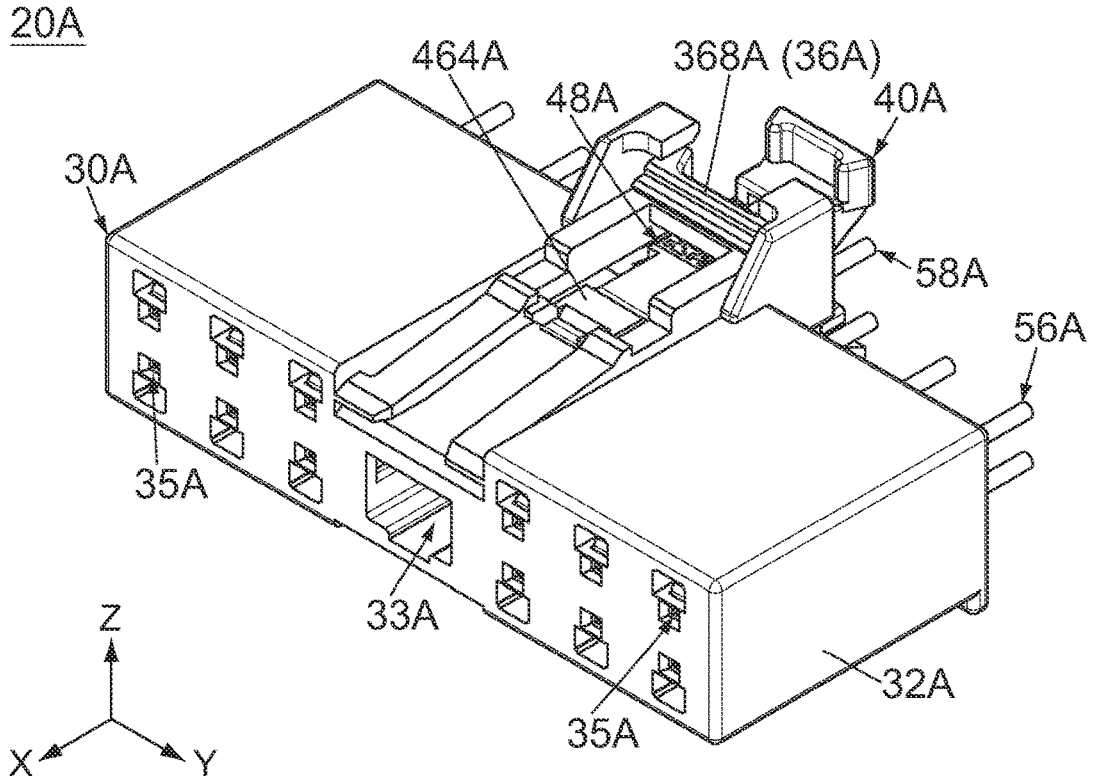
FIG. 30 is a perspective view showing the connector of the connector assembly of FIG. 26.
Figure 31:
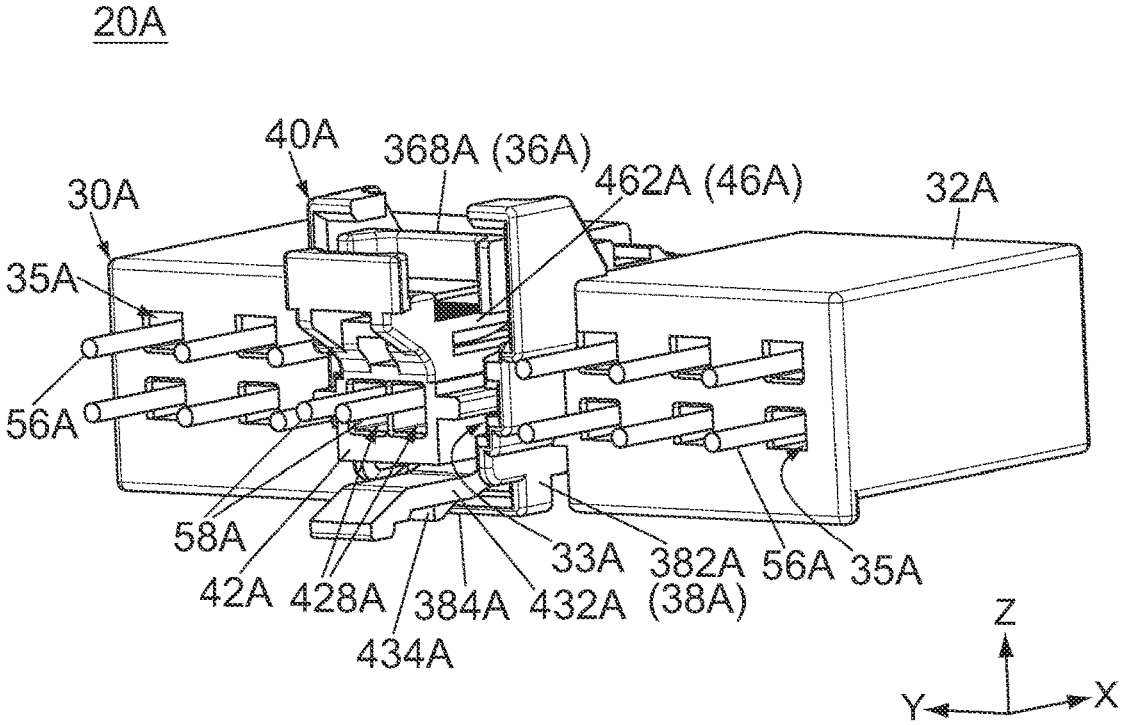
FIG. 31 is another perspective view showing the connector of FIG. 30.

Referring to FIGS. 26, 30 and 31, the first housing 30A of the present embodiment has a base portion 32A, a first structure 36A and an additional structure 38A. The base portion 32A has a shape which corresponds to the receiving portion 62A of the mating connector 60A. The first structure 36A is a part of the CPA mechanism of the connector assembly 10A. The first structure 36A of the present embodiment is connected to an upper side (positive Z-side) of the base portion 32A. The additional structure 38A is connected to a lower side (negative Z-side) of the base portion 32A. The first housing 30A of the present embodiment has the aforementioned structure as a whole. However, the structure of the first housing 30A can be modified as necessary.

Referring to FIGS. 30 and 31, the base portion 32A is formed with an accommodation portion 33A and a plurality of first-terminal accommodation portions 35A. The accommodation portion 33A is a hole which passes through the base portion 32A in the X-direction and opens forward and rearward. The accommodation portion 33A has a rectangular parallelepiped shape. Each of the first-terminal accommodation portions 35A is a hole which passes through the base portion 32A in the X-direction and opens forward and rearward.

Figure 33:
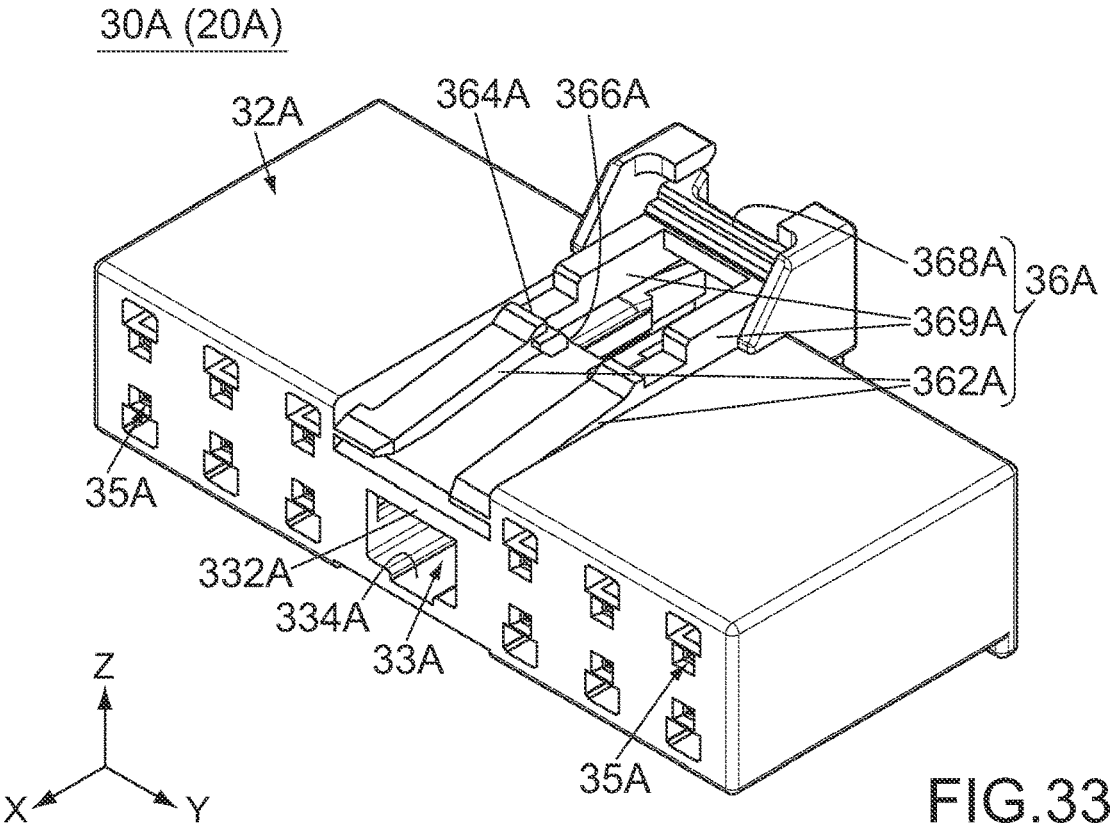
FIG. 33 is a perspective view showing a first housing of the connector of FIG. 32.
Figure 36:
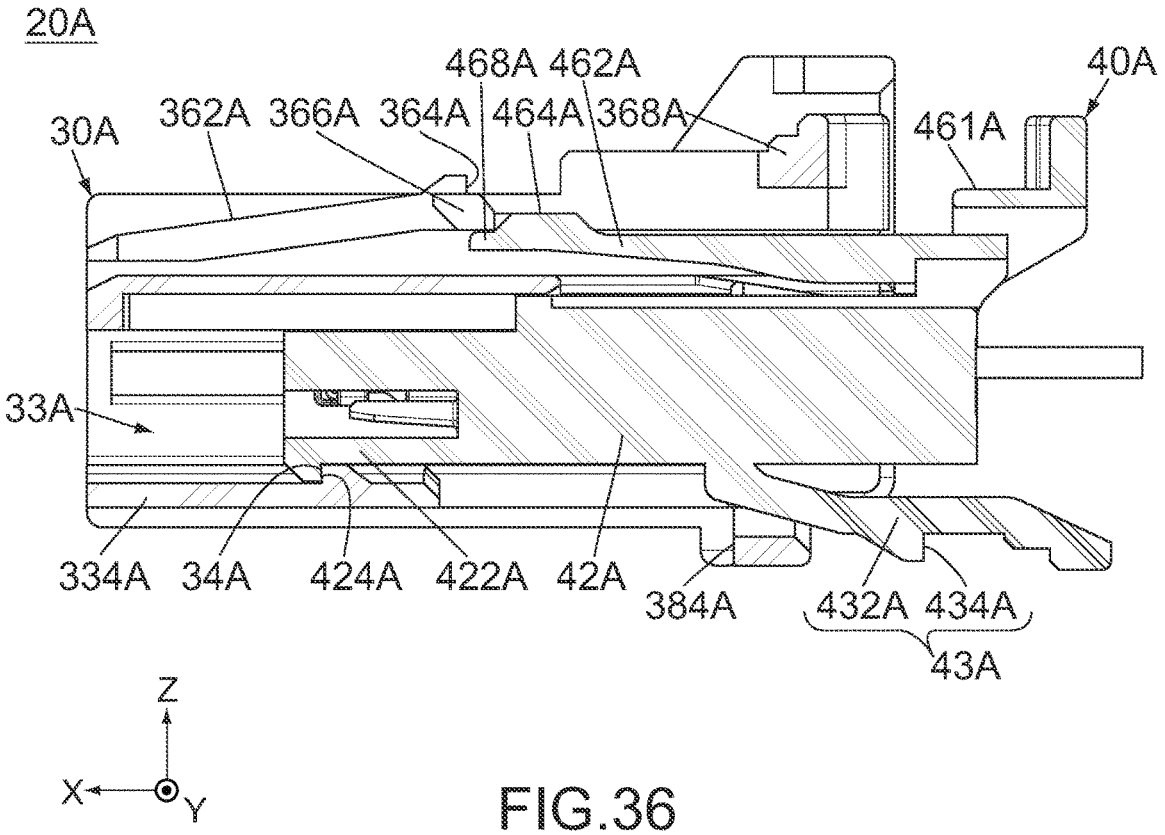
FIG. 36 is a cross-sectional view showing the connector of FIG. 35, taken along line XXXVI-XXXVI.

Referring to FIGS. 32 and 36, the accommodation portion 33A is a space which accommodates a part of the second housing 40A but allows a movement of the second housing 40A. Referring to FIG. 33, the accommodation portion 33A is located at the middle of the base portion 32A in the Y-direction. The accommodation portion 33A is provided with an upper wall 332A and a bottom wall 334A. The upper wall 332A is an upper inner wall of the accommodation portion 33A. The bottom wall 334A is a lower inner wall of the accommodation portion 33A.

Referring to FIG. 36, the bottom wall 334A is formed with an additional stopper 34A. Thus, the first housing 30A is provided with the additional stopper 34A. The additional stopper 34A is a part for holding a part of the second housing 40A in the accommodation portion 33A. The additional stopper 34A projects upward, i.e. in the positive Z-direction, from the bottom wall 334A. Thus, the additional stopper 34A projects into the accommodation portion 33A. The additional stopper 34A of the present embodiment has a rear end formed with a guide surface and a front end formed with a stop surface. The guide surface of the additional stopper 34A is a gentle slope which relatively gently slopes forward and upward. The stop surface of the additional stopper 34A is a sharp slope which sharply slopes forward and upward. The accommodation portion 33A of the present embodiment has the aforementioned structure. However, the structure of the accommodation portion 33A is not limited to the present embodiment.

Referring to FIG. 32, the first-terminal accommodation portions 35A are provided so as to correspond to the first terminals 52A, respectively. Each of the first-terminal accommodation portions 35A is a space for accommodating the corresponding first terminal 52A. Referring to FIG. 26, positions of the first-terminal accommodation portions 35A in the YZ-plane correspond to positions of the mating contact portions 822A of the first mating terminals 82A of the mating connector 60A in the YZ-plane, respectively. Thus, the first-terminal accommodation portions 35A are arranged so that the mating contact portions 822A can be received therein, respectively.

Referring to FIG. 32, each of the first terminals 52A is a so-called socket contact which is formed by bending a single metal plate. Thus, each of the first terminals 52A is a single metal plate with bends. The first terminals 52A of the present embodiment have shapes same as each other. Each of the first terminals 52A has a contact portion 522A and a connected portion 528A.

Referring to FIG. 32 together with FIG. 26, each of the contact portions 522A can receive a part of the mating contact portion 822A of the corresponding first mating terminal 82A and thereby can be brought into contact with the mating contact portion 822A. The thus-formed first terminals 52A are connected to the first mating terminals 82A, respectively, when the first housing 30A is received in the receiving portion 62A of the mating connector 60A. Meanwhile, each of the connected portions 528A is connected to the corresponding cable 56A. Each of the first terminals 52A of the present embodiment has the aforementioned structure. However, the structure of each of the first terminals 52A is not limited to the present embodiment.

Referring to FIG. 32, each of the first terminals 52A is inserted into the corresponding first-terminal accommodation portion 35A together with an end of the cable 56A and is held therein to be unmovable relative to the base portion 32A. Thus, the first housing 30A holds the first terminals 52A. When the first terminals 52A are held by the first housing 30A, the contact portion 522A of each of the first terminals 52A is located in the vicinity of a front end of the base portion 32A.

Referring to FIGS. 31 and 32, the second housing 40A is partially insertable in the accommodation portion 33A of the first housing 30A. The second housing 40A is inserted into the accommodation portion 33A from behind and is accommodated therein so that the connector 20A is assembled.

Figure 34:
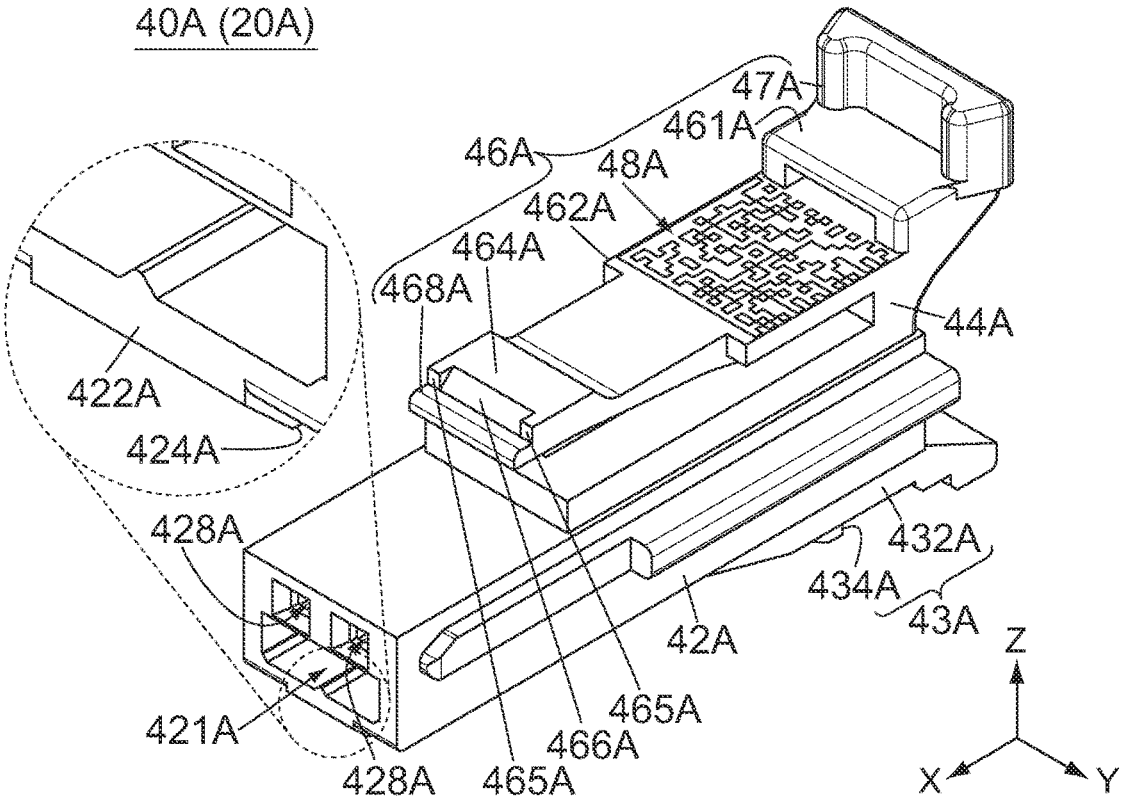
FIG. 34 is a perspective view showing a second housing of the connector of FIG. 32, wherein a part of the second housing enclosed by dashed line is enlarged and illustrated.

Referring to FIG. 34, the second housing 40A of the present embodiment has a body portion 42A, an additional structure 43A, a coupling portion 44A and a second structure 46A. The body portion 42A has a shape which corresponds to the accommodation portion 33A (see FIG. 32) of the first housing 30A (see FIG. 32). The additional structure 43A is connected to a lower surface of the body portion 42A and extends rearward beyond a rear end of the body portion 42A. The coupling portion 44A is connected to a rear end of an upper surface (positive Z-side surface) of the body portion 42A and extends upward from the upper surface of the body portion 42A. The second structure 46A is a part of the CPA mechanism of the connector assembly 10A (see FIG. 26). The second structure 46A of the present embodiment is connected to an upper end of the coupling portion 44A. Most of the second structure 46A extends forward from the coupling portion 44A while a part of the second structure 46A protrudes rearward from the coupling portion 44A. Thus, the coupling portion 44A couples the second structure 46A to the body portion 42A.

The second housing 40A of the present embodiment has the aforementioned structure as a whole. However, the structure of the second housing 40A can be modified as necessary.

The body portion 42A of the present embodiment is formed with two second-terminal accommodation portions 428A and a bottom plate 422A which has an additional stopped portion 424A. Thus, the second housing 40A of the present embodiment is provided with the second-terminal accommodation portions 428A and the additional stopped portion 424A.

Referring to FIG. 32, each of the second-terminal accommodation portions 428A is a hole which passes through the body portion 42A in the X-direction and opens forward and rearward. The second-terminal accommodation portions 428A are provided so as to correspond to the second terminals 54A, respectively. Each of the second-terminal accommodation portions 428A is a space for accommodating the corresponding second terminal 54A. Referring to FIG. 26, positions of the second-terminal accommodation portions 428A in the YZ-plane correspond to positions of the mating contact portions 842A of the second mating terminals 84A of the mating connector 60A in the YZ-plane, respectively. Thus, the second-terminal accommodation portions 428A are arranged so that the mating contact portions 842A can be received therein, respectively.

Figure 37:
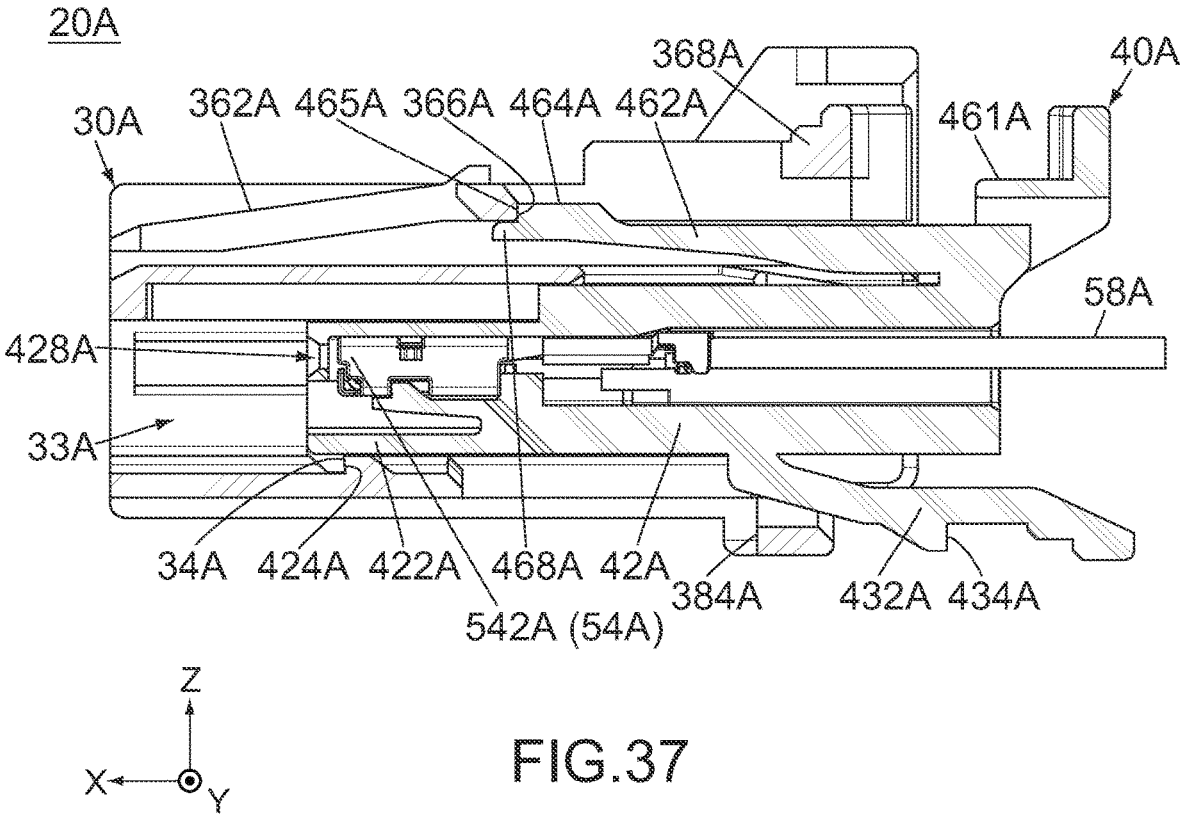
FIG. 37 is a cross-sectional view showing the connector of FIG. 35, taken along line XXXVII-XXXVII, wherein a second terminal and a cable are illustrated not by their cross-sections but by their side surfaces.

Referring to FIG. 34, the body portion 42A is formed with a recess 421A which is recessed rearward. The bottom plate 422A is a lower inner wall of the recess 421A. The bottom plate 422A has a thin thickness, i.e. a small size in the Z-direction. The thus-formed bottom plate 422A is easily bent. The additional stopped portion 424A is located at a front end of the bottom plate 422A and projects downward from a lower surface of the bottom plate 422A. Referring to FIGS. 36 and 37, the additional stopped portion 424A of the present embodiment has a front end formed with a guided surface and a rear end formed with a stopped surface. The guided surface of the additional stopped portion 424A is a gentle slope which relatively gently slopes rearward and downward. The stopped surface of the additional stopped portion 424A is a sharp slope which sharply slopes rearward and downward.

The body portion 42A of the present embodiment has the aforementioned structure. However, the structure of the body portion 42A is not limited to the present embodiment.

Referring to FIG. 32, each of the second terminals 54A is a so-called socket contact which is formed by bending a single metal plate. Thus, each of the second terminals 54A is a single metal plate with bends. The second terminals 54A of the present embodiment have shapes same as each other. Each of the second terminals 54A has a contact portion 542A and a connected portion 548A. Referring to FIG. 32 together with FIG. 26, each of the contact portions 542A can receive a part of the mating contact portion 842A of the corresponding second mating terminal 84A and thereby can be brought into contact with the mating contact portion 842A. Meanwhile, each of the connected portions 548A is connected to the corresponding cable 58A. Thus, the second terminals 54A are connected to the cables 58A, respectively. Each of the second terminals 54A of the present embodiment has the aforementioned structure. However, the structure of each of the second terminals 54A is not limited to the present embodiment.

Referring to FIGS. 32 and 37, each of the second terminals 54A is inserted into the corresponding second-terminal accommodation portion 428A together with an end of the cable 58A and is held therein to be unmovable relative to the body portion 42A. Thus, the second housing 40A holds the second terminals 54A. When the second terminals 54A are held by the second housing 40A, the contact portion 542A of each of the second terminals 54A is located in the vicinity of a front end of the body portion 42A.

Referring to FIGS. 36 and 37, the body portion 42A of the second housing 40A is inserted into the accommodation portion 33A of the first housing 30A from behind. When the body portion 42A is inserted into the accommodation portion 33A, the guided surface of the front end of the additional stopped portion 424A is guided by the guide surface of the rear end of the additional stopper 34A. The thus-guided additional stopped portion 424A is moved forward beyond the additional stopper 34A while the bottom plate 422A is bent. In the assembled connector 20A, the additional stopped portion 424A is located forward of the additional stopper 34A and faces the additional stopper 34A in the X-direction. If the second housing 40A is tried to be removed from the accommodation portion 33A, the stopped surface of the rear end of the additional stopped portion 424A is stopped by the stop surface of the front end of the additional stopper 34A so that the rearward movement of the second housing 40A is stopped.

As described above, the additional stopper 34A and the additional stopped portion 424A are engaged with each other so that the body portion 42A of the second housing 40A is prevented from coming off the accommodation portion 33A of the first housing 30A. Thus, the second housing 40A is securely held so as not to come off the first housing 30A.

Referring to FIGS. 32 and 37, when the body portion 42A of the second housing 40A is accommodated in the accommodation portion 33A of the first housing 30A, i.e. when the connector 20A is assembled, the contact portions 542A of the second terminals 54A are located rearward of the contact portions 522A of the first terminals 52A.

Referring to FIG. 26, according to the present embodiment, the first structure 36A of the first housing 30A and the second structure 46A of the second housing 40A form the CPA mechanism of the connector assembly 10A together with the release projection 722A and the mating lock portions 724A of the mating connector 60A. Hereafter, explanation will be made about a structure of each of the first structure 36A and the second structure 46A.

Referring to FIG. 33, the first structure 36A of the first housing 30A of the present embodiment includes two first support portions 362A, two lock portions (lock projections) 364A, two stoppers 366A, a cover portion (operation portion) 368A and two coupling arms 369A. Thus, the first housing 30A is provided with the first support portions 362A, the lock portions 364A, the stoppers 366A, the cover portion 368A and the coupling arms 369A.

The first support portions 362A are arranged to be apart from each other in the Y-direction. Each of the first support portions 362A has a front end which is a fixed end fixed to the front end of the base portion 32A. The first support portions 362A extend rearward from these fixed ends in parallel to each other while being away from an upper surface of the base portion 32A. The coupling arms 369A are provided so as to correspond to the first support portions 362A, respectively. Each of the coupling arms 369A is connected to a rear end of the corresponding first support portion 362A and extends rearward above the base portion 32A. The cover portion 368A extends along the Y-direction and couples rear ends of the two coupling arms 369A to each other. In other words, each of the coupling arms 369A couples the cover portion 368A and the corresponding first support portion 362A to each other.

As can be seen from the structure described above, each of the first support portions 362A works as a cantilevered spring and is resiliently deformable. In particular, each of the first support portions 362A has a thin thickness, i.e. a small size in the Z-direction, and is easily deformed resiliently. In contrast, each of the coupling arms 369A has a thick thickness, i.e. a large size in the Z-direction, and is hardly deformed resiliently. For example, when the cover portion 368A is pressed downward, the first support portions 362A are mainly deformed resiliently. Thus, each of the first support portions 362A of the present embodiment has a restoring force which is a resilient force thereof.

The two lock portions 364A are provided so as to correspond to the first support portions 362A, respectively. Each of the lock portions 364A is located in the vicinity of the rear end of the corresponding first support portion 362A and projects upward from the first support portion 362A. Thus, each of the first support portions 362A supports the corresponding lock portion 364A. Each of the lock portions 364A is movable in the Z-direction by using the restoring force of the corresponding first support portion 362A. For example, when the cover portion 368A is pressed downward, the first support portions 362A are resiliently deformed, and the lock portions 364A are moved downward. When the pressure against the cover portion 368A is stopped, the first support portions 362A return to their initial states, and the lock portions 364A are moved upward.

Each of the lock portions 364A of the present embodiment has a front end formed with a guided surface and a rear end formed with a stopped surface. The guided surface of each of the lock portions 364A is a gentle slope which relatively gently slopes rearward and upward. The stopped surface of each of the lock portions 364A is a vertical surface which extends along the YZ-plane.

Figure 39:
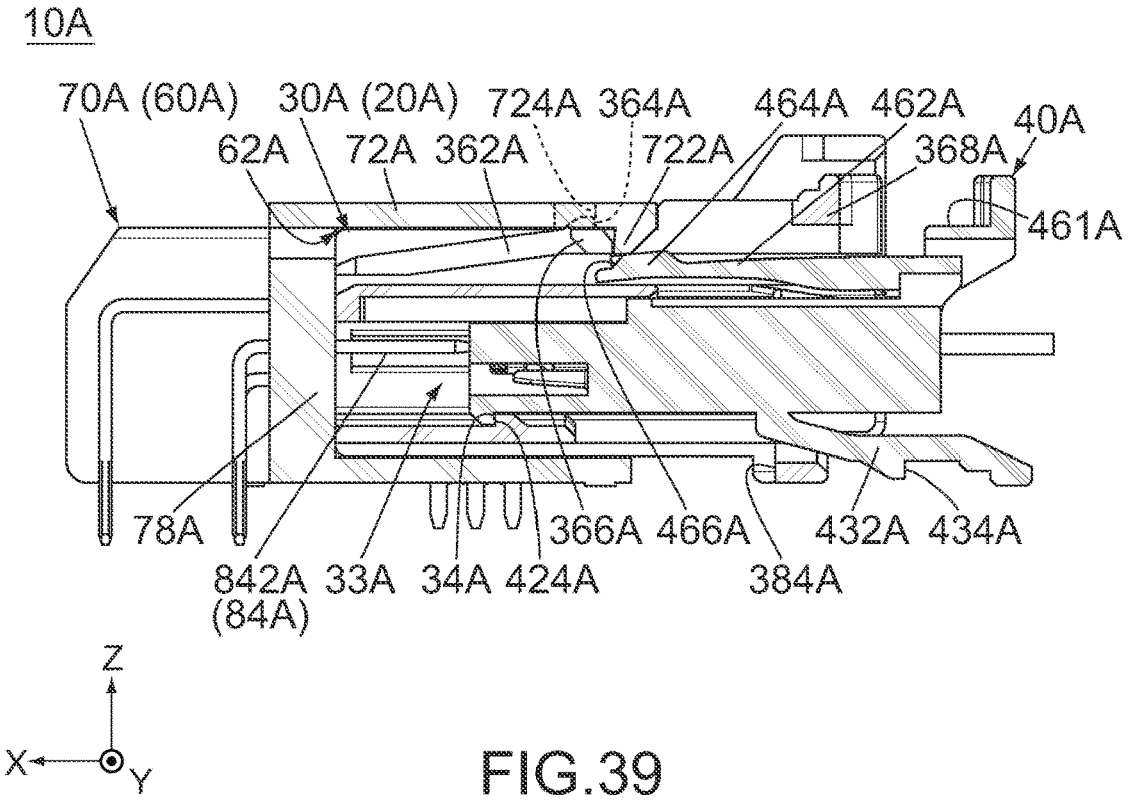
FIG. 39 is a cross-sectional view showing the connector assembly of FIG. 38, taken along line XXXIX-XXXIX, wherein hidden outlines of a lock portion and the mating lock portion are illustrated with dashed line.
Figure 40:
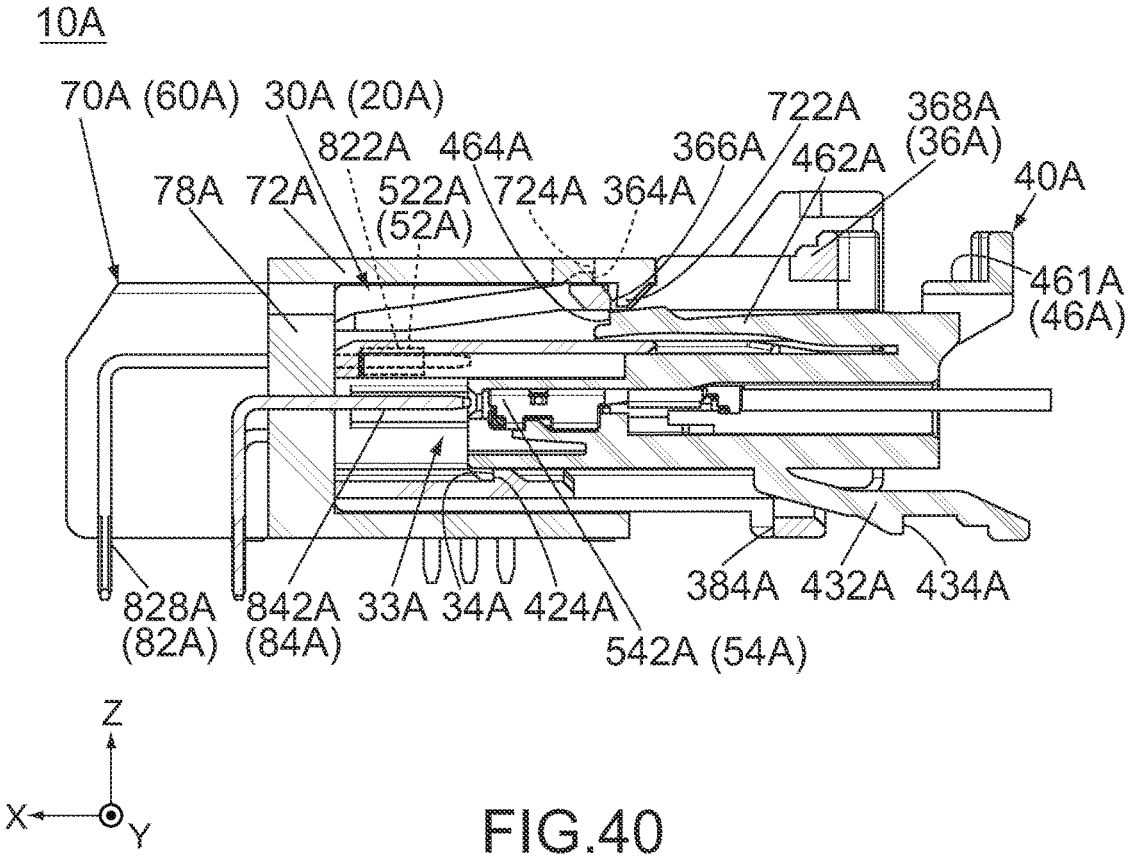
FIG. 40 is a cross-sectional view showing the connector assembly of FIG. 38, taken along line XL-XL, wherein hidden outlines of the lock portion, the mating lock portion, a part of a terminal and a mating terminal are illustrated with dashed line, and the second terminal and the cable are illustrated not by their cross-sections but by their side surfaces.

Referring to FIG. 39, the lock portions 364A, which are formed as described above, are engaged with the mating lock portions 724A, respectively, under the mated state where the first housing 30A is received in the receiving portion 62A of the mating connector 60A. The lock portions 364A and the mating lock portions 724A, which are engaged as described above, prevent the first housing 30A from coming off the receiving portion 62A. Referring to FIG. 40, under the mated state, the first terminals 52A of the connector 20A are connected to the first mating terminals 82A of the mating connector 60A, respectively. Thus, the lock portions 364A and the mating lock portions 724A lock a state where the first housing 30A is received in the receiving portion 62A when the first terminals 52A are connected to the first mating terminals 82A.

Referring to FIG. 39, each of the lock portions 364A of the present embodiment has the aforementioned structure. However, the structure of each of the lock portions 364A is not limited to the present embodiment, provided that the lock portions 364A are provided so as to correspond to the mating lock portions 724A, respectively. For example, in an instance where each of the mating lock portions 724A is a projection, each of the lock portions 364A may be a hole provided in the first support portion 362A. Moreover, only one of the lock portions 364A may be provided. In this instance, only one of the first support portions 362A may be provided.

Referring to FIG. 33, the two stoppers 366A of the present embodiment are provided so as to correspond to the first support portions 362A, respectively. Each of the stoppers 366A is located at a position same as that of the lock portion 364A in the X-direction and protrudes inward of the first housing 30A in the Y-direction from the corresponding first support portion 362A. Thus, each of the first support portions 362A supports the corresponding stopper 366A. Each of the stoppers 366A is movable in the Z-direction by using the restoring force of the corresponding first support portion 362A. Each of the stoppers 366A of the present embodiment has a rear end formed with a stop surface. The stop surface of each of the stoppers 366A is a vertical surface which extends along the YZ-plane.

Referring to FIG. 34, the second structure 46A of the second housing 40A of the present embodiment includes a regulation portion 461A, a second support portion 462A, a stopped portion (supported portion) 464A, an end portion 468A and a movement-stopped portion 47A. Thus, the second housing 40A is provided with the regulation portion 461A, the second support portion 462A, the stopped portion 464A, the end portion 468A and the movement-stopped portion 47A.

The regulation portion 461A of the present embodiment is a plane which is in parallel to the XY-plane and is located rearward of and above the second support portion 462A. The movement-stopped portion 47A is provided on a rear end of the regulation portion 461A and projects upward from the regulation portion 461A. However, the present invention is not limited thereto. For example, the shape of the regulation portion 461A is not limited to a planar shape. The movement-stopped portion 47A may be provided as necessary.

The second support portion 462A of the present embodiment has a flat-plate shape in parallel to the XY-plane. The second support portion 462A extends forward from the coupling portion 44A above the body portion 42A. The second support portion 462A is cantilevered by the coupling portion 44A and is resiliently deformable. In other words, the second support portion 462A has a restoring force. The second support portion 462A has a predetermined upper surface which is located on a rear end part thereof. The predetermined upper surface is provided with a mechanically readable mark 48A. Thus, the second housing 40A is provided with the mark 48A.

The mark 48A of the present embodiment is a two-dimensional code such as DataMatrix Code (DMC). However, the present invention is not limited thereto. For example, the mark 48A may be provided in any manner, provided that the mark 48A can be read by a reader device (not shown). For example, the mark 48A may be numbers engraved on the second support portion 462A or may be a pattern of a plurality of projections formed on the second support portion 462A.

The stopped portion 464A of the present embodiment has a flat-plate shape which is substantially in parallel to the XY-plane. The stopped portion 464A extends forward from a front end of the second support portion 462A. The stopped portion 464A is formed with two stopped surfaces 465A and a sloping surface 466A. Each of the stopped surfaces 465A is a vertical surface in parallel to the YZ-plane. The stopped surfaces 465A are located at a front end of the stopped portion 464A and sandwich the sloping surface 466A in the Y-direction. The sloping surface 466A slopes upward and rearward from the front end of the stopped portion 464A. The end portion 468A of the present embodiment projects forward from the front end of the stopped portion 464A. The end portion 468A is located below the stopped surfaces 465A and the sloping surface 466A.

Referring to FIGS. 33 and 34, each of the first structure 36A and the second structure 46A of the present embodiment has the aforementioned structure. However, the present invention is not limited thereto, but the structure of each of the first structure 36A and the second structure 46A can be modified as necessary.

Hereafter, explanation will be made about a positional relation between the first housing 30A and the second housing 40A under a state where the connector 20A is not yet mated with the mating connector 60A (see FIG. 26).

Referring to FIG. 37, when the body portion 42A of the second housing 40A is inserted into the accommodation portion 33A of the first housing 30A so that the additional stopped portion 424A is located forward of the additional stopper 34A, the stop surfaces of the rear ends of the stoppers 366A are in contact with the stopped surfaces 465A of the stopped portion 464A, respectively, or face the stopped surfaces 465A in the X-direction, respectively. If the second housing 40A is pushed forward, the stopped surfaces 465A are stopped by the stop surfaces of the stoppers 366A so that the forward movement of the second housing 40A is stopped. Thus, the stoppers 366A and the stopped portion 464A prevent the second housing 40A from being moved forward relative to the first housing 30A. A position of the thus-located second housing 40A relative to the first housing 30A (see the position shown in FIGS. 35 to 37) is referred to "covering position".

As described above, when the second housing 40A is installed to the first housing 30A along the positive X-direction, the stopped portion 464A is brought into abutment with the stoppers 366A, and the second housing 40A takes a regulated state where a movement of the second housing 40A in the positive X-direction is regulated by the stoppers 366A. Thus, when the second housing 40A is located at the covering position, the second housing 40A is under the regulated state. In other words, the second housing 40A under the regulated state is located at the covering position.

Referring to FIGS. 36 and 37, when the second housing 40A is located at the covering position, i.e. when the second housing 40A takes the regulated state, the additional stopper 34A regulates a movement of the additional stopped portion 424A in the negative X-direction so that the second housing 40A is unremovable from the first housing 30A. Therefore, the second housing 40A located at the covering position cannot be removed from the first housing 30A and cannot be further inserted into the first housing 30A. For example, if the cover portion 368A is pushed downward to move the stoppers 366A downward, the end portion 468A is pushed by the stoppers 366A to be moved downward. As a result, the stopped portion 464A is moved downward together with the stoppers 366A and continues being in contact with or facing the stoppers 366A in the X-direction.

Figure 35:
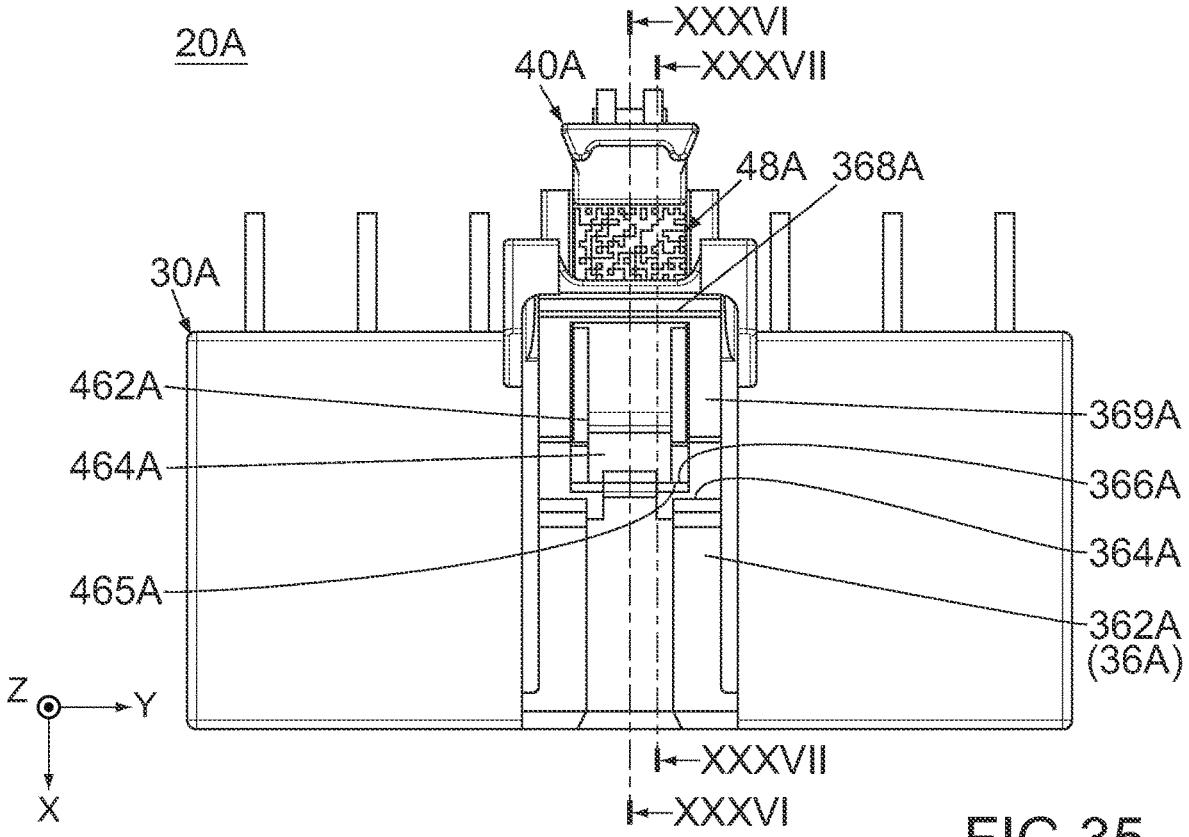
FIG. 35 is a top view showing the connector of FIG. 30.

Referring to FIG. 35 together with FIG. 34, when the second housing 40A is located at the covering position, a front end of the mark 48A is located just under the cover portion 368A to be covered by and hidden behind the cover portion 368A. The reader device (not shown) cannot correctly read the thus-hidden mark 48A, and thereby it can be found that the second housing 40A is located at the covering position. According to the present embodiment, when the second housing 40A is located at the covering position, the mark 48A is partially covered by and hidden behind the cover portion 368A. However, the present invention is not limited thereto. For example, when the second housing 40A is located at the covering position, the mark 48A may be entirely covered by and hidden behind the cover portion 368A. In summary, when the second housing 40A is located at the covering position, the mark 48A should be, at least in part, covered by and hidden behind the cover portion 368A.

Hereafter, explanation will be made about a mating operation for mating the connector 20A with the mating connector 60A and the CPA mechanism of the connector assembly 10A.

Referring to FIGS. 39 and 40, when the connector 20A is mated with the mating connector 60A, the connector 20A is inserted into the mating connector 60A. In detail, the second housing 40A located at the covering position is inserted into the receiving portion 62A of the mating connector 60A along the positive X-direction together with the first housing 30A. When the connector 20A is inserted into the mating connector 60A, the mating contact portions 822A of the first mating terminals 82A are brought into contact with the contact portions 522A of the first terminals 52A, respectively.

When the connector 20A is further inserted into the mating connector 60A, the guide surfaces of the front ends of the lock portions 364A of the connector 20A are brought into abutment with a rear end of the upper plate 72A of the mating housing 70A. When the connector 20A is further inserted into the mating connector 60A, the first support portions 362A are resiliently deformed, and thereby the lock portions 364A are moved to be located under the upper plate 72A together with the stoppers 366A and are received into the receiving portion 62A.

When the connector 20A is further inserted into the mating connector 60A, the lock portions 364A are moved to the mating lock portions 724A of the mating connector 60A. The thus-located lock portions 364A are moved upward together with the stoppers 366A by the restoring forces of the first support portions 362A to be received in the mating lock portions 724A, respectively. At that time, the connector 20A and the mating connector 60A are under the mated state shown in FIGS. 38 to 40 where they are mated with each other, and the second housing 40A is kept at the covering position. The mated state at this time is referred to as "incompletely mated state".

If the first housing 30A of the connector 20A under the incompletely mated state is pulled rearward, the stopped surfaces of the rear ends of the lock portions 364A are stopped by an inner wall surface of the mating lock portions 724A. Therefore, the first housing 30A cannot be removed from the receiving portion 62A merely by pulling it rearward. However, the first housing 30A can be removed from the receiving portion 62A by pushing the cover portion 368A downward so that the lock portions 364A are moved to be located below the mating lock portions 724A.

According to the present embodiment, when the connector 20A is under the mated state including the incompletely mated state, a front end of the first housing 30A is in contact with the rear plate 78A of the mating housing 70A. Therefore, the first housing 30A cannot be further inserted into the receiving portion 62A. Thus, according to the present embodiment, when the connector 20A is under the mated state, the rear plate 78A regulates a further forward movement of the first housing 30A. However, the present invention is not limited thereto, but some part other than the rear plate 78A of the mating housing 70A may regulate the further forward movement of the first housing 30A.

Referring to FIG. 39, as described above, when the connector 20A is inserted into the mating connector 60A, the lock portions 364A are moved to be under the upper plate 72A together with the stoppers 366A. Meanwhile, the second support portion 462A is resiliently deformed, and the stopped portion 464A is moved downward. The sloping surface 466A of the thus-moved stopped portion 464A is guided by the guide surface of the rear end of the release projection 722A so that the stopped portion 464A is moved to be under the release projection 722A. When the lock portions 364A are received in the mating lock portions 724A, the restoring force of the second support portion 462A forces the stopped portion 464A to be in abutment with the release projection 722A which is located above the stopped portion 464A. When the connector 20A is under the incompletely mated state, the stopped portion 464A is located below the stoppers 366A so that the second housing 40A can be moved forward relative to the first housing 30A from the covering position.

Figure 38:
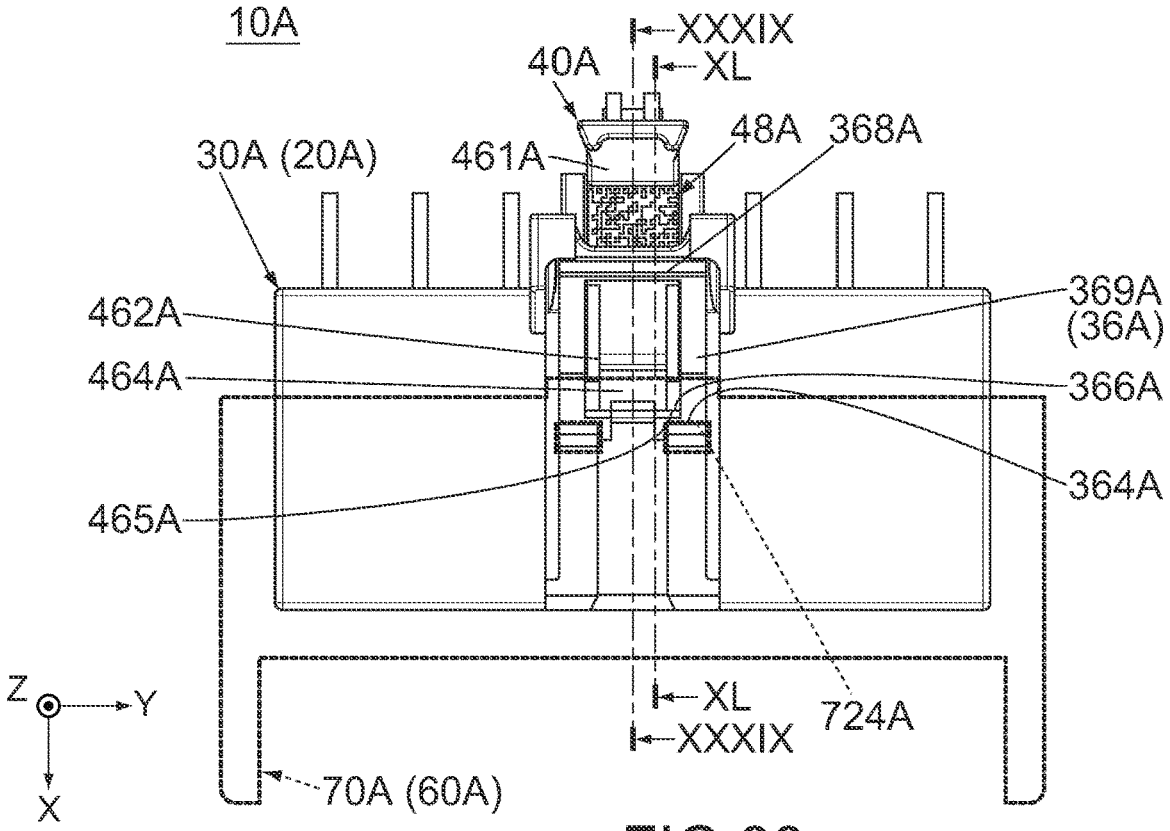
FIG. 38 is a top view showing the connector assembly comprising the connector of FIG. 35 and the mating connector of FIG. 28, wherein the mating connector is only partially illustrated with dashed line, the connector and the mating connector are under a mated state where they are mated with each other, and the second housing of the connector is located at a covering position.

Referring to FIGS. 38 to 43, when the second housing 40A is moved forward from the covering position, i.e. from the state shown in FIGS. 38 to 40, the regulation portion 461A of the second housing 40A is moved to be located under the cover portion 368A of the first housing 30A. A position of the thus-located second housing 40A relative to the first housing 30A (see the position shown in FIGS. 41 to 43) is referred to as "exposing position". The mated state at this time is referred to "completely mated state".

Figure 42:
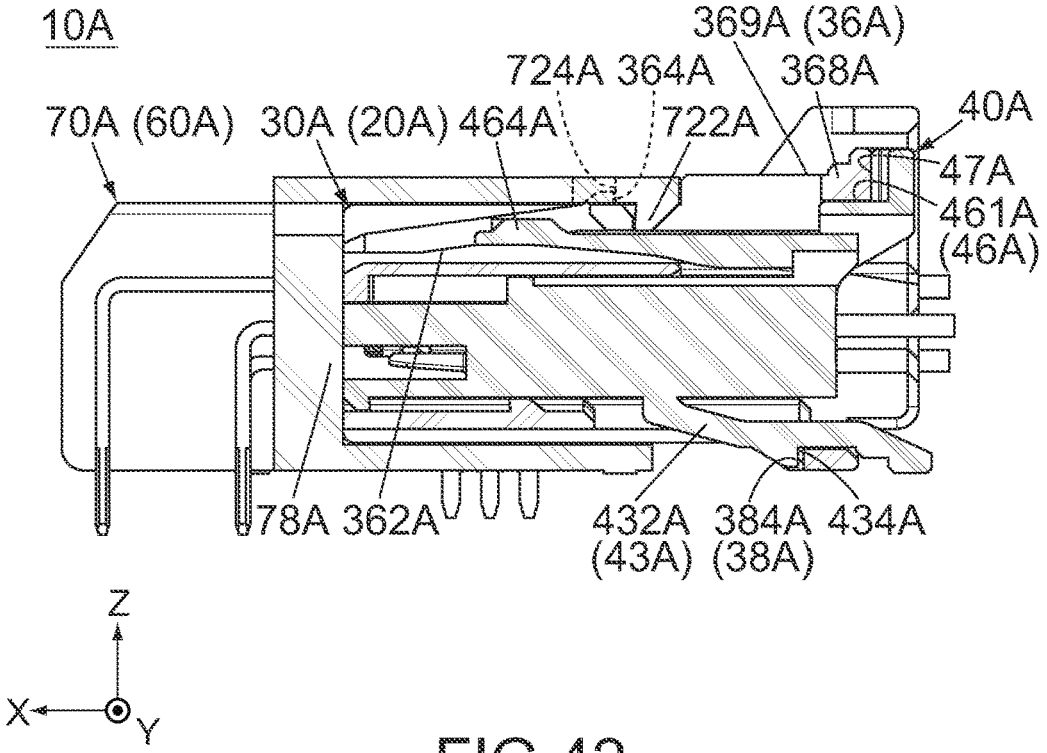
FIG. 42 is a cross-sectional view showing the connector assembly of FIG. 41, taken along line XLII-XLII, wherein hidden outlines of the lock portion and the mating lock portion are illustrated with dashed line.
Figure 43:
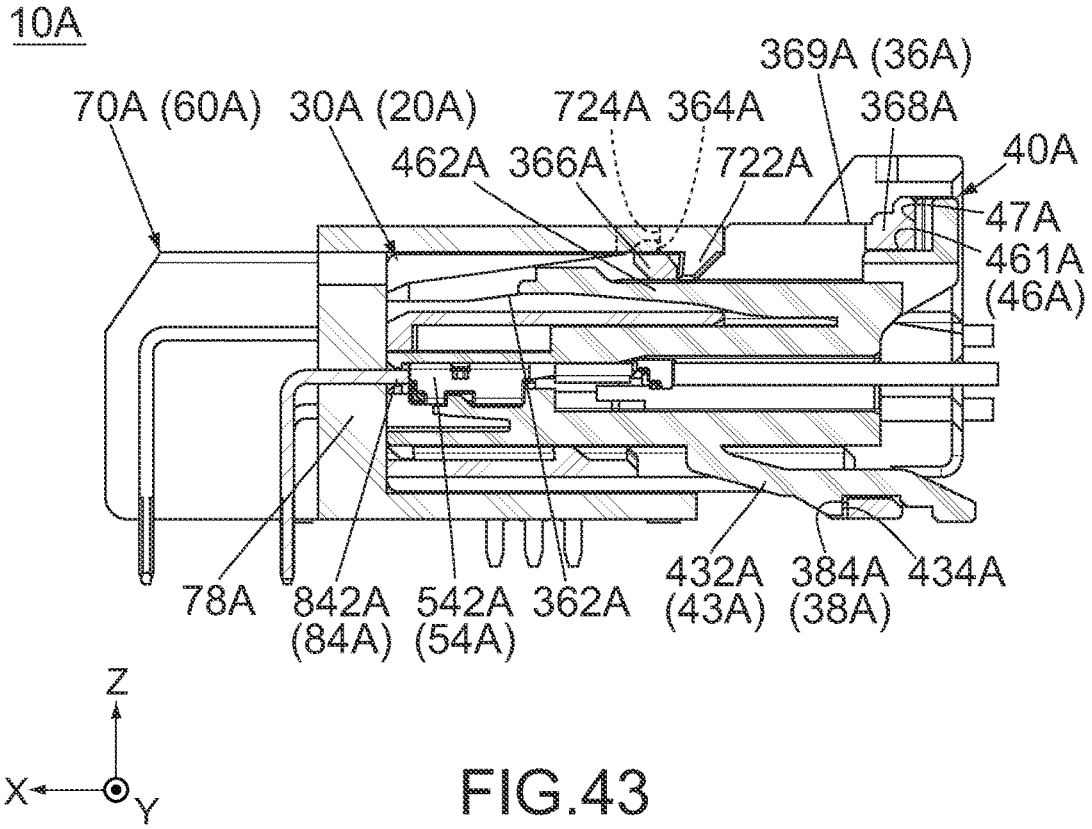
FIG. 43 is a cross-sectional view showing the connector assembly of FIG. 41, taken along line XLIII-XLIII, wherein hidden outlines of the lock portion and the mating lock portion are illustrated with dashed line, and the second terminal and the cable are illustrated not by their cross-sections but by their side surfaces.

Referring to FIGS. 42 and 43, according to the present embodiment, when the second housing 40A is located at the exposing position, a front end of the second housing 40A is in contact with the rear plate 78A of the mating housing 70A. In addition, the movement-stopped portion 47A of the second housing 40A is in contact with the cover portion 368A of the first housing 30A. Therefore, the second housing 40A cannot be further moved forward. Thus, according to the present embodiment, when the second housing 40A is located at the exposing position, the rear plate 78A and the cover portion 368A regulate a further forward movement of the second housing 40A. However, the present invention is not limited thereto. For example, only the cover portion 368A may regulate the further forward movement of the first housing 30A.

If the cover portion 368A or the coupling arms 369A is pushed downward under a state where the second housing 40A is located at the exposing position, the cover portion 368A is stopped by the regulation portion 461A of the second housing 40A, and thereby the first support portions 362A are not resiliently deformed. Moreover, the first support portions 362A are almost entirely received in the receiving portion 62A (see FIG. 26) of the mating connector 60A and are hard to be directly operated. Therefore, when the second housing 40A is located at the exposing position, the lock portions 364A are hard to be moved downward. In other words, when the second housing 40A is located at the exposing position, the mated state is securely locked.

Figure 41:
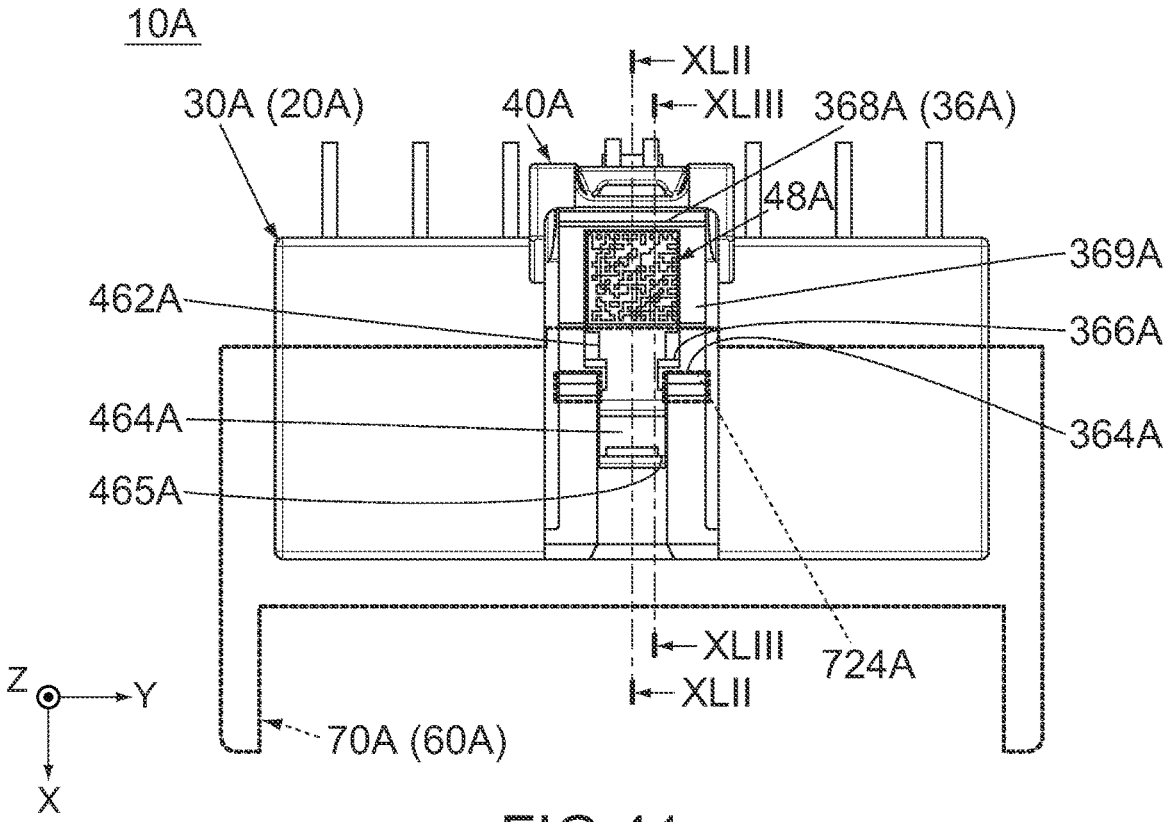
FIG. 41 is a top view showing the connector assembly of FIG. 38, wherein the mating connector is only partially illustrated with dashed line, and the second housing of the connector is located at an exposing position.

Referring to FIG. 41 together with FIG. 34, when the second housing 40A is located at the exposing position, the mark 48A is located forward of the cover portion 368A and is entirely exposed from the cover portion 368A. The reader device (not shown) can correctly read the mark 48A which is completely exposed as described above, and thereby it can be found that the second housing 40A is located at the exposing position, and that the mated state is locked.

Summarizing the explanation described above with reference to FIGS. 38 to 43, the second housing 40A of the present embodiment is held by the first housing 30A to be locatable at each of the covering position shown in FIGS. 38 to 40 and the exposing position shown in FIGS. 41 to 43. In other words, the second housing 40A is held by the first housing 30A to be movable relative to the first housing 30A. However, when the second housing 40A is located at the covering position, the stoppers 366A regulate the movement of the stopped portion 464A in the positive X-direction so that the second housing 40A cannot be moved to the exposing position along the positive X-direction.

When the second housing 40A, which is located at the covering position and is under the regulated state, is received into the receiving portion 62A along the positive X-direction together with the first housing 30A, the first terminals 52A are connected to the first mating terminals 82A, and then the stopped portion (supported portion) 464A is brought into abutment with the release projection 722A so that a movement regulation of the stopped portion 464A made by the stoppers 366A is released. Thus, the release projection 722A releases the movement regulation of the second housing 40A in the positive X-direction.

When the second housing 40A is moved to the exposing position along the positive X-direction after release of the movement regulation, the regulation portion 461A is located inward of the cover portion 368A in the Z-direction to regulate the movement of the lock portions 364A in the Z-direction. As a result, the mated state where the first housing 30A is received in the receiving portion 62A cannot be unlocked. Thus, the connector assembly 10A of the present embodiment has a CPA mechanism which locks the mated state of the connector 20A with the mating connector 60A.

Referring to FIG. 38, when the second housing 40A is located at the covering position, the mechanically readable mark 48A of the second housing 40A is covered and hidden and thereby cannot be mechanically read. On the other hand, referring to FIG. 41, when the second housing 40A is located at the exposing position, the mark 48A is entirely exposed from the cover portion 368A and thereby can be mechanically read by the reader device (not shown). By mechanically reading the mark 48A, it becomes possible to accurately detect and control whether the mated state of the connector 20A is locked or not, without the use of visual inspection. Thus, the present embodiment provides the connector assembly 10A which allows more reliable inspection on whether the mated state is locked or not in comparison with the existing inspection.

Referring to FIGS. 42 and 43, according to the present embodiment, the first structure 36A of the first housing 30A and the second structure 46A of the second housing 40A work as the CPA mechanism together with the release projection 722A and the mating lock portions 724A of the mating connector 60A. However, the present invention is not limited thereto, but the CPA mechanism of the present invention can be variously modified as described below.

Referring to FIGS. 36 and 37, the stoppers 366A of the first housing 30A of the present embodiment are supported by the first support portions 362A to be movable. However, the present invention is not limited thereto, but the stoppers 366A may be provided not to be moved relative to the first housing 30A.

The second support portion 462A of the present embodiment is provided to the second housing 40A. The second support portion 462A supports the stopped portion 464A as the supported portion. This structure enables more flexible design. However, the present invention is not limited thereto. For example, the first housing 30A may be provided, in addition to the first support portions 362A, with a second support portion which supports the stoppers 366A so that he stoppers 366A are movable. In this instance, the stopped portion 464A may be provided to be unmovable relative to the second housing 40A. Thus, one of the first housing 30A and the second housing 40A should be provided with a second support portion which has the restoring force. This second support portion should support a supported portion which is one of the stoppers 366A and the stopped portion 464A. The supported portion should be movable in the Z-direction by using the restoring force of the second support portion.

Referring to FIGS. 38 to 43, as described above, when the second housing 40A is received into the receiving portion 62A along the positive X-direction together with the first housing 30A, the first terminals 52A are connected to the first mating terminals 82A. Thereafter, not the stopped portion (supported portion) 464A but the second support portion 462A may be brought into abutment with the release projection 722A so that the movement regulation of the stopped portion 464A by the stoppers 366A is released. Thus, one of the second support portion 462A and the supported portion 464A should be brought into abutment with the release projection 722A so that the movement regulation of the stopped portion 464A by the stoppers 366A, i.e. the movement regulation of the second housing 40A in the positive X-direction, is released.

Referring to FIG. 33, the cover portion 368A of the present embodiment is a part of the first structure 36A. However, the present invention is not limited thereto. For example, the cover portion 368A may be a part other than the first structure 36A. Referring to FIGS. 41 to 43, in this instance, when the second housing 40A is moved to the exposing position, a part of the second housing 40A should be located under the first support portions 362A or the lock portions 364A and work as a regulation portion.

As described above, the cover portion 368A may be a part integral with the first structure 36A or a part separated from the first structure 36A. In any case, the first housing 30A should be provided with the cover portion 368A and the first structure 36A which includes the first support portions 362A and the lock portions 364A. According to the present embodiment and its modifications, when the second housing 40A is moved to the exposing position along the positive X-direction after the release of the movement regulation of the stopped portion 464A made by the stoppers 366A, the regulation portion 461A is located inward of at least a part of the first structure 36A in the Z-direction to regulate a movement of the lock portions 364A in the Z-direction.

Hereafter, explanation will be made about the HVIL mechanism of the connector assembly 10A.

Referring to FIG. 40, as previously described, the first terminals 52A are connected to the first mating terminals 82A when the connector 20A takes the incompletely mated state. In contrast, the contact portions 542A of the second terminals 54A are not in contact with the mating contact portions 842A of the second mating terminals 84A when the connector 20A takes the incompletely mated state. In other words, the second terminals 54A are unconnected to the second mating terminals 84A. According to the present embodiment, high-voltage power is not supplied to the mating connector 60A until the second terminals 54A are connected to the second mating terminals 84A, respectively.

Referring to FIG. 43, when the second housing 40A is moved from the covering position toward the exposing position, the mating contact portions 842A of the second mating terminals 84A are brought into contact with the contact portions 542A of the second terminals 54A, respectively. Thus, when the second housing 40A is further moved in the positive X-direction after the release of the movement regulation of the stopped portion 464A made by the stoppers 366A, the second terminals 54A are connected to the second mating terminals 84A, respectively, and the second housing 40A is moved to the exposing position. According to the present embodiment, when the second housing 40A is moved to the exposing position along the positive X-direction after the release of the movement regulation, the second terminals 54A are connected to the second mating terminals 84A. As a result, high-voltage power supply to the mating connector 60A starts.

When the high-voltage power supply to the mating connector 60A starts, the regulation portion 461A regulates a movement of the lock portions 364A in the Z-direction as previously described. As described above, when the second housing 40A is further moved in the positive X-direction after the release of the movement regulation, the second terminals 54A are connected to the second mating terminals 84A, respectively, and the regulation portion 461A is located inward of at least a part of the first structure 36A in the Z-direction to regulate a movement of the lock portions 364A in the Z-direction.

The connector assembly 10A of the present embodiment has the aforementioned HVIL mechanism configured to prevent electric shock which might be caused by high-voltage power. However, the present invention is not limited thereto, but the structure of the HVIL mechanism can be modified as necessary. For example, referring to the figure in dashed circle of FIG. 9, the number of the second terminals 54A may be two, and the two second terminals 54A may be connected to each other similarly to the modification of the first embodiment.

Referring to FIG. 42, the connector 20A of the present embodiment has a mechanism which securely maintains the second housing 40A at the exposing position when the second housing 40A is located at the exposing position. This mechanism is formed of the additional structure 38A of the first housing 30A and the additional structure 43A of the second housing 40A. Hereafter, explanation will be made about the structure of each of the additional structure 38A and the additional structure 43A.

Figure 44:
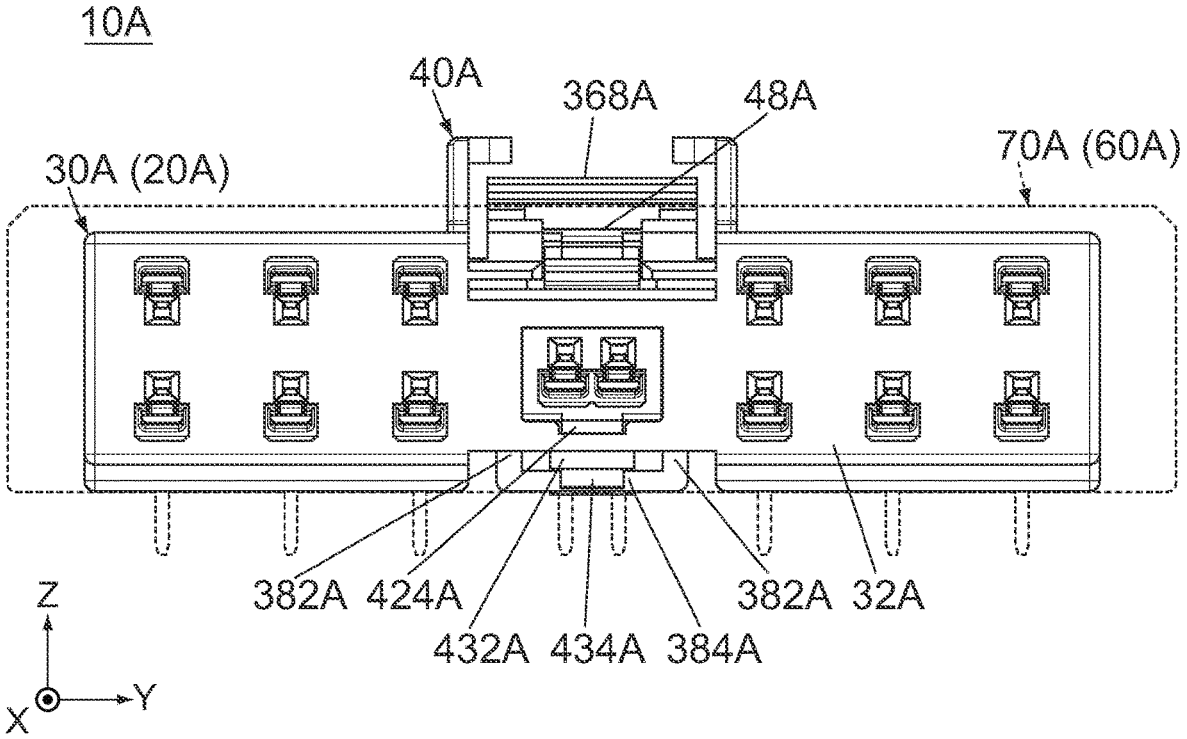
FIG. 44 is a front view showing the connector assembly of FIG. 41, wherein the mating connector is only partially illustrated with dashed line.
Figure 45:
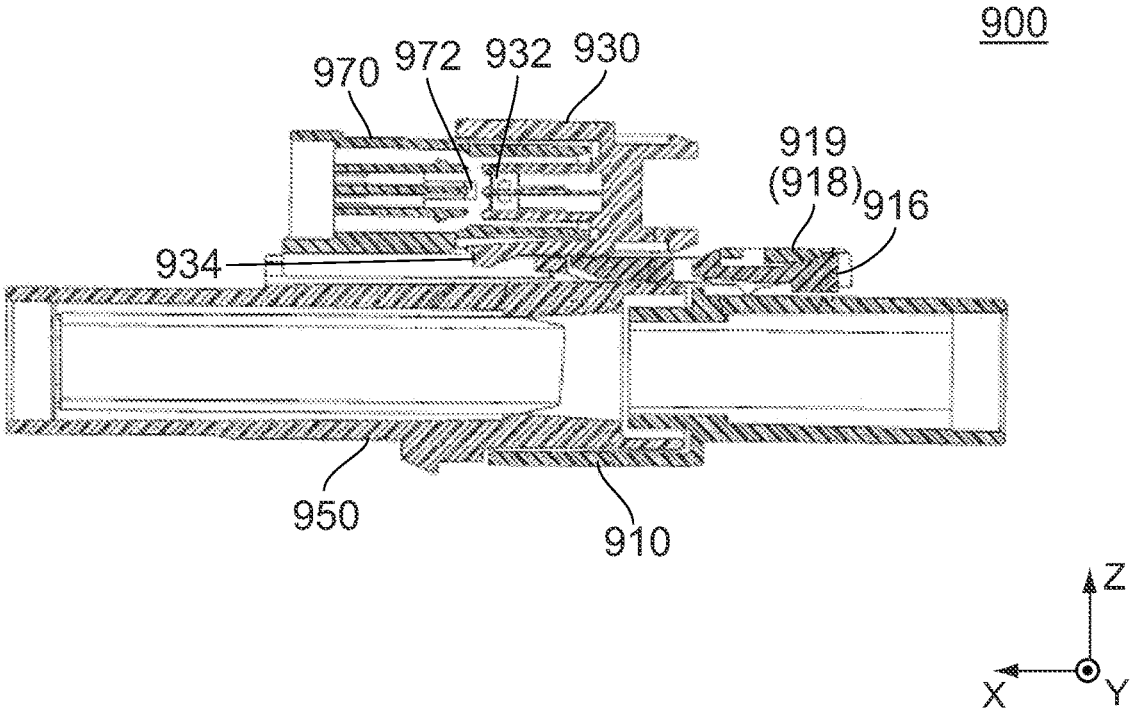
FIG.45 PRIOR ART
FIG. 45 is a cross-sectional view showing a connector assembly of Patent Document 1, wherein a female high-voltage connector and a male high-voltage connector are mated with each other, and a female HVIL connector and a male HVIL connector are mated with each other.
Figure 46:
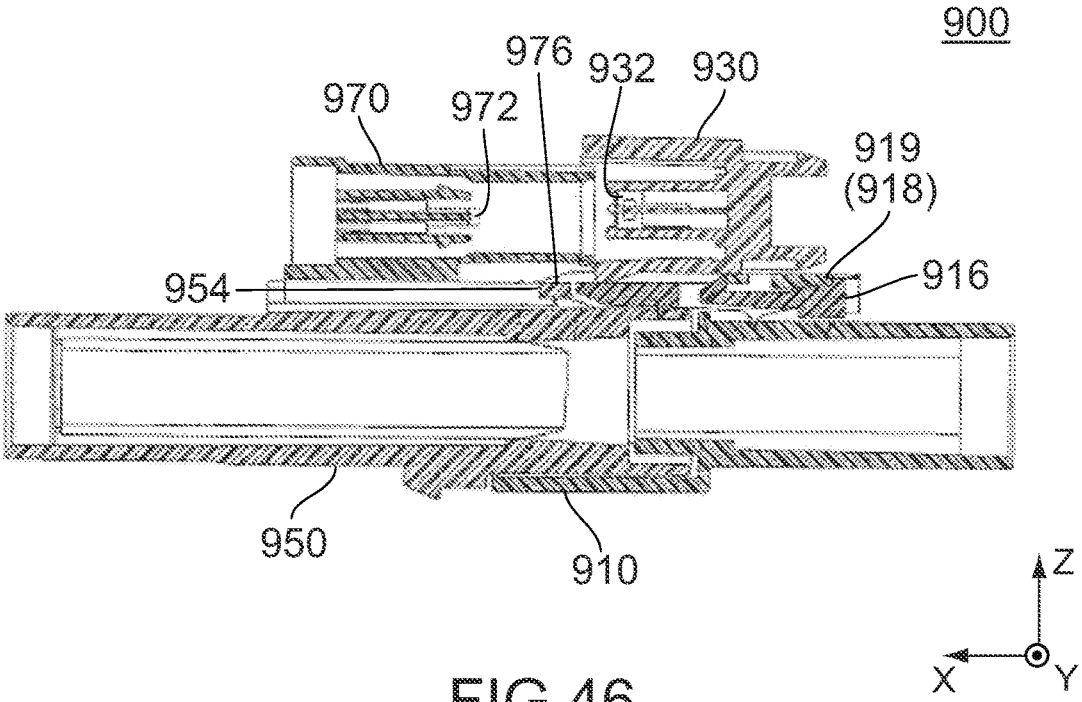
FIG.46 PRIOR ART
FIG. 46 is another cross-sectional view showing the connector assembly of FIG. 45, wherein the female high-voltage connector and the male high-voltage connector are mated with each other, but the female HVIL connector and the male HVIL connector are under unmated state.
Figure 47:
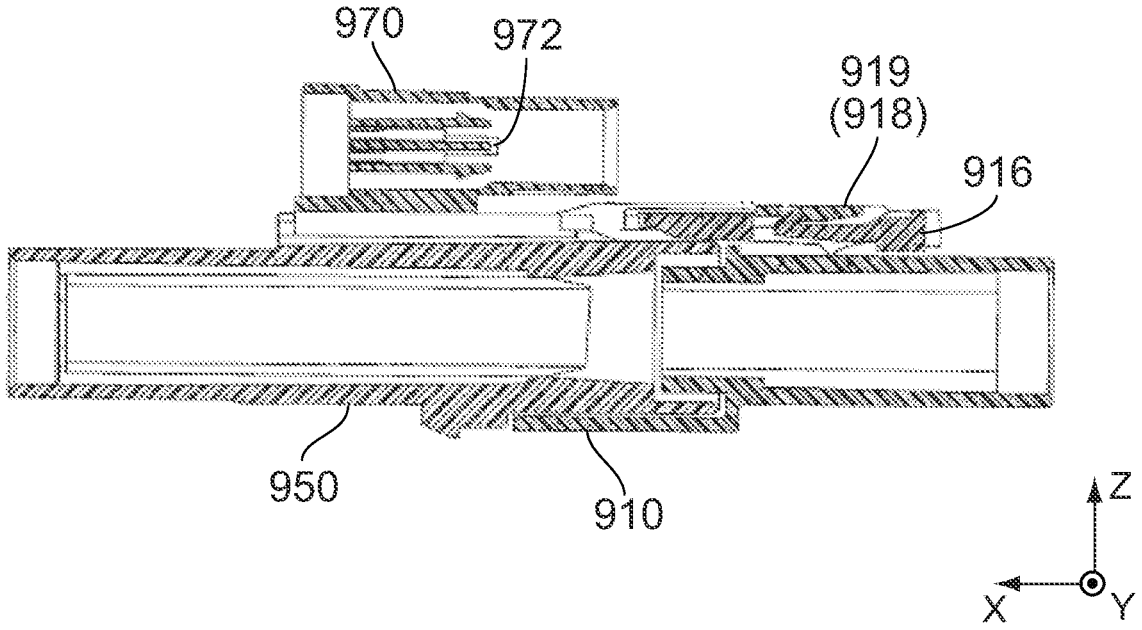
FIG.47 PRIOR ART
FIG. 47 is still another cross-sectional view showing the connector assembly of FIG. 45, wherein the female high-voltage connector and the male high-voltage connector are mated with each other, but the female HVIL connector is removed from the female high-voltage connector.

Referring to FIGS. 31 and 44, the additional structure 38A of the present embodiment includes two support plates 382A and an additional locked portion 384A. Thus, the first housing 30A is provided with the support plates 382A and the additional locked portion 384A. The support plates 382A are arranged in the Y-direction and extend downward from the base portion 32A. The additional locked portion 384A extends along the Y-direction and is connected to lower ends of the two support plates 382A. Thus, the first housing 30A has the additional locked portion 384A which is supported by the support plates 382A. The additional locked portion 384A of the present embodiment has a rear end formed with a guide surface and a front end formed with a stop surface. The guide surface of the additional locked portion 384A is a gentle slope which relatively gently slopes rearward and downward. The stop surface of the additional locked portion 384A is a vertical surface which extends along the YZ-plane.

Referring to FIGS. 31 and 34, the additional structure 43A of the present embodiment includes an additional support portion 432A and an additional lock portion 434A. Thus, the second housing 40A is provided with the additional support portion 432A and the additional lock portion 434A. The additional support portion 432A is connected to the lower surface of the body portion 42A and extends rearward while being away from the lower surface of the body portion 42A. Thus, the additional support portion 432A is a cantilevered spring and is resiliently deformable. In other words, the additional support portion 432A of the present embodiment has a restoring force which is a resilient force thereof.

Referring to FIG. 36, the additional lock portion 434A projects downward from the additional support portion 432A. Thus, the additional support portion 432A supports the additional lock portion 434A. The additional lock portion 434A is movable in the Z-direction by using the restoring force of the additional support portion 432A. The additional lock portion 434A of the present embodiment has a front end formed with a guided surface and a rear end formed with a stopped surface. The guided surface of the additional lock portion 434A is a gentle slope which relatively gently slopes rearward and downward. The stopped surface of the additional lock portion 434A is a vertical surface which extends along the YZ-plane.

Referring to FIGS. 39 and 40, when the second housing 40A is located at the covering position, the additional lock portion 434A is located rearward of the additional locked portion 384A. Referring to FIGS. 42 and 43, when the second housing 40A is moved from the covering position to the exposing position, the guided surface of the front end of the additional lock portion 434A is guided by the guide surface of the rear end of the additional locked portion 384A so that the additional lock portion 434A is moved beyond the additional locked portion 384A.

When the second housing 40A is moved to the exposing position, the additional lock portion 434A is located forward of the additional locked portion 384A. When the second housing 40A is pulled rearward, the stopped surface of the rear end of the additional lock portion 434A is stopped by the stop surface of the front end of the additional locked portion 384A so that a movement of the second housing 40A toward the covering position is prevented. Thus, the additional lock portion 434A and the additional locked portion 384A lock the second housing 40A at the exposing position when the second housing 40A is located at the exposing position.

Each of the additional structure 38A and the additional structure 43A of the present embodiment has the aforementioned structure. However, the structure of each of the additional structure 38A and the additional structure 43A is not limited to the present embodiment but can be modified as necessary. Moreover, the additional structure 38A and the additional structure 43A may be provided as necessary.

Referring to FIGS. 42 and 43, the lock by the additional lock portion 434A and the additional locked portion 384A can be released when the additional support portion 432A is lifted upward. When the second housing 40A is pulled rearward after the aforementioned release of the lock, the second housing 40A is moved to the covering position. Referring to FIGS. 39 and 40, when the second housing 40A is moved to the covering position, the first housing 30A can be removed from the receiving portion 62A together with the second housing 40A by moving the lock portions 364A to a position located below the mating lock portions 724A.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector assembly comprising a connector and a mating connector, wherein:

the mating connector comprises a first mating terminal, a second mating terminal, and a mating housing;

the mating housing holds the first mating terminal and the second mating terminal;

the mating housing defines a receiving portion;

the mating housing comprises a release projection and a mating lock portion;

the release projection projects into the receiving portion;

the mating lock portion faces the receiving portion;

the connector is mateable with the mating connector along a mating direction;

the connector comprises a first terminal, a first housing, a second terminal, and a second housing;

the first housing is configured to be received into the receiving portion along the mating direction;

the first housing holds the first terminal;

the first terminal is connected to the first mating terminal when the first housing is received in the receiving portion;

the first housing is provided with a stopper and a first structure which includes a first support portion and a lock portion;

the first support portion has a restoring force and supports the lock portion;

the lock portion is movable in a perpendicular direction perpendicular to the mating direction by using the restoring force of the first support portion;

the lock portion and the mating lock portion lock a state where the first housing is received in the receiving portion when the first terminal is connected to the first mating terminal;

the second housing holds the second terminal;

the second housing is provided with a stopped portion and a regulation portion;

the second housing is provided with a second support portion;

the second support portion has a restoring force and supports the stopped portion as a supported portion;

the supported portion is movable in the perpendicular direction by using the restoring force of the second support portion;

when the second housing is installed to the first housing along the mating direction, the stopped portion is brought into abutment with the stopper, and the second housing takes a regulated state where a movement of the second housing in the mating direction is regulated by the stopper;

when the second housing under the regulated state is received into the receiving portion along the mating direction together with the first housing, the first terminal is connected to the first mating terminal, and then one of the second support portion and the supported portion is brought into abutment with the release projection so that a movement regulation of the second housing in the mating direction is released; and when the second housing is further moved in the mating direction after release of the movement regulation, the second terminal is connected to the second mating terminal, and the regulation portion is located inward of at least a part of the first structure in the perpendicular direction to regulate a movement of the lock portion in the perpendicular direction.

2. The connector assembly as recited in claim 1, wherein the second housing is held by the first housing to be movable relative to the first housing.

3. The connector assembly as recited in claim 1, wherein:

the first structure further includes an operation portion; and when the second housing is further moved in the mating direction after the release of the movement regulation, the second terminal is connected to the second mating terminal, and the regulation portion is located inward of the operation portion in the perpendicular direction to regulate the movement of the lock portion in the perpendicular direction.

4. The connector assembly as recited in claim 1, wherein:

the second housing is provided with an additional lock portion and an additional support portion;

the additional support portion has a restoring force and supports the additional lock portion;

the first housing has an additional locked portion; and when the second terminal is connected to the second mating terminal, the additional lock portion and the additional locked portion lock a state where the second housing is installed to the first housing.

5. The connector assembly as recited in claim 2, wherein:

the first housing is provided with a cover portion;

the second housing is provided with a mechanically readable mark;

the second housing is held by the first housing to be locatable at each of a covering position and an exposing position;

the second housing under the regulated state is located at the covering position;

when the second housing is further moved in the mating direction after the release of the movement regulation, the second terminal is connected to the second mating terminal, and the second housing is moved to the exposing position;

when the second housing is located at the covering position, the mark is, at least in part, covered by and hidden behind the cover; and when the second housing is located at the exposing position, the mark is entirely exposed from the cover.

6. The connector assembly as recited in claim 5, wherein:

the cover is a part of the first structure; and when the second housing is moved to the exposing position along the mating direction after the release of the movement regulation, the regulation portion is located inward of the cover portion in the perpendicular direction to regulate the movement of the lock portion in the perpendicular direction.

7. The connector assembly as recited in claim 5, wherein:

the second housing is provided with an additional lock portion and an additional support portion;

the additional support portion has a restoring force and supports the additional lock portion;

the first housing has an additional locked portion; and the additional lock portion and the additional locked portion lock the second housing at the exposing position when the second housing is located at the exposing position.

8. The connector assembly as recited in claim 5, wherein the mark is a two-dimensional code.

9. The connector assembly as recited in claim 1, wherein:

the first housing is provided with an additional stopper;

the second housing is provided with an additional stopped portion; and when the second housing takes the regulated state, the additional stopper regulates a movement of the additional stopped portion in a removing direction opposite to the mating direction so that the second housing is unremovable from the first housing.

10. The connector assembly as recited in claim 1, wherein the second terminal is connected to a cable.

11. The connector assembly as recited in claim 1, wherein the second terminal comprises two of the second terminals which are connected to each other.

* * * * *